US009072153B2

(12) United States Patent
Wakabayashi et al.

(10) Patent No.: US 9,072,153 B2
(45) Date of Patent: Jun. 30, 2015

(54) EXTREME ULTRAVIOLET LIGHT GENERATION SYSTEM UTILIZING A PRE-PULSE TO CREATE A DIFFUSED DOME SHAPED TARGET

(75) Inventors: Osamu Wakabayashi, Hiratsuka (JP); Tatsuya Yanagida, Hiratsuka (JP); Hakaru Mizoguchi, Oyama (JP)

(73) Assignee: GIGAPHOTON INC., Tochigi (JP)

( * ) Notice: Subject to any disclaimer, the term of this patent is extended or adjusted under 35 U.S.C. 154(b) by 0 days.

(21) Appl. No.: 13/572,248

(22) Filed: Aug. 10, 2012

(65) Prior Publication Data

US 2012/0305811 A1 Dec. 6, 2012

Related U.S. Application Data

(63) Continuation-in-part of application No. 13/523,446, filed on Jun. 14, 2012.

(30) Foreign Application Priority Data

| | | |
|---|---|---|
| Mar. 29, 2010 | (JP) | 2010-074256 |
| Nov. 29, 2010 | (JP) | 2010-265791 |
| Jan. 27, 2011 | (JP) | 2011-015695 |
| Mar. 16, 2011 | (JP) | 2011-058026 |
| Jun. 15, 2011 | (JP) | 2011-133112 |
| Sep. 15, 2011 | (JP) | 2011-201750 |
| Apr. 27, 2012 | (JP) | 2012-103580 |
| Jun. 22, 2012 | (JP) | 2012-141079 |

(51) Int. Cl.
*H05G 2/00* (2006.01)

(52) U.S. Cl.
CPC ..... *H05G 2/008* (2013.01); *H05G 2/003* (2013.01)

(58) Field of Classification Search
CPC ..... H05G 2/00–2/008
USPC ..... 250/504 R
See application file for complete search history.

(56) References Cited

U.S. PATENT DOCUMENTS

| | | | | |
|---|---|---|---|---|
| 4,443,696 | A * | 4/1984 | Taboada | 250/205 |
| 5,799,024 | A * | 8/1998 | Bowers et al. | 372/11 |
| 5,991,360 | A | 11/1999 | Matsui et al. | |
| 6,031,241 | A * | 2/2000 | Silfvast et al. | 250/504 R |
| 7,091,507 | B2 * | 8/2006 | Masaki et al. | 250/504 R |
| 7,239,686 | B2 * | 7/2007 | Berglund et al. | 378/119 |

(Continued)

FOREIGN PATENT DOCUMENTS

| | | |
|---|---|---|
| JP | 09-232694 A | 9/1997 |
| JP | 10-221499 A | 8/1998 |

(Continued)

OTHER PUBLICATIONS

Office Action Japanese Patent Application No. 2011-058026 dated Jul. 8, 2014 with partial English translation.

(Continued)

*Primary Examiner* — Phillip A Johnston
*Assistant Examiner* — Sean Luck
(74) *Attorney, Agent, or Firm* — Studebaker & Brackett PC

(57) ABSTRACT

An apparatus used with a laser apparatus may include a chamber, a target supply for supplying a target material to a region inside the chamber, a laser beam focusing optical system for focusing a laser beam from the laser apparatus in the region, and an optical system for controlling a beam intensity distribution of the laser beam.

20 Claims, 35 Drawing Sheets

(56) References Cited

U.S. PATENT DOCUMENTS

| | | | | |
|---|---|---|---|---|
| 7,308,007 | B2 * | 12/2007 | Rocca et al. | 372/5 |
| 7,317,192 | B2 * | 1/2008 | Ma | 250/396 ML |
| 2002/0041418 | A1 * | 4/2002 | Fillion et al. | 359/201 |
| 2004/0057470 | A1 * | 3/2004 | Rhodes et al. | 372/5 |
| 2005/0117620 | A1 * | 6/2005 | Thro et al. | 372/70 |
| 2005/0178979 | A1 | 8/2005 | Masaki et al. | |
| 2005/0205811 | A1 * | 9/2005 | Partlo et al. | 250/504 R |
| 2006/0215712 | A1 * | 9/2006 | Ziener et al. | 372/2 |
| 2007/0007469 | A1 | 1/2007 | Murakami et al. | |
| 2007/0086713 | A1 * | 4/2007 | Ingmar et al. | 385/122 |
| 2007/0090304 | A1 | 4/2007 | Jonkers et al. | |
| 2007/0242705 | A1 * | 10/2007 | Faure et al. | 372/5 |
| 2008/0015662 | A1 * | 1/2008 | Tunnermann et al. | 607/89 |
| 2008/0149862 | A1 * | 6/2008 | Hansson et al. | 250/504 R |
| 2008/0179548 | A1 * | 7/2008 | Bykanov et al. | 250/504 R |
| 2009/0027753 | A1 * | 1/2009 | Lizotte | 359/238 |
| 2010/0040105 | A1 * | 2/2010 | Rocca et al. | 372/75 |

FOREIGN PATENT DOCUMENTS

| | | | |
|---|---|---|---|
| JP | 2000-299197 | A | 10/2000 |
| JP | 2003-270551 | A | 9/2003 |
| JP | 2003-270551 | A | 9/2003 |
| JP | 2003-272892 | A | 9/2003 |
| JP | 2004-006716 | A | 1/2004 |
| JP | 2005-235959 | A | 9/2005 |
| JP | 2005-276673 | A | 10/2005 |
| JP | 2008-103151 | A | 5/2008 |
| JP | 2009-105006 | A | 5/2009 |

OTHER PUBLICATIONS

United States Office Action issued in U.S. Appl. No. 13/523,446 dated Jun. 10, 2013.

United States Office Action issued in U.S. Appl. No. 13/523,446 dated Jul. 3, 2014.

United States Office Action issued in U.S. Appl. No. 13/523,446 dated Jan. 30, 2014.

* cited by examiner

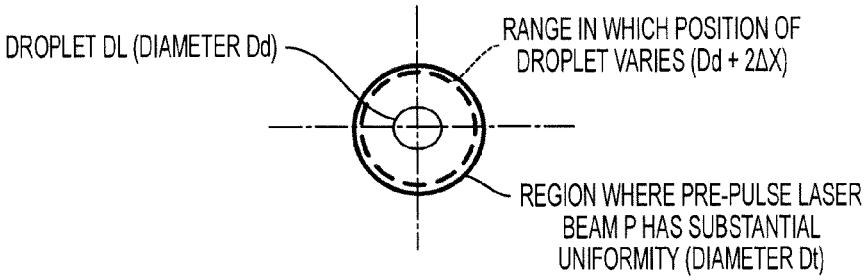
FIG. 4A
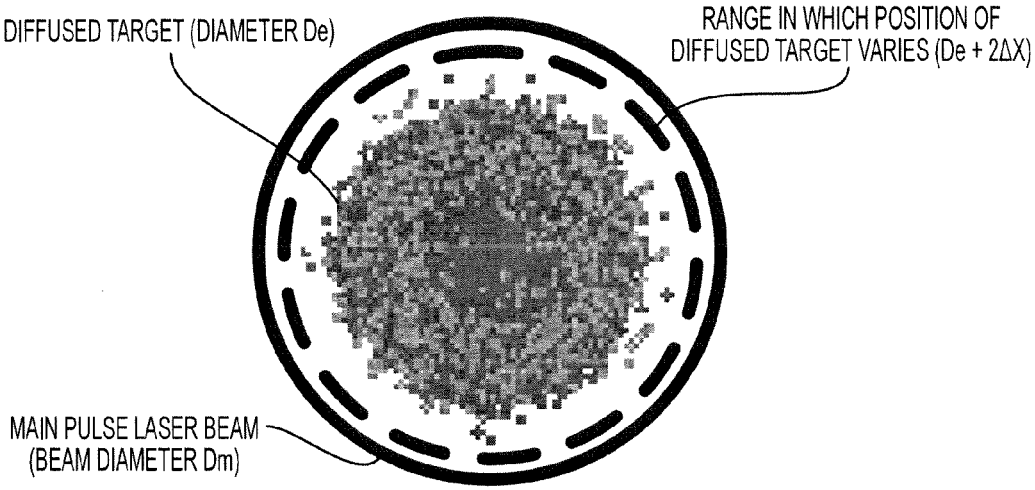
FIG. 4B
| VARIATION ΔX OF DROPLET | PROBABILITY OF DROPLET NOT IRRADIATED WITH UNIFORM REGION |
|---|---|
| 1σ | $1.59 \times 10^{-1}$ |
| 2σ | $2.28 \times 10^{-2}$ |
| 3σ | $1.35 \times 10^{-3}$ |
| 4σ | $3.17 \times 10^{-5}$ |
| 5σ | $2.87 \times 10^{-7}$ |
| 6σ | $9.87 \times 10^{-10}$ |
| 7σ | $1.28 \times 10^{-12}$ |
| 8σ | $6.22 \times 10^{-16}$ |
| 9σ | $1.13 \times 10^{-19}$ |
| 10σ | $7.62 \times 10^{-24}$ |
FIG. 5

| | CASE 1 | CASE 2 | CASE 3 | CASE 4 |
|---|---|---|---|---|
| BEAM DIAMETER | TOP-HAT | TOP-HAT | TOP-HAT | TOP-HAT |
| PULSE ENERGY E (mJ) | 0.3 | 0.3 | 0.3 | 0.5 |
| PULSE DURATION T (ns) | 20 | 10 | 0.1 | 0.05 |
| DIAMETER OF UNIFORM REGION Dt (μm) | 30 | 30 | 30 | 30 |
| BEAM INTENSITY W ($W/cm^2$) | $2.12 \times 10^9$ | $4.24 \times 10^9$ | $4.24 \times 10^{11}$ | $1.41 \times 10^{12}$ |

FIG. 21

EXTREME ULTRAVIOLET LIGHT GENERATION SYSTEM UTILIZING A PRE-PULSE TO CREATE A DIFFUSED DOME SHAPED TARGET

CROSS-REFERENCE TO RELATED APPLICATIONS

The present application is a continuation-in-part of U.S. patent application Ser. No. 13/523,446 filed Jun. 14, 2012, which claims priority from Japanese Patent Application No. 2010-074256 filed Mar. 29, 2010, Japanese Patent Application No. 2010-265791 filed Nov. 29, 2010, Japanese Patent Application No. 2011-015695 filed Jan. 27, 2011, Japanese Patent Application No. 2011-058026 filed Mar. 16, 2011, Japanese Patent Application No. 2011-133112 filed Jun. 15, 2011, and Japanese Patent Application No. 2011-201750 filed Sep. 15, 2011. The present application further claims priority from Japanese Patent Application No. 2012-103580 filed Apr. 27, 2012, and Japanese Patent Application No. 2012-141079 filed Jun. 22, 2012.

BACKGROUND

1. Technical Field

This disclosure relates to an extreme ultraviolet (EUV) light generation system.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

An apparatus according to one aspect of this disclosure may be used with a laser apparatus and may include a chamber, a target supply for supplying a target material to a region inside the chamber, a laser beam focusing optical system for focusing a laser beam from the laser apparatus in the region, and an optical system for controlling a beam intensity distribution of the laser beam.

A system for generating extreme ultraviolet light according to another aspect of this disclosure may include a laser apparatus, a chamber, a target supply for supplying a target material to a region inside the chamber, a laser beam focusing optical system for focusing the laser beam in the region inside the chamber, an optical system for adjusting a beam intensity distribution of the laser beam, and a laser controller for controlling a timing at which the laser beam is outputted from the laser apparatus.

BRIEF DESCRIPTION OF THE DRAWINGS

FIG. 4A shows the relationship between a diameter of a droplet and a diameter of a pre-pulse laser beam in this disclosure, as viewed in the direction of the beam axis.

FIG. 4B shows the relationship between a diameter of a diffused target and a diameter of a main pulse laser beam in this disclosure, as viewed in the direction of the beam axis.

FIG. 5 is a table showing examples of a variation $\Delta X$ in the position of a droplet.

FIG. 21 is a table showing examples of irradiation conditions of the pre-pulse laser beam in this disclosure.

DETAILED DESCRIPTION

Figure 1A:
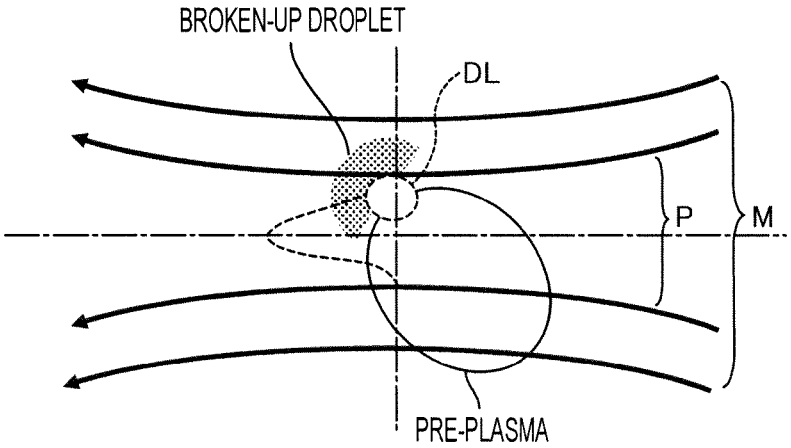
FIGS. 1A through 1C are diagrams for discussing a technical issue pertaining to this disclosure.

Hereinafter, selected embodiments of this disclosure will be described in detail with reference to the accompanying drawings. The embodiments to be described below are merely illustrative in nature and do not limit the scope of this disclosure. Further, the configuration(s) and operation(s) described in each embodiment are not all essential in implementing this disclosure. Note that like elements are referenced by like reference numerals and characters, and duplicate descriptions thereof will be omitted herein.

Contents

1. Background of Embodiments
2. Overview of Embodiments
3. Diameter of Region of Substantial Uniformity
4. Examples of Beam Intensity Distribution
5. First Embodiment
6. Examples of Beam-Shaping Optical systems
7. Second Embodiment
8. Third Embodiment
9. Fourth Embodiment
10. Fifth Embodiment
11. Sixth Embodiment
12. Irradiation Conditions of Pre-pulse Laser Beam
13. Seventh Embodiment
14. Eighth Embodiment
15. Ninth Embodiment
15.1 Configuration
15.2 Operation
16. Control of Fluence
17. Control of Delay Time
18. Tenth Embodiment 18.1 Configuration
18.2 Operation
18.3 Parameters of Pre-pulse Laser Beam
18.3.1 Relationship between Pulse Duration and CE
18.3.2 Relationship between Pulse Duration and Fluence, and Relationship between Pulse Duration and Beam Intensity
18.3.3 Relationship between Pulse Duration and State of Diffused Target
18.3.4 Generation Process of Diffused Target
18.3.5 Range of Pulse Duration
18.3.6 Range of Fluence
18.4 Pre-pulse Laser Apparatus
18.4.1 General Configuration
18.4.2 Mode-Locked Laser Device
18.4.3 Regenerative Amplifier
18.4.3.1 When Voltage Is Not Applied to Pockels Cell
18.4.3.2 When Voltage Is Applied to Pockels Cell
18.4.4 Timing Control
18.4.5 Examples of Laser Medium
18.5 Main Pulse Laser Apparatus
19. Eleventh Embodiment

1. Background of Embodiments

Figure 1B:
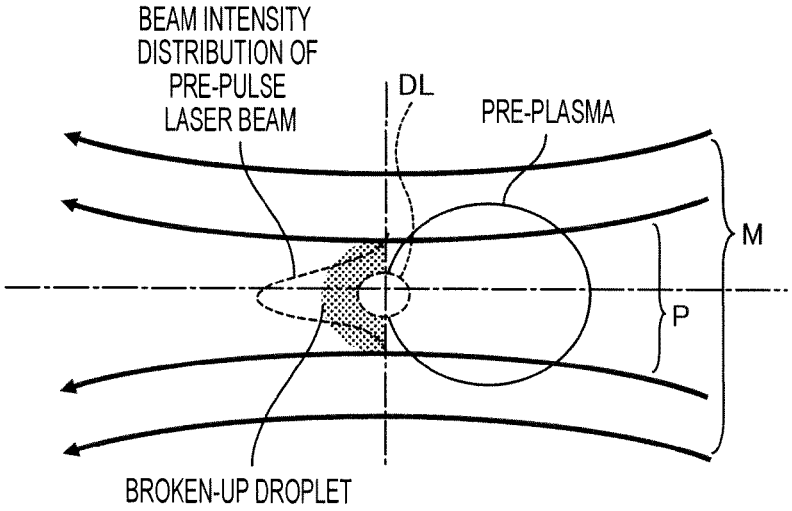
Figure 1C:
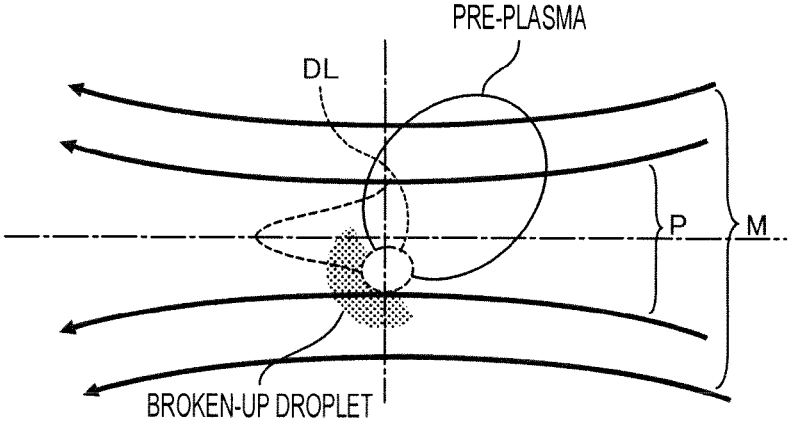

FIGS. 1A through 1C are diagrams for discussing a technical issue pertaining to this disclosure. FIGS. 1A through 1C each shows that a droplet DL of a target material is irradiated with a pre-pulse laser beam P. It is preferable that the pre-pulse laser beam P strikes the droplet DL at a timing at which the droplet DL reaches the intersection of dash-dotted lines as shown in FIG. 1B.

Although it varies depending on conditions such as the diameter of the droplet DL and the beam intensity of the pre-pulse laser beam P, when the droplet DL is irradiated with the pre-pulse laser beam P, pre-plasma may be generated from a surface of the droplet DL that has been irradiated with the pre-pulse laser beam P. As shown in FIG. 1B, the pre-plasma may jet out in a direction substantially opposite to the direction in which the pre-pulse laser beam P travels. The pre-plasma may be a vaporized target material that includes ions and neutral particles of the target material generated from the surface of the droplet DL that has been irradiated with the pre-pulse laser beam P. The phenomenon where the pre-plasma is generated is referred to as laser ablation.

Further, when the droplet DL is irradiated with the pre-pulse laser beam P, the droplet DL may be broken up. As shown in FIG. 1B, the broken-up droplet DL may be diffused in a direction in which the pre-pulse laser beam P travels due to the reaction force of the jetting-out pre-plasma.

Hereinafter, a target that includes at least one of the pre-plasma and the broken-up droplet generated when a droplet is irradiated with a pre-pulse laser beam P may be referred to as a diffused target.

The position of the droplet DL relative to the center of the pre-pulse laser beam P at the time of irradiating the droplet DL with the pre-pulse laser beam P may vary. As shown in FIG. 1A, the position of the droplet DL may be offset upwardly from the intersection of the dash-dotted lines. As shown in FIG. 1C, the position of the droplet DL may also be offset downwardly from the intersection of the dash-dotted lines. To counter this, in one method, it may be possible to increase the diameter of the pre-pulse laser beam P so that the pre-pulse laser beam P can strike the droplet even when the position of the droplet relative to the pre-pulse laser beam P varies.

Typically, the beam intensity distribution of a laser beam outputted from a laser apparatus is in a Gaussian distribution. Because of the Gaussian distribution as shown by the dotted lines in FIGS. 1A through 1C, the pre-pulse laser beam P may have a higher beam intensity around at its center portion around the beam axis, but has a lower beam intensity at its peripheral portion. When the droplet DL is irradiated with the pre-pulse laser beam P having such a beam intensity distribution, there is a possibility for the droplet DL to be irradiated with the pre-pulse laser beam P such that the center of the droplet DL is offset from the beam axis of the pre-pulse laser beam P, as shown in FIGS. 1A and 1C.

When the droplet DL is irradiated with the pre-pulse laser beam P of the Gaussian beam intensity distribution such that the center of the droplet DL is offset from the beam axis of the pre-pulse laser beam P, the energy of the pre-pulse laser beam P may be provided disproportionately to the droplet DL. That is, the energy of the pre-pulse laser beam P may be provided intensively to a part of the droplet DL which is closer to the center of the Gaussian beam intensity distribution in the pre-pulse laser beam P (see FIGS. 1A and 1C). As a result, the pre-plasma may jet out in a direction that is different from the beam axis of the pre-pulse laser beam P. Further, the aforementioned broken-up droplet may be diffused in a direction that is different from the beam axis of the pre-pulse laser beam P due to the reaction force of the jetting-out pre-plasma.

In this way, a diffused target which is generated when a droplet is irradiated with a pre-pulse laser beam P having the Gaussian beam intensity distribution may be diffused in a direction that is different from the direction of the beam axis depending on the position of the droplet relative to the beam axis of the pre-pulse laser beam P when the droplet is irradiated with the pre-pulse laser beam P. Accordingly, it may become difficult to irradiate the diffused target stably with a main pulse laser beam M.

2. Overview of Embodiments

Figure 2A:
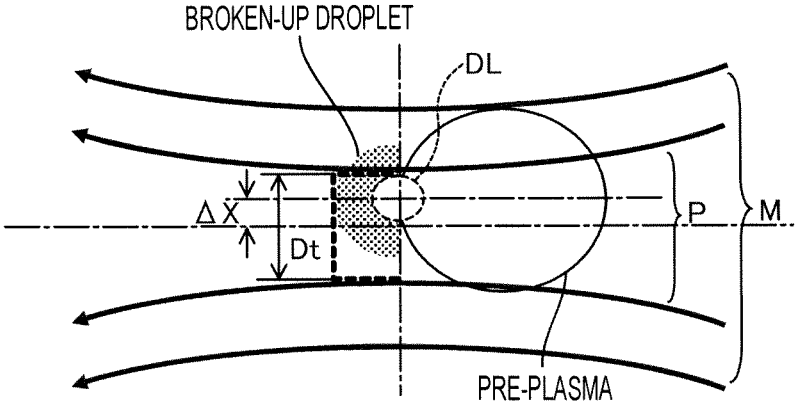
FIGS. 2A through 2C each show a droplet of a target material being irradiated with a pre-pulse laser beam in this disclosure.
Figure 2B:
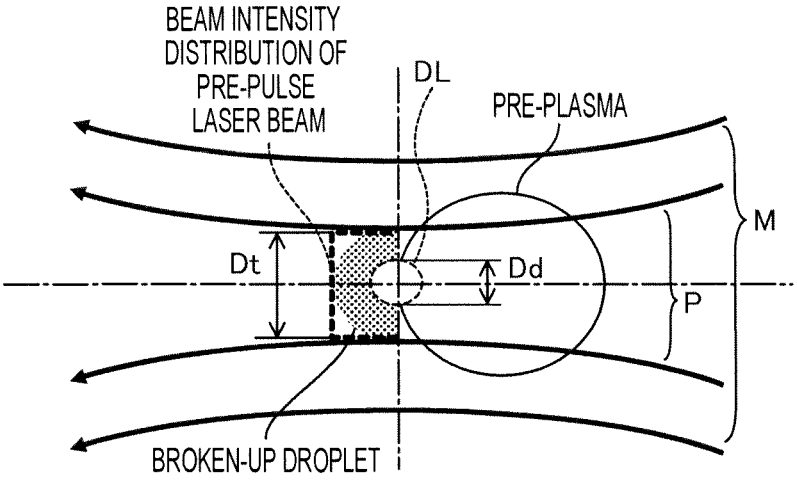
Figure 2C:
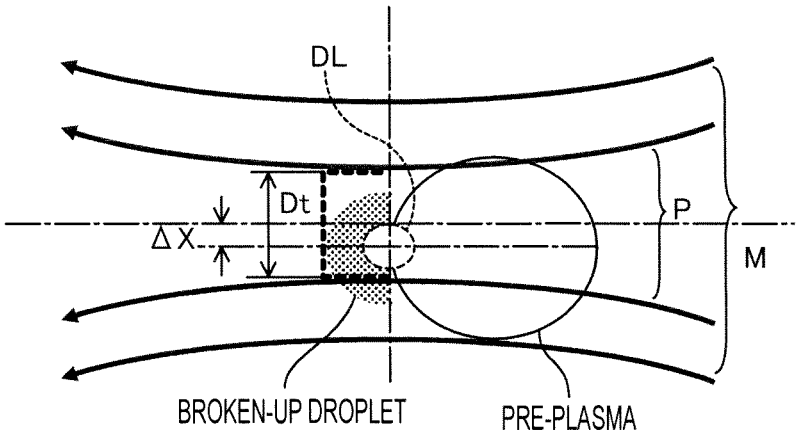

FIGS. 2A through 2C each show a droplet of a target material irradiated with a pre-pulse laser beam in this disclosure. As shown in FIGS. 2A through 2C, as in the cases shown in FIGS. 1A through 1C, the position of the droplet DL relative to the beam axis of the pre-pulse laser beam P when the droplet DL is irradiated with the pre-pulse laser beam P may vary. However, in the cases shown in FIGS. 2A through 2C, the pre-pulse laser beam P may have such a beam intensity distribution that includes a region (diameter Dt) where the beam intensity along a cross-section of the pre-pulse laser beam P has substantial uniformity.

In the cases shown in FIGS. 2A through 2C, the droplet DL is located within the region (diameter Dt) where the beam intensity along the cross-section of the pre-pulse laser beam P has substantial uniformity. Thus, the droplet DL may be irradiated with the pre-pulse laser beam P with substantially uniform beam intensity across the irradiation surface of the droplet DL. Accordingly, even when the position of the droplet DL relative to the beam axis of the pre-pulse laser beam P varies when the droplet DL is irradiated with the pre-pulse laser beam P, the target material forming the droplet DL may be diffused in a direction perpendicular to the beam axis of the pre-pulse laser beam P. As a result, the entire diffused target may be irradiated with the main pulse laser beam M.

Figure 3A:
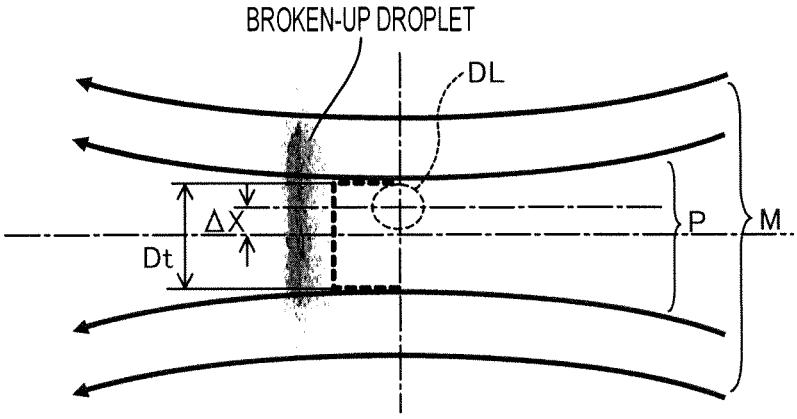
FIGS. 3A through 3C each show another example of a droplet of a target material being irradiated with a pre-pulse laser beam in this disclosure.
Figure 3B:
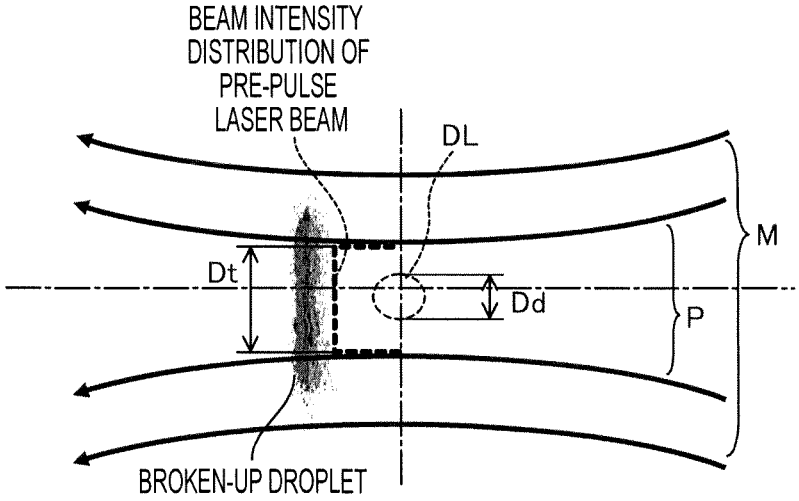
Figure 3C:
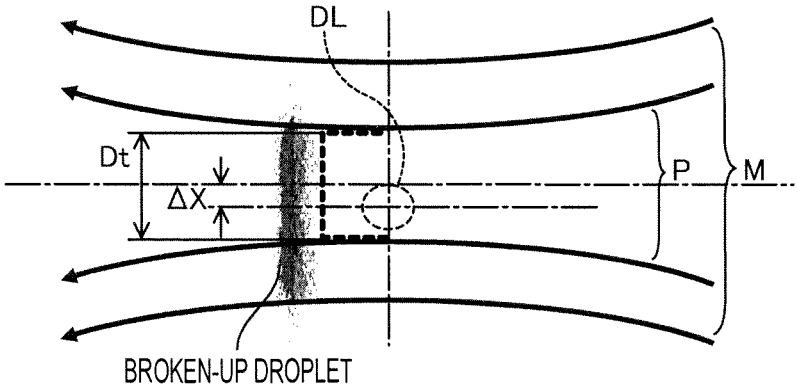

FIGS. 3A through 3C each show another example of a droplet of a target material irradiated with a pre-pulse laser beam in this disclosure. In the cases shown in FIGS. 3A through 3C, as in the cases shown in FIGS. 2A through 2C, the pre-pulse laser beam P may have such a beam intensity distribution that includes the region (diameter Dt) where the beam intensity along the cross-section of the pre-pulse laser beam P has substantial uniformity.

In the cases shown in FIGS. 3A through 3C, the droplet DL, when irradiated with the pre-pulse laser beam P, may be broken up and diffused in a disc-shape to form a diffused target. Such a diffused target may be obtained under the condition where the droplet DL is a mass-limited droplet (approximately 10 μm in diameter) and the beam intensity of the pre-pulse laser beam P is controlled to substantial intensity, which will be described later.

In the cases shown in FIGS. 3A through 3C, even when the position of the droplet DL relative to beam axis of the pre-pulse laser beam P varies, the droplet DL may be located within the region (diameter Dt) where the beam intensity along the cross-section of the pre-pulse laser beam P has substantial uniformity. Thus, the droplet DL may be irradiated with the pre-pulse laser beam P at substantially uniform beam intensity across the irradiation surface of the droplet DL. Accordingly, even when the position of the droplet DL relative to the beam axis of the pre-pulse laser beam P varies when the droplet DL is irradiated with the pre-pulse laser beam P, the target material forming the droplet DL may be diffused in a direction perpendicular to the beam axis of the pre-pulse laser beam P. As a result, the entire diffused target may be irradiated with the main pulse laser beam M.

3. Diameter of Region of Substantial Uniformity

With reference to FIGS. 2A through 3C, the diameter Dt of the region where the beam intensity along the cross-section of the pre-pulse laser beam P has substantial uniformity will now be discussed.

In order to diffuse a target in the direction perpendicular to the beam axis of the pre-pulse laser beam P when the droplet DL is irradiated with the pre-pulse laser beam P, the droplet DL may be irradiated with the pre-pulse laser beam P with substantially uniform beam intensity across a hemispherical surface thereof. Accordingly, when the diameter of the droplet DL is Dd, the diameter Dt of the aforementioned region may be larger than the diameter Dd.

Further, when the position of the droplet DL relative to the beam axis of the pre-pulse laser beam P when the droplet DL is irradiated with the pre-pulse laser beam P may vary, a possible variation ΔX (see FIGS. 3A and 3C) may be taken into consideration. For example, the diameter Dt of the aforementioned region may satisfy the following condition.

$$Dt \geq Dd + 2\Delta X$$

That is, the diameter Dt of the aforementioned region may be equal to or larger than the sum of the diameter Dd of the droplet DL and the variation ΔX in the position of the droplet DL. Here, the position of the droplet DL is assumed to vary in opposite directions along a plane perpendicular to the beam axis. Thus, double the variation ΔX (2ΔX) is added to the diameter Dd of the droplet DL.

FIG. 4A shows the relationship between a diameter of a droplet and a diameter of a pre-pulse laser beam, as viewed in the direction of the beam axis. FIG. 4B also shows the relationship between a diameter of a diffused target and a diameter of a main pulse laser beam, as viewed in the direction of the beam axis. As shown in FIG. 4A, the diameter Dt of the aforementioned region may be equal to or larger than the sum of the diameter Dd and 2ΔX. Further, as shown in FIG. 4B, in order for the entire diffused target to be irradiated with the main pulse laser beam M, a beam diameter Dm of the main pulse laser beam M may be equal to or larger than a diameter De of the diffused target.

Further, when the droplet DL is irradiated with the pre-pulse laser beam P having such a beam intensity distribution that includes a region where the beam intensity along a cross-section of the pre-pulse laser beam P has substantial uniformity, the droplet DL may be diffused in the direction perpendicular to the beam axis of the pre-pulse laser beam P. Thus, the variation in the position of the diffused target does not depend on the direction into which the droplet is diffused, but may depend primarily on the already-existing variation ΔX in the position of the droplet DL when the droplet DL is irradiated with the pre-pulse laser beam P. Accordingly, the beam diameter Dm of the main pulse laser beam M may satisfy the following condition.

$$Dm \geq De + 2\Delta X$$

That is, the beam diameter Dm of the main pulse laser beam M may be equal to or larger than the sum of the diameter De of the diffused target and the variation ΔX in the position of the droplet DL. Here, the position of the droplet DL is assumed to vary in opposite directions along a plane perpendicular to the beam axis. Thus, double the variation ΔX (2ΔX) is added to the diameter De of the diffused target.

FIG. 5 is a table showing examples of the variation ΔX in the position of the droplet DL. When the standard deviation of the distance between the beam axis of the pre-pulse laser beam P and the center of the droplet DL along the plane perpendicular to the beam axis is σ, ΔX may be set to σ, 2σ, 3σ, . . . , for example.

Here, under the assumption that the distance between the beam axis of the pre-pulse laser beam P and the center of the droplet DL is in the normal distribution, under the condition of Dt≥Dd+2ΔX, the probability of the droplet DL irradiated (or not irradiated) with the pre-pulse laser beam P such that the droplet DL is located within a region where the beam intensity distribution along the cross-section of the pre-pulse laser beam P has substantial uniformity may be calculated.

In the table shown in FIG. 5, the probability of the droplet DL not being irradiated with the pre-pulse laser beam P such that the droplet DL is located within the aforementioned region is shown in the right column. As shown in FIG. 5, the aforementioned probability is 15.9% when the variation ΔX is σ, 2.28% when the variation ΔX is 2σ, and 0.135% when the variation ΔX is 3σ.

Although a case where each of the pre-pulse laser beam P and the main pulse laser beam M has a circular cross-section and each of the droplet DL and the diffused target has a circular cross-section has been described so far, this disclosure is not limited thereto. When the cross-section is not circular, the relationship between the spot size of a given laser beam and the size of a droplet may be defined two-dimensionally in terms of the area. For example, an area (mathematical) of a region (two-dimensional plane) where the beam intensity distribution along the cross-section of the pre-pulse laser beam P has substantial uniformity may exceed the area (mathematical) of the maximum cross-section of the droplet DL. Further, the minimum area of the region where the beam intensity distribution along the cross-section of the pre-pulse laser beam P has substantial uniformity may be equal to or larger than the sum of the area of the maximum cross-section of the droplet DL and the variation in the position of the droplet DL. Furthermore, an area of the cross-section of the main pulse laser beam M may be larger than the area of the maximum cross-section of the diffused target. In addition, the area of the minimum cross-section of the main pulse laser beam M may be equal to or larger than the sum of the area of the maximum cross-section of the diffused target and the variation in the position of the diffused target.

Figure 6:
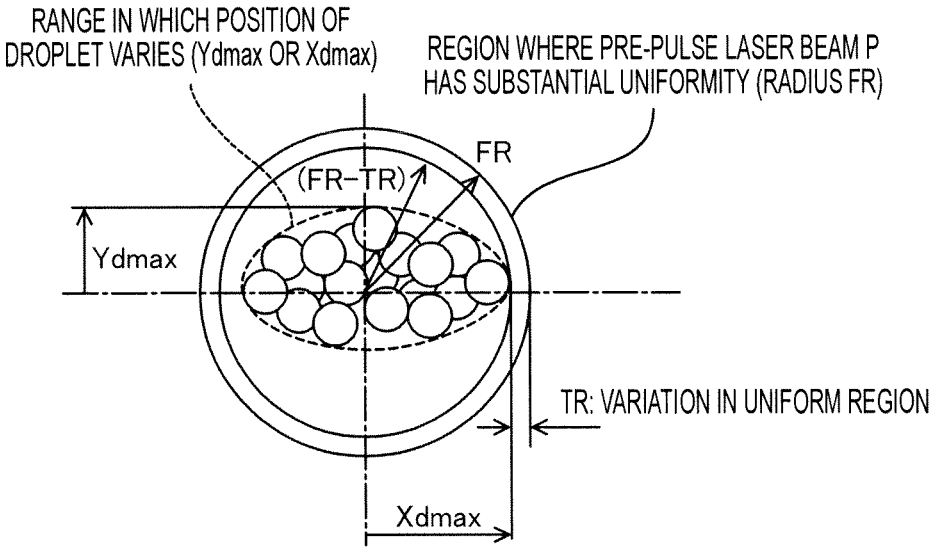
FIG. 6 shows the relationship between a range within which the position of a droplet varies and a diameter of a pre-pulse laser beam, as viewed in the direction of the beam axis.

FIG. 6 shows the relationship between a range within which the position of the droplet DL may vary and the diameter of the pre-pulse laser beam P, as viewed in the direction of the beam axis. As shown in FIG. 6, the variation in the position of the droplet DL along the plane perpendicular to the beam axis of the pre-pulse laser beam P may be evaluated in various directions. In FIG. 6, Xdmax is the sum of the radius of a droplet DL and the maximum amount (distance) in which the center position of the droplet DL varies in the X-direction from a plane containing the beam axis of the pre-pulse laser beam P, the plane extending in the Y-direction, and Ydmax is the sum of the radius of a droplet DL and the maximum amount (distance) in which the center position of the droplet DL varies in the Y-direction from a plane containing the beam axis of the pre-pulse laser beam P, the plane extending in the X-direction. In the example shown in FIG. 6, the maximum value of the variation along the X-direction is greater than the maximum value of the variation along the Y-direction (Xdmax>Ydmax).

In that case, the size of the cross-section (the substantially uniform intensity distribution region) of the pre-pulse laser beam P may be determined in consideration of the variation along the X-direction. For example, the size of the pre-pulse laser beam P may be determined such that a region where the beam intensity distribution along the cross-section of the pre-pulse laser beam P has substantial uniformity may have a circular shape with a diameter FR equal to or greater than Xdmax. Alternatively, the pre-pulse laser beam P may be shaped such that the substantially uniform intensity distribution region has an elliptical or any other suitable shape with the dimension in the X-direction equal to or greater than Xdmax. Further, considering that there may be a variation TR in the size of the substantially uniform intensity distribution region, the region may have any suitable shape where the dimension in the X-direction is equal to or greater than (Xdmax+TR).

Further, the diameter of the pre-pulse laser beam P may be adjustable in accordance with the variation in the position of the droplet DL. When the diameter of the pre-pulse laser beam P is changed while the energy of the pre-pulse laser beam P is retained constant, the beam intensity of the pre-pulse laser beam P along the irradiation plane varies inversely to the square of the beam diameter. Accordingly, the energy of the pre-pulse laser beam P may be adjusted in order to retain the beam intensity constant.

Alternatively, the shape of the substantially uniform intensity distribution region where the beam intensity distribution along the cross-section of the pre-pulse laser beam P has substantial uniformity may be adjusted to be elliptical if, for example, the dimension in the X-direction (Xdmax+TR) is greater than the dimension in the Y-direction (Ydmax+TR). As for the main pulse laser beam M, the size or the shape of the cross-section thereof may be adjusted in accordance with the variation in the position of the diffused target along the X-direction and the Y-direction.

4. Examples of Beam Intensity Distribution

Figure 7A:
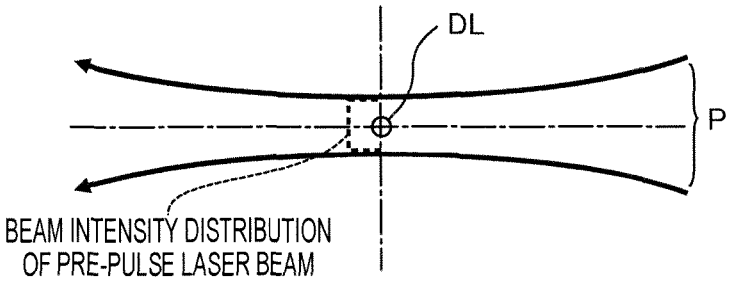
FIGS. 7A through 7C are diagrams for discussing examples of a beam intensity distribution of the pre-pulse laser beam in this disclosure.
Figure 7B:
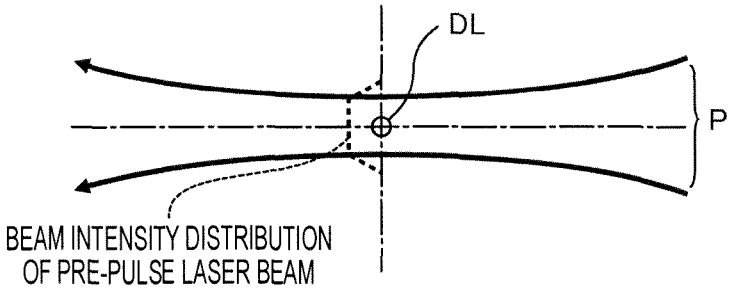
Figure 7C:
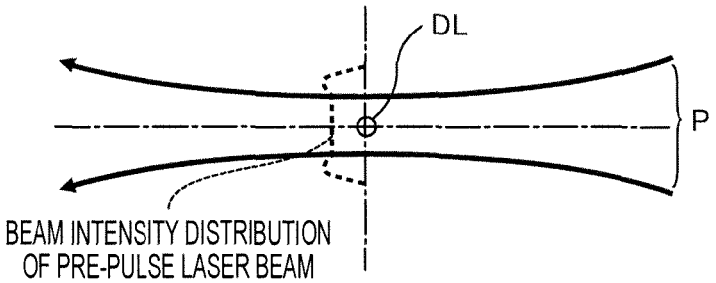

FIGS. 7A through 7C are diagrams for discussing examples of the beam intensity distribution of the pre-pulse laser beam in this disclosure. As shown in FIG. 7A, when the pre-pulse laser beam P has a substantially uniform beam intensity distribution across the cross-section, the beam intensity distribution of such pre-pulse laser beam P may be a top-hat distribution and can be considered to have the substantial uniformity.

As shown in FIG. 7B, even when the pre-pulse laser beam P has a beam intensity distribution along the cross-section where the beam intensity gradually decreases around the peripheral region, when the center portion surrounded by such peripheral region has a substantially uniform beam intensity distribution, the center portion can be said to have the substantial uniformity.

As shown in FIG. 7C, even when the pre-pulse laser beam P has a beam intensity distribution along the cross-section where the beam intensity is higher around the peripheral region, when the center portion surrounded by such peripheral region has a substantially uniform beam intensity distribution, the center portion can be said to have the substantial uniformity.

In order to diffuse the droplet DL in the direction perpendicular to the beam axis of the pre-pulse laser beam P when the droplet DL is irradiated with the pre-pulse laser beam P, the pre-pulse laser beam P may include the substantially uniform beam intensity distributed center portion, as shown in FIGS. 7A through 7C. However, as will be described below, the beam intensity distribution of a given laser beam does not need to be perfectly uniform. It is sufficient as long as the above-discussed region (e.g., FIGS. 4A and 4B) of the cross-section of the given laser beam has a certain uniformity.

Figure 8:
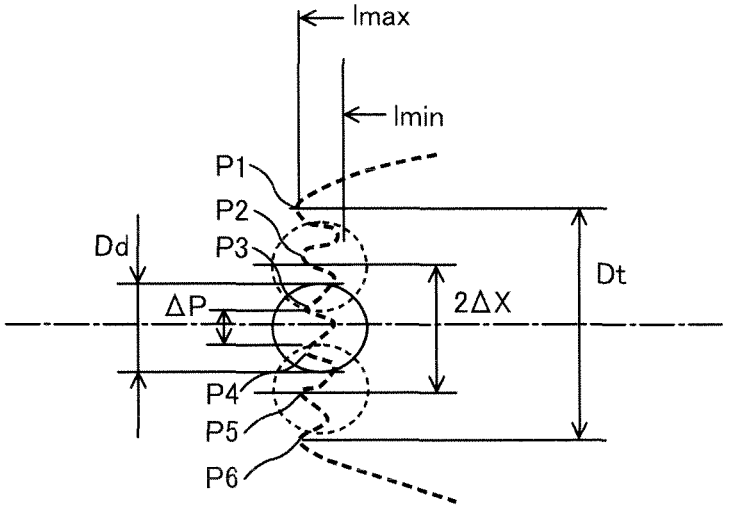
FIG. 8 is a diagram for discussing a beam intensity distribution of a laser beam with which a target material is irradiated.

FIG. 8 is a diagram for discussing the beam intensity distribution of a laser beam with which a target material is irradiated. As shown in FIG. 8, the laser beam may not be said to have the substantial uniformity in a given region (diameter Dt) along its cross-section depending on a difference between a value Imax and a value Imin. The value Imax is the highest beam intensity in the given region and the value Imin is the lowest beam intensity in the given region. In order for a laser beam to be consider to have the substantial uniformity in a give region along its cross-section, for example, the value of a variation C below may be equal to or smaller than 20(%).

$$C=\{(I\max-I\min)/(I\max+I\min)\}\times 100(\%)$$

The value of the variation C equal to or smaller than, for example, 10(%) may be considered to be preferable than 20%.

Further, when there are multiple peaks P1 through P6 existing within the region, a gap ΔP between two adjacent peaks may be equal to or smaller than, for example, one half of the diameter Dd of the droplet DL to say that the pre-pulse laser beam P has the substantially uniform beam intensity distribution.

5. First Embodiment

Figure 9:
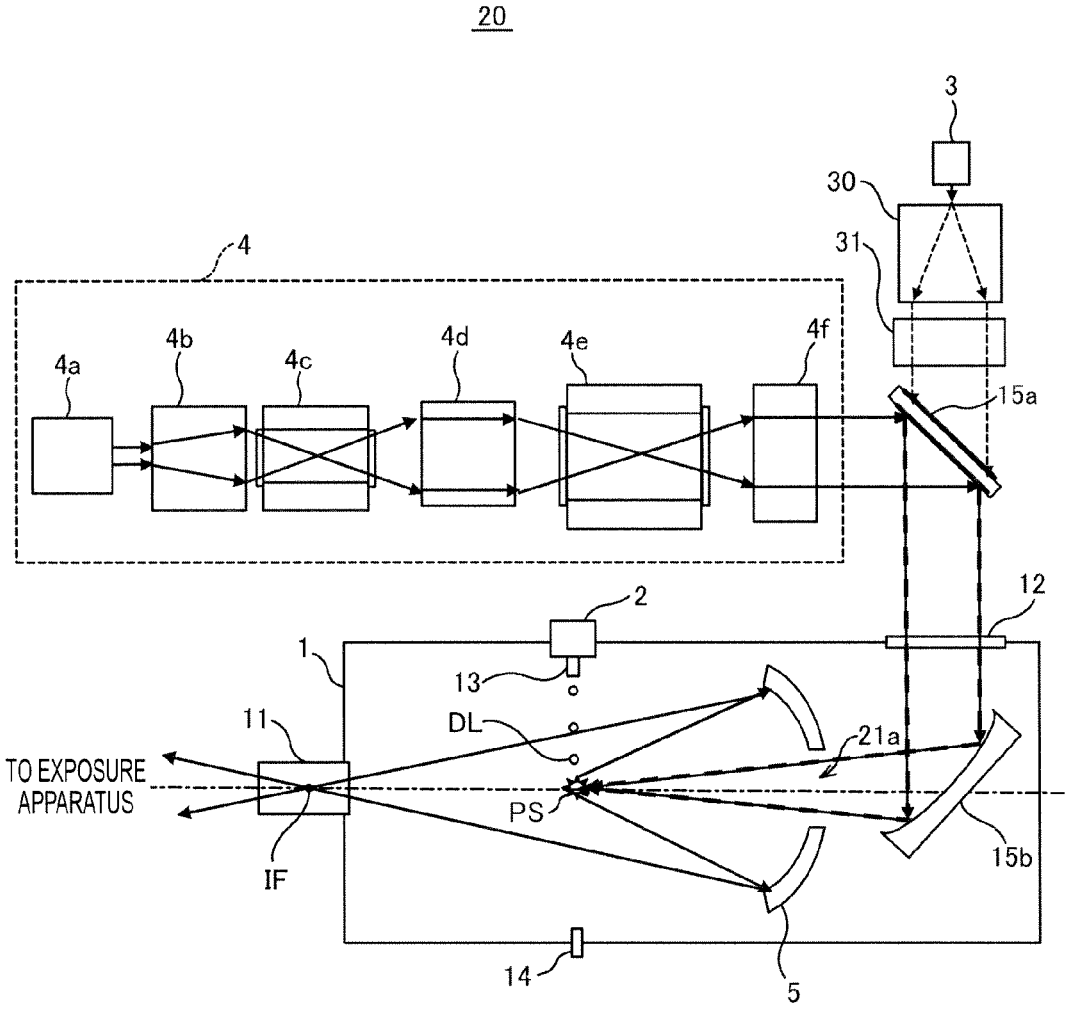
FIG. 9 schematically illustrates an exemplary configuration of an EUV light generation system according to a first embodiment.

FIG. 9 schematically illustrates an exemplary configuration of an EUV light generation system according to a first embodiment. The EUV light generation system of the first embodiment may be of an LPP type. As shown in FIG. 9, an EUV light generation system 20 may include a chamber 1, a target supply unit 2, a pre-pulse laser apparatus 3, a main pulse laser apparatus 4, and an EUV collector mirror 5.

The chamber 1 may be a vacuum chamber in which the EUV light is generated. The chamber 1 may be provided with an exposure apparatus connection port 11 and a window 12. The EUV light generated inside the chamber 1 may be outputted to an external apparatus, such as an exposure apparatus (reduced projection reflective optical system), through the exposure apparatus connection port 11. The laser beams outputted from the pre-pulse laser apparatus 3 and the main pulse laser apparatus 4, respectively, may enter the chamber 1 through the window 12.

The target supply unit 2 may be configured to supply a target material, such as tin (Sn) or lithium (Li) for generating the EUV light, into the chamber 1. The target material may be outputted through a target nozzle 13 in the form of droplets DL. The diameter of the droplet DL may be in the range between 10 μm and 100 μm. Of the droplets DL supplied into the chamber 1, those that are not irradiated with a laser beam may be collected into a target collector 14.

Each of the pre-pulse laser apparatus 3 and the main pulse laser apparatus 4 may be a master oscillator power amplifier (MOPA) type laser apparatus configured to output a driving laser beam for exciting the target material. The pre-pulse laser apparatus 3 and the main pulse laser apparatus 4 may each be configured to output a pulse laser beam (e.g., a pulse duration of a few to several tens of nanoseconds) at a high repetition rate (e.g., 10 to 100 kHz). The pre-pulse laser apparatus 3 may be configured to output the pre-pulse laser beam P at a first wavelength, and the main pulse laser apparatus 4 may be configured to output the main pulse laser beam M at a second wavelength. A Yttrium Aluminum Garnet (YAG) laser apparatus may be used as the pre-pulse laser apparatus 3, and a $CO_2$ laser apparatus may be used as the main pulse laser apparatus 4. However, this disclosure is not limited thereto, and any other suitable laser apparatuses may be used.

The pre-pulse laser beam P from the pre-pulse laser apparatus 3 may be transmitted through a beam combiner 15*a* and through the window 12, and be reflected by a laser beam focusing optical system, such as an off-axis paraboloidal mirror 15*b*. Then, the pre-pulse laser beam P may pass through a through-hole 21*a* formed in the EUV collector mirror 5, and be focused on the droplet DL in the plasma generation region PS. When the droplet DL is irradiated with the pre-pulse laser beam P, the droplet DL may be turned into a diffused target.

The main pulse laser beam M from the main pulse laser apparatus 4 may be reflected by the beam combiner 15*a*, transmitted through the window 12, and reflected by the off-axis paraboloidal mirror 15*b*. Then, the main pulse laser beam M may pass through the through-hole 21*a*, and be focused on the diffused target in the plasma generation region PS. When the diffused target is irradiated with the main pulse laser beam M, the diffused target may be excited by the energy of the main pulse laser beam M. Accordingly, the diffused target may be turned into plasma, and rays of light at various wavelengths including the EUV light may be emitted from the plasma.

The EUV collector mirror 5 may have a spheroidal concave surface on which a multilayer reflective film formed by alternately laminating a molybdenum (Mo) layer and a silicon (Si) layer is formed to selectively collect and reflect the EUV light at a central wavelength of 13.5 nm. The EUV collector mirror 5 may be positioned so that a first focus of the spheroidal surface lies in the plasma generation region PS and a second focus thereof lies in an intermediate focus region IF. Because of such an arrangement, the EUV light reflected by the EUV collector mirror 5 may be focused in the intermediate focus region IF and then be outputted to an external exposure apparatus.

A beam-shaping optical system 31 may be configured to adjust the beam intensity distribution of the pre-pulse laser beam P with which the droplet DL is to be irradiated. The pre-pulse laser beam P from the pre-pulse laser apparatus 3 may first be expanded in diameter by a beam expander 30 and then enter the beam-shaping optical system 31. The beam-shaping optical system 31 may adjust the beam intensity distribution of the pre-pulse laser beam P such that the pre-pulse laser beam P contains a region where the beam intensity distribution along a cross-section of the pre-pulse laser beam P has substantial uniformity at a position where the droplet DL is irradiated therewith and such that the diameter Dt of the aforementioned region is greater than the diameter Dd of the droplet DL (see, e.g., FIG. 4A). The pre-pulse laser beam P outputted from the beam-shaping optical system 31 is incident on the beam combiner 15*a*.

The main pulse laser apparatus 4 may include a master oscillator 4*a*, a preamplifier 4*c*, a main amplifier 4*e*, and relay optical systems 4*b*, 4*d*, and 4*f* respectively disposed downstream from the master oscillator 4*a*, the preamplifier 4*c*, and the main amplifier 4*e*. The master oscillator 4*a* may be configured to output a seed beam at the second wavelength. The seed beam from the master oscillator 4*a* may be amplified by the preamplifier 4*c* and the main amplifier 4*e* to have a desired beam intensity. The amplified seed beam is outputted from the main pulse laser apparatus 4 as the main pulse laser beam M, and the main pulse laser beam M is then incident on the beam combiner 15*a*.

The beam combiner 15*a* may be configured to transmit the pre-pulse laser beam P outputted from the pre-pulse laser apparatus 3 at the first wavelength (e.g., 1.06 μm) with high transmittance and to reflect the main pulse laser beam M outputted from the main pulse laser apparatus 4 at the second wavelength (10.6 μm) with high reflectance. The beam combiner 15*a* may be positioned such that the transmitted pre-pulse laser beam P and the reflected main pulse laser beam M may travel in substantially the same direction into the chamber 1. More specifically, the beam combiner 15*a* may include a diamond substrate on which a multilayer film having the aforementioned reflection/transmission properties is formed. Alternatively, the beam combiner 15*a* may be configured to reflect the pre-pulse laser beam P with high reflectivity and to transmit the main pulse laser beam M with high transmittance. To use such a beam combiner, the place of the pre-pulse laser apparatus 3 and that of the main pulse laser apparatus 4 with respect to the beam combiner 15*a* may be switched.

According to the first embodiment, the pre-pulse laser beam P may contain a region where the beam intensity distribution along a cross-section thereof has substantial uniformity at a position where the droplet DL is irradiated therewith, and the diameter Dt of such a region is greater than the diameter Dd of the droplet DL. Accordingly, the variation in the position of the diffused target resulting from the variation in the position of the droplet DL may be reduced. In turn, the entire diffused target may be irradiated with the main pulse laser beam M, and consequently, the stability in the energy of the generated EUV light may be improved.

Further, according to the first embodiment, the pre-pulse laser beam P and the main pulse laser beam M may be guided to the plasma generation region PS along substantially the same beam path. Accordingly, separate through-holes for the pre-pulse laser beam P and the main pulse laser beam M respectively need not be formed in the EUV collector mirror 5.

In the first embodiment, the EUV light generation system 20 that includes the pre-pulse laser apparatus 3 and the main pulse laser apparatus 4 is described. This disclosure, however, is not limited thereto. For example, the embodiment(s) of this disclosure may be applied to a chamber apparatus used with an external laser apparatus configured to supply excitation energy into the chamber apparatus for generating the EUV light.

6. Examples of Beam-Shaping Optical Systems

Figure 10:
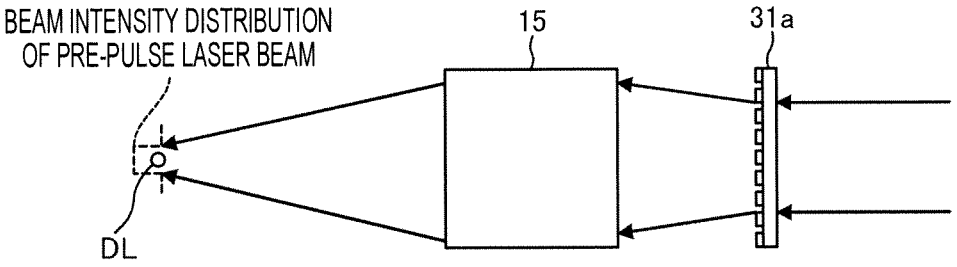
FIG. 10 is a conceptual diagram showing an example of a beam-shaping optical system.

FIG. 10 is a conceptual diagram showing an example of a beam-shaping optical system. The beam-shaping optical system shown in FIG. 10 may include a diffractive optical element 31*a*. The diffractive optical element 31*a* may comprise a transparent substrate on which minute concavities and convexities for diffracting an incident laser beam are formed. The concavity/convexity pattern on the diffractive optical element 31*a* may be designed such that the diffracted laser beam, when focused by a focusing optical system, forms a spot having substantially uniform beam intensity distribution across its cross-section. The diffracted laser beam outputted from the diffractive optical element 31*a* may be focused by a focusing optical system 15 (e.g., the off-axis paraboloidal mirror 15*b* shown in FIG. 9). As a result, the droplet DL may be irradiated with the pre-pulse laser beam P having a top-hat beam intensity distribution.

Figure 11:
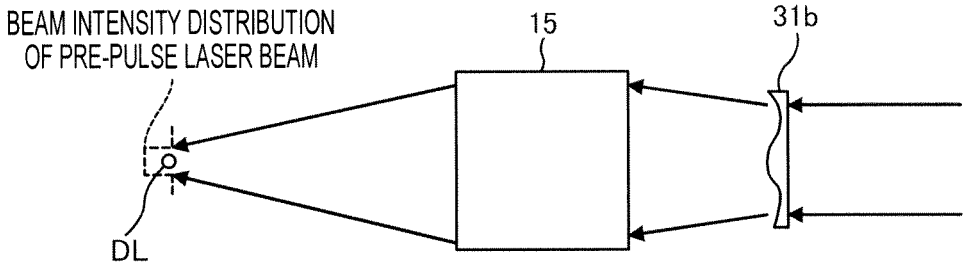
FIG. 11 is a conceptual diagram showing another example of a beam-shaping optical system.

FIG. 11 is a conceptual diagram showing another example of a beam-shaping optical system. The beam-shaping optical system shown in FIG. 11 may include a phase shift optical element 31*b*. The phase shift optical element 31*b* may comprise a transparent substrate which is thicker at the center portion than in the peripheral portion. The phase shift optical element 31*b* may give a phase difference n between a laser beam transmitted through the center portion and a laser beam transmitted through the peripheral portion. Because of the phase optical element 31*b*, an incident laser beam having the Gaussian beam intensity distribution may be converted into such a laser beam that, when focused by the focusing optical system 15, forms a spot having a top-hat beam intensity distribution across its cross-section, and outputted from the phase shift optical element 31*b*.

Figure 12:
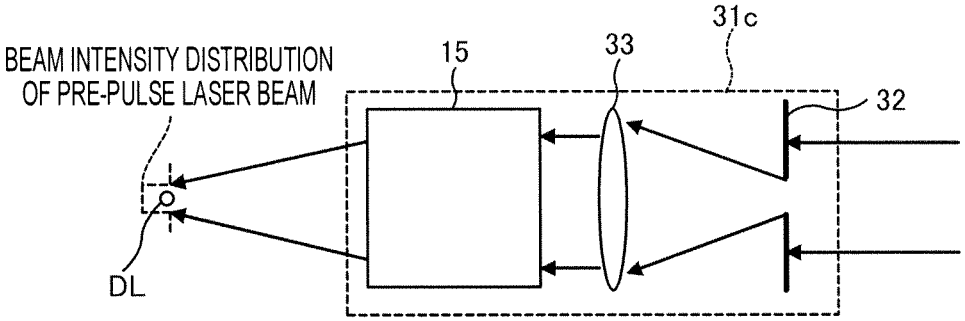
FIG. 12 is a conceptual diagram showing yet another example of a beam-shaping optical system.

FIG. 12 is a conceptual diagram showing yet another example of a beam-shaping optical system. The beam-shaping optical system shown in FIG. 12 may include a mask 32 having an opening of any shape formed therein. The mask 32, a collimator lens 33, and the focusing optical system 15 may constitute a reduced projection optical system 31*c*. The mask 32 may allow a portion of an incident pre-pulse laser beam P where a beam intensity distribution has substantial uniformity to pass therethrough. The reduced projection optical system 31*c* may be configured to project an image of the pre-pulse laser beam P having passed through the mask 32 on the droplet DL through the collimator lens 33 and the focusing optical system 15. Accordingly, the droplet DL may be irradiated with the pre-pulse laser beam P having a top-hat beam intensity distribution.

Figure 13:
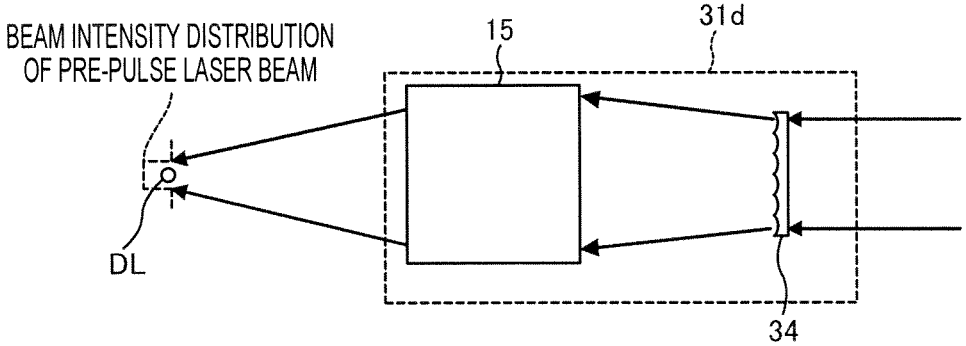
FIG. 13 is a conceptual diagram showing yet another example of a beam-shaping optical system.

FIG. 13 is a conceptual diagram showing yet another example of a beam-shaping optical system. The beam-shaping optical system shown in FIG. 13 may include a fly-eye lens array 34 in which a number of small concave lenses are arranged. The fly-eye lens array 34 and the focusing optical system 15 may constitute a Kohler illumination optical system 31*d*. With the Kohler illumination optical system 31*d*, the incident pre-pulse laser beam P may be diverged at an angle by the respective concave lenses in the fly-eye lens array 34, and the diverged laser beams may overlap with one another at the focus of the focusing optical system 15. As a result, the beam intensity distribution of the pre-pulse laser beam P may become substantially uniform at the focus of the focusing optical system 15. Accordingly, the droplet DL may be irradiated with the pre-pulse laser beam P having a top-hat beam intensity distribution.

In the examples shown in FIGS. 10 through 13, transmissive optical elements are used to adjust the beam intensity distribution of the pre-pulse laser beam P. This disclosure, however, is not limited thereto, and reflective optical elements may be used instead. Further, although each of FIGS. 10 through 13 shows a case where a beam-shaping optical system is combined with a focusing optical system, this disclosure is not limited thereto. A single optical element may be configured to fulfill both functions. For example, an optical element in which minute concavities and convexities as in the diffractive optical element are formed on a focusing lens, or an optical element in which a focusing mirror has the phase shift function may be used.

Figure 14:
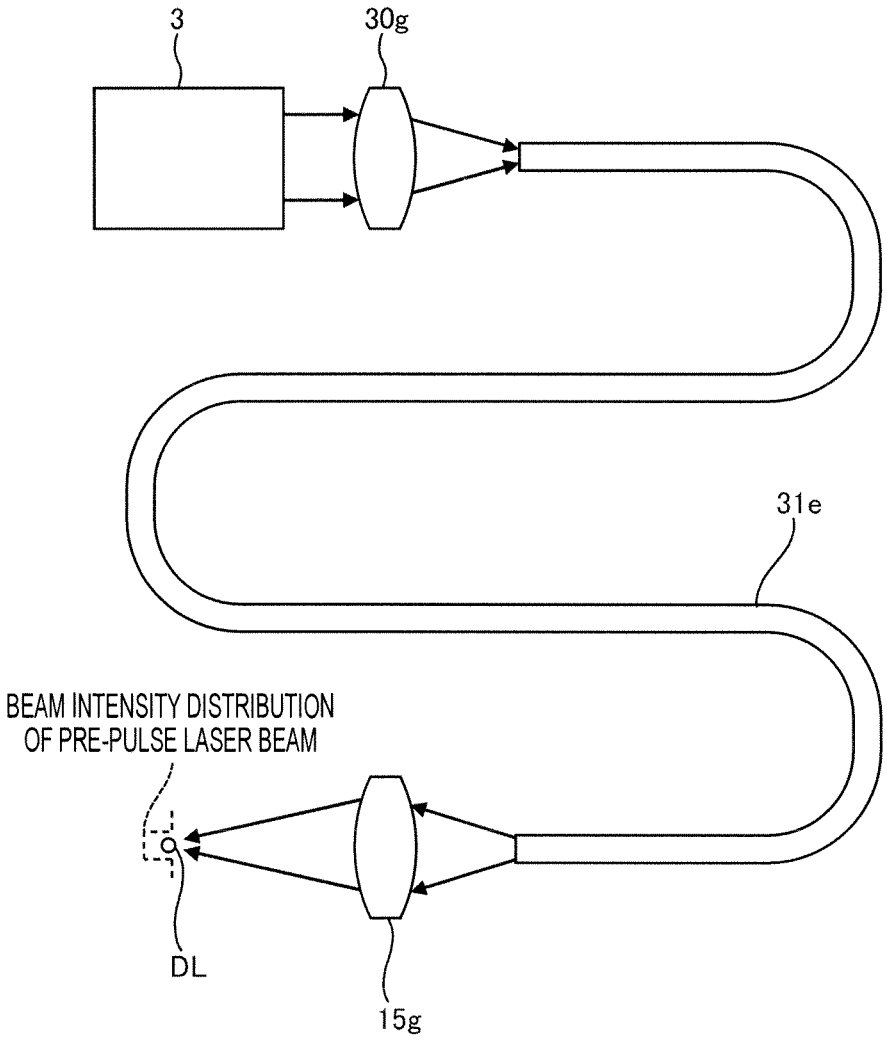
FIG. 14 is a conceptual diagram showing yet another example of a beam-shaping optical system.

FIG. 14 is a conceptual diagram showing yet another example of a beam-shaping optical system. The beam-shaping optical system shown in FIG. 14 may include a multi-mode optical fiber 31*e*. Further, a focusing optical system 30*g*, in place of the beam expander 30 (see FIG. 9), may be provided in a beam path between the pre-pulse laser apparatus 3 and the multi-mode optical fiber 31*e*.

The pre-pulse laser beam P from the pre-pulse laser apparatus 3 may be focused by the focusing optical system 30*g* and may enter the multi-mode optical fiber 31*e*. The pre-pulse laser beam P may be focused in accordance with the numerical aperture of the multi-mode optical fiber 31*e*. Generally, the multi-mode optical fiber 31*e* has a larger core than a single-mode optical fiber, and has multiple paths through which the laser beam travels. Accordingly, when the pre-pulse laser beam P having the Gaussian beam intensity distribution passes through the multi-mode optical fiber 31*e*, the beam intensity distribution may change. Thus, the pre-pulse laser beam P having the Gaussian beam intensity distribution may be converted into a laser beam having a top-hat beam intensity distribution. The focusing optical system 15*g* may project an image of the pre-pulse laser beam P from the multi-mode optical fiber 31*e* on the droplet DL so that the droplet DL may be irradiated with the pre-pulse laser beam P having a top-hat beam intensity distribution.

7. Second Embodiment

Figure 15:
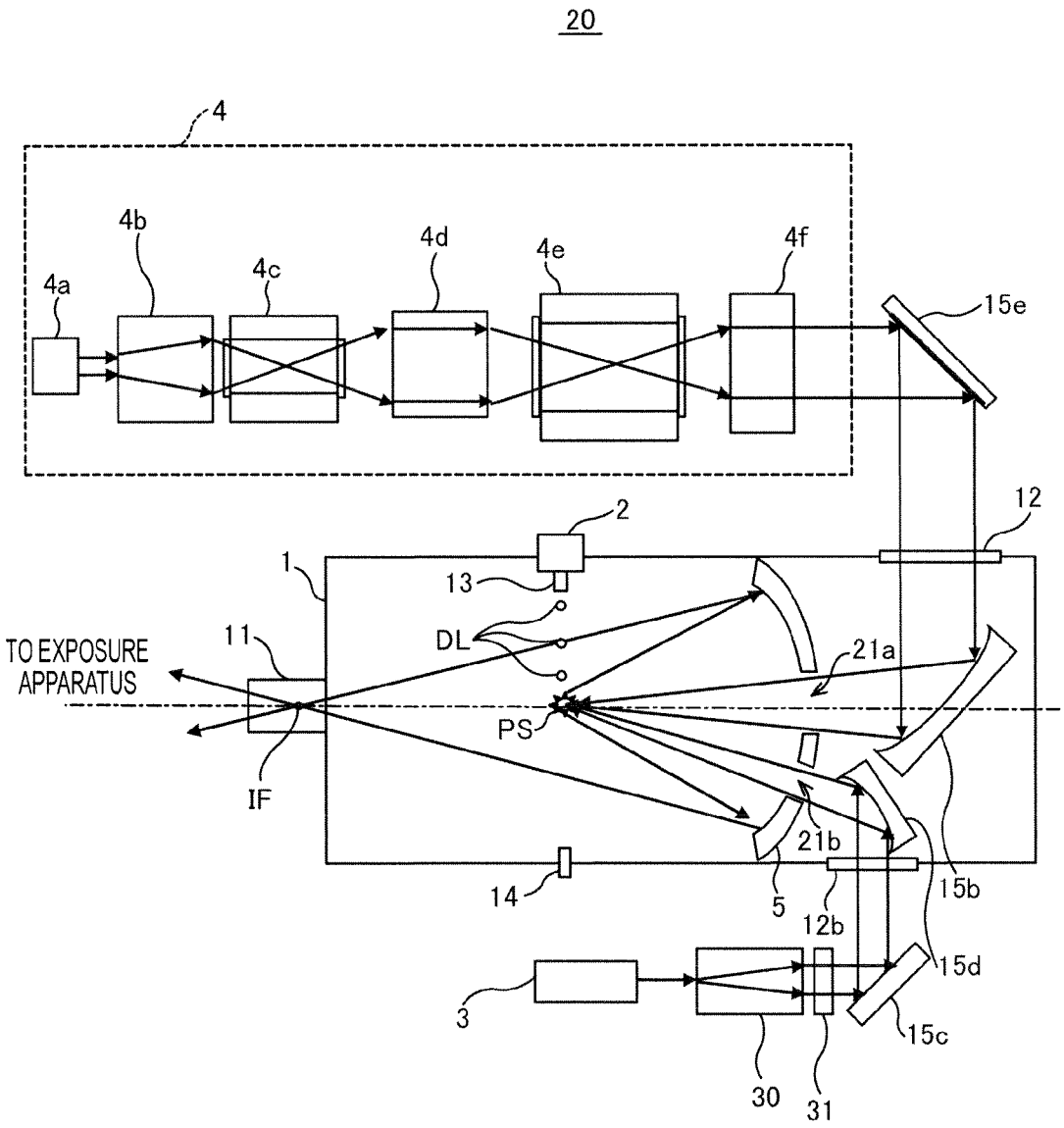
FIG. 15 schematically illustrates an exemplary configuration of an EUV light generation system according to a second embodiment.

FIG. 15 schematically illustrates an exemplary configuration of an EUV light generation system according to a second embodiment. In the EUV light generation system according to the second embodiment, the pre-pulse laser beam P from the pre-pulse laser apparatus 3 and the main pulse laser beam M from the main pulse laser apparatus 4 may be guided into the chamber 1 along separate beam paths.

The pre-pulse laser beam P from the pre-pulse laser apparatus 3 may be reflected by a high-reflection mirror 15*c*, transmitted through a window 12*b*, and reflected by an off-axis paraboloidal mirror 15*d*. Then the pre-pulse laser beam P may be focused on the droplet DL in the plasma generation region PS through a through-hole 21*b* formed in the EUV collector mirror 5. When the droplet DL is irradiated with the pre-pulse laser beam P, the droplet DL may be turned into a diffused target.

The main pulse laser beam M from the main pulse laser apparatus 4 may be reflected by a high-reflection mirror 15*e*, transmitted through the window 12, and reflected by the off-axis paraboloidal mirror 15*b*. Then, the main pulse laser beam M may be focused on the diffused target in the plasma generation region PS through the through-hole 21*a* formed in the EUV collector mirror 5.

According to the second embodiment, the pre-pulse laser beam P and the main pulse laser beam M may respectively be guided to the plasma generation region PS through separate optical systems. Accordingly, each optical system may be designed independently of one another such that each of the pre-pulse laser beam P and the main pulse laser beam M forms a spot of a desired size. Further, the droplet DL and the diffused target may respectively be irradiated with the pre-pulse laser beam P and the main pulse laser beam M in substantially the same direction without an optical element, such as a beam combiner which makes the beam paths of the pre-pulse laser beam P and the main pulse laser beam M coincide with each other.

8. Third Embodiment

Figure 16:
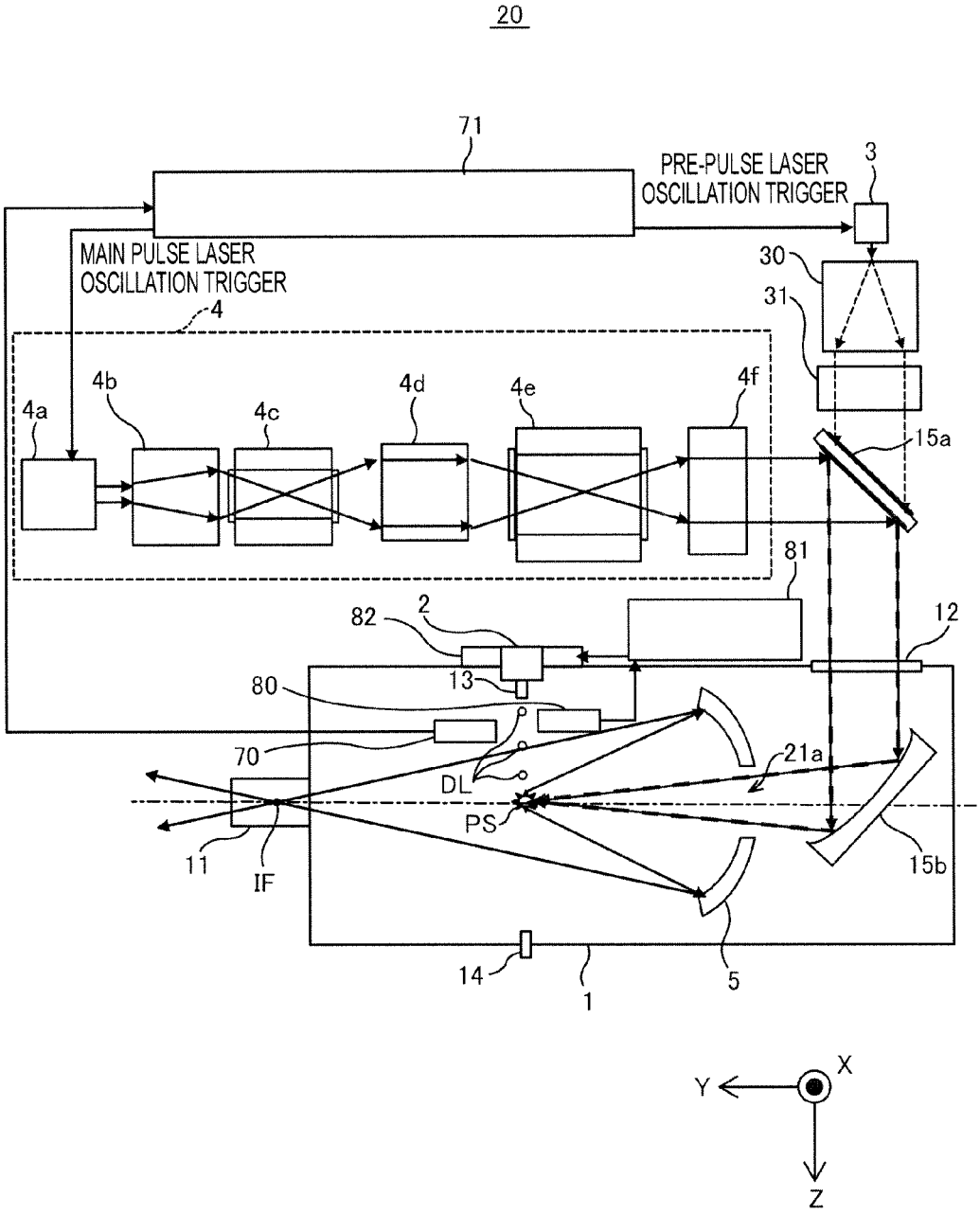
FIG. 16 schematically illustrates an exemplary configuration of an EUV light generation system according to a third embodiment.

FIG. 16 schematically illustrates an exemplary configuration of an EUV light generation system according to a third embodiment. In the EUV light generation system according to the third embodiment, a position detection mechanism for detecting the droplet DL may be added to the EUV light generation system according to the first embodiment shown in FIG. 9. Because of the position detection mechanism, a timing at which a laser beam is outputted may be controlled in accordance with the detection result by the position detection mechanism. The position detection mechanism may include a droplet Z-direction detector 70 and a droplet XY-direction detector 80.

The droplet Z-direction detector 70 may be configured to detect the position of the droplet DL in the travel direction thereof (Z-direction). More specifically, the droplet Z-direction detector 70 may send a Z-position detection signal to a laser trigger generation mechanism (laser controller) 71 when the droplet DL reaches a position in the Z-direction.

Upon receiving the Z-position detection signal, the laser trigger generation mechanism 71 may send a pre-pulse laser oscillation trigger signal to the pre-pulse laser apparatus 3 when a first delay time elapses. The pre-pulse laser apparatus 3 may output the pre-pulse laser beam P based on the pre-pulse laser oscillation trigger signal. The first delay time may be set appropriately so that the pre-pulse laser beam P from the pre-pulse laser apparatus 3 strikes the droplet DL in the plasma generation region PS.

With the above control, the droplet DL may be irradiated with the pre-pulse laser beam P in the plasma generation region PS and turned into a diffused target. Thereafter, the laser trigger generation mechanism 71 may send a main pulse laser oscillation trigger signal to the main pulse laser apparatus 4 when a second delay time elapses. The main pulse laser apparatus 4 may output the main pulse laser beam M based on the main pulse laser oscillation trigger signal. The second delay time may be set such that the diffused target is irradiated with the main pulse laser beam M from the main pulse laser apparatus 4 at a timing at which the diffused target is diffused to a desired size.

In this way, the timing at which the pre-pulse laser beam P is outputted and the timing at which the main pulse laser beam M is outputted may be controlled based on the detection result of the droplet Z-direction detector 70.

Various jitters (temporal fluctuations) may exist among the droplet Z-direction detector 70, the laser trigger generation mechanism 71, the pre-pulse laser apparatus 3, and the main pulse laser apparatus 4. The jitters may include: (1) a jitter in time required for the droplet Z-direction detector 70 to output a signal ($\sigma a$); (2) a jitter in time required to transmit various signals ($\sigma b$); (3) a jitter in time required to process various signals ($\sigma c$); (4) a jitter in time required for the pre-pulse laser apparatus 3 to output the pre-pulse laser beam P ($\sigma d$); and (5) a jitter in time required for the main pulse laser apparatus 4 to output the main pulse laser beam M (of). The standard deviation $\sigma j$ the above jitters may be expressed in the expression below.

$$\sigma j=(\sigma a^2+\sigma b^2+\sigma d^2+\sigma f^2+\bullet\bullet\bullet)^{1/2}$$

The deviation in the Z-direction between the focus of the pre-pulse laser beam P and the position of the droplet DL may, for example, be expressed as $2\sigma j\times v$, where v is the speed of the droplet DL. In that case, a diameter Dtz of a region where the beam intensity distribution along a cross-section of the pre-pulse laser beam P has substantial uniformity may satisfy the following condition.

$$Dtz\geq Dd+2\sigma j\times v$$

The droplet XY-direction detector 80 may be configured to detect the position of the droplet DL along a plane perpendicular to the travel direction (Z-direction) of the droplet DL, and send an XY-position detection signal to a droplet XY controller 81.

Upon receiving the XY-position detection signal, the droplet XY controller 81 may determine whether or not the position of the detected droplet DL falls within a permissible range. When the position of the droplet DL does not fall within the permissible range, the droplet XY controller 81 may send an XY driving signal to a droplet XY control mechanism 82.

The droplet XY control mechanism 82 may drive a driving motor provided in the target supply unit 2 based on the received XY driving signal. With this, the position toward which the droplet DL is outputted may be controlled. In this way, the position of the droplet DL along the XY plane may be controlled in accordance with the detection result of the droplet XY-direction detector 80.

Even with the above control, it may be difficult to change the position toward which the droplet DL is outputted for each droplet DL. Accordingly, when the short-term fluctuation (standard deviation) in the XY-direction is $\sigma x$, a diameter Dtx of a region where the beam intensity distribution along a cross-section of the pre-pulse laser beam P has substantial uniformity may satisfy the following condition.

$$Dtx\geq Dd+2\sigma x$$

In the third embodiment, the position toward which the droplet DL is outputted is controlled along the XY plane. This disclosure, however, is not limited thereto. For example, the angle at which the droplet DL is outputted from the target supply unit 2 may be controlled.

9. Fourth Embodiment

Figure 17:
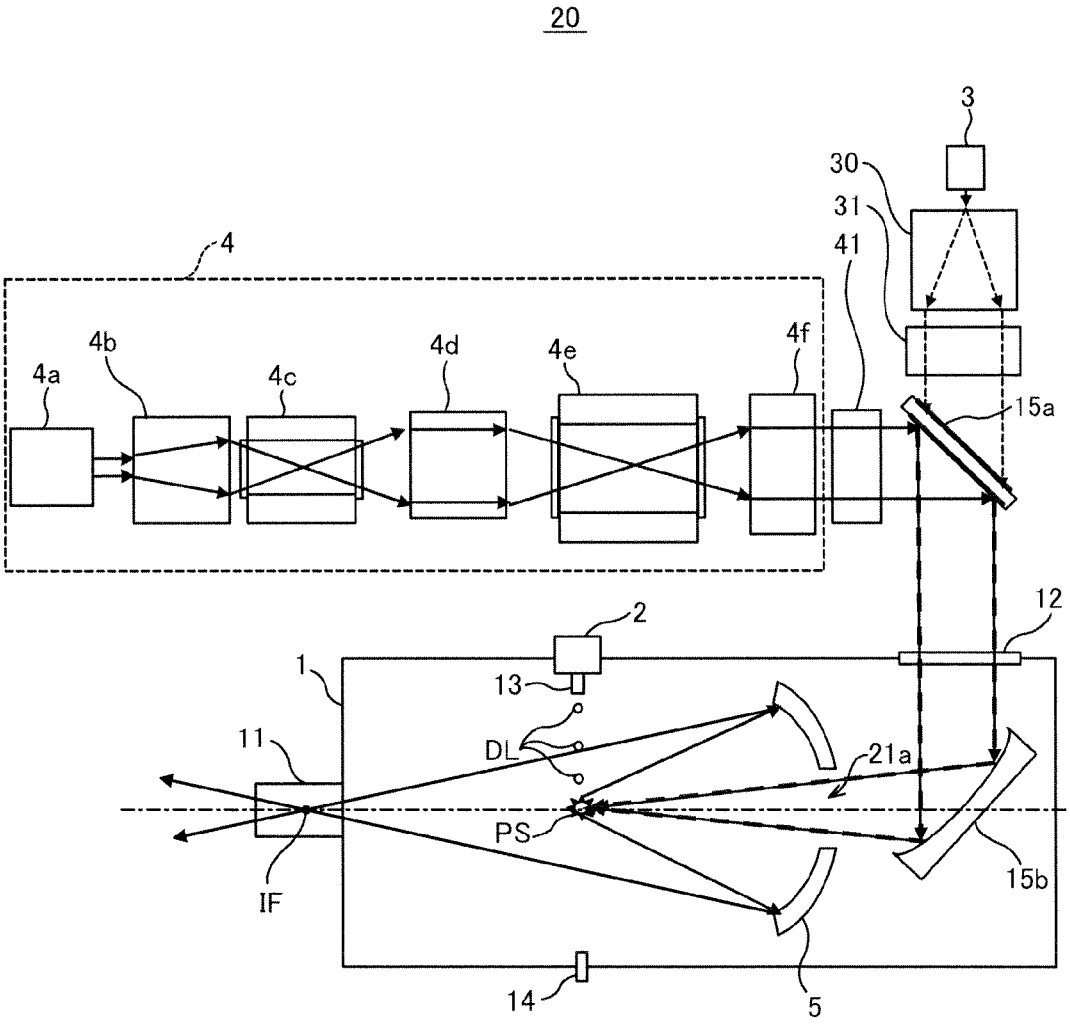
FIG. 17 schematically illustrates an exemplary configuration of an EUV light generation system according to a fourth embodiment.

FIG. 17 schematically illustrates the configuration of an EUV light generation system according to a fourth embodiment. The EUV light generation system according to the fourth embodiment may include a beam-shaping optical system 41 provided between the main pulse laser apparatus 4 and the beam combiner 15*a* to adjust the beam intensity distribution of the main pulse laser beam M.

The configuration of the beam-shaping optical system 41 may be similar to that of the beam-shaping optical system 31 configured to adjust the beam intensity distribution of the pre-pulse laser beam P. The beam-shaping optical system 41 may adjust the beam intensity distribution of the main pulse laser beam M such that the main pulse laser beam M contains a region where the beam intensity distribution along a cross-section has substantial uniformity. With this, the entire diffused target may be irradiated with the main pulse laser beam M at substantially uniform beam intensity.

Figure 18A:
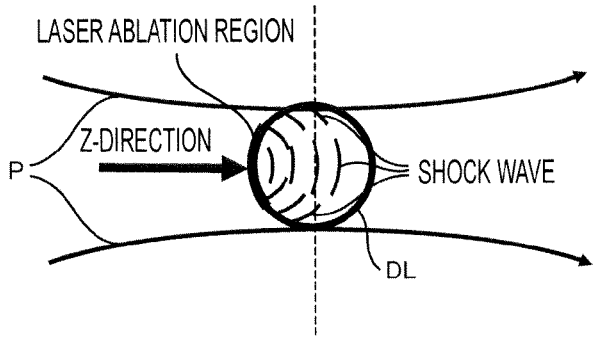
FIG. 18A is a conceptual diagram showing a droplet being irradiated with a pre-pulse laser beam.
Figure 18B:
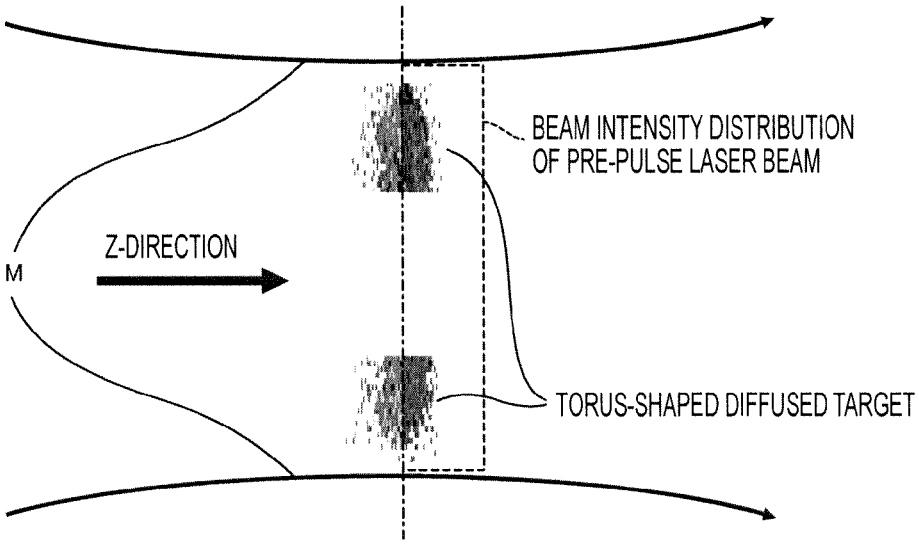
FIG. 18B is a conceptual diagram showing a torus-shaped diffused target, which has been formed as a droplet is irradiated with a pre-pulse laser beam, being irradiated with a main pulse laser beam having a top-hat beam intensity distribution, as viewed in the direction perpendicular to the beam axis.
Figure 18C:
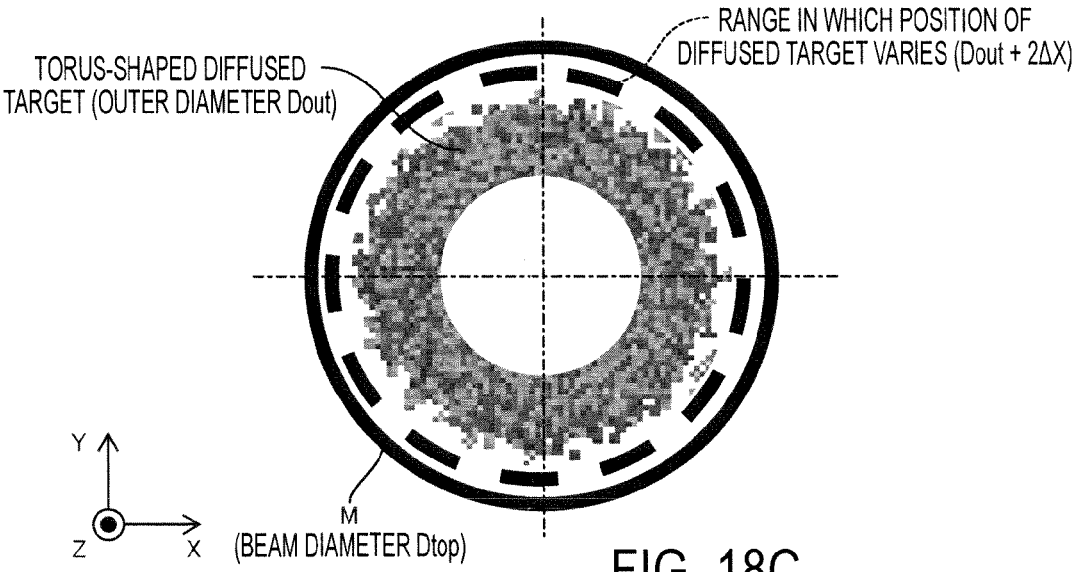
FIG. 18C is a conceptual diagram showing a torus-shaped diffused target, which has been formed as a droplet is irradiated with a pre-pulse laser beam, being irradiated with a main pulse laser beam having a top-hat beam intensity distribution, as viewed in the direction of the beam axis.

FIG. 18A is a conceptual diagram showing the droplet DL being irradiated with the pre-pulse laser beam P. FIGS. 18B and 18C are conceptual diagrams showing that a torus-shaped diffused target, which has been formed when the droplet DL is irradiated with the pre-pulse laser beam P, is irradiated with the main pulse laser beam M having a top-hat beam intensity distribution. FIGS. 18A and 18B are diagrams viewed in the direction perpendicular to the beam axes of the pre-pulse laser beam P and the main pulse laser beam M. FIG. 18C is a diagram viewed in the direction of the beam axis of the main pulse laser beam M.

As shown in FIG. 18A, when the pre-pulse laser beam P is focused on the droplet DL, laser ablation may occur at the surface of the droplet DL irradiated with the pre-pulse laser beam P. A shock wave or sonic wave may occur from the irradiated surface of the droplet DL toward the interior of the droplet DL due to the energy by the laser ablation. This shock wave or sonic wave may propagate throughout the droplet DL. When the beam intensity of the pre-pulse laser beam P is equal to or greater than a first value (e.g., $1\times10^9$ W/cm$^2$), the droplet DL may be broken up.

Here, when the beam intensity of the pre-pulse laser beam P is equal to or greater than a second value (e.g., $6.4\times10^9$ W/cm$^2$), the droplet DL may be broken up to form a torus-shaped diffused target as shown in FIGS. 18B and 18C. As shown in FIGS. 18B and 18C, the torus-shaped diffused target may be diffused into a torus-shape symmetrically about the beam axis of the pre-pulse laser beam P.

Specific conditions for generating a torus-shaped diffused target may, for example, be as follows. The range of the beam intensity of the pre-pulse laser beam P may be from $6.4\times10^9$ W/cm$^2$ to $3.2\times10^{10}$ W/cm$^2$ inclusive. The droplet DL may be 12 μm to 40 μm inclusive in diameter.

Irradiation of the torus-shaped diffused target with the main pulse laser beam M will now be discussed. For example, the torus-shaped diffused target may, for example, be formed in 0.5 μs to 2.0 μs after the droplet DL is irradiated with the pre-pulse laser beam P. Accordingly, the diffused target may be irradiated with the main pulse laser beam M in the aforementioned period after the droplet DL is irradiated with the pre-pulse laser beam P.

Further, as shown in FIGS. 18B and 18C, the torus-shaped diffused target may be shaped such that the length in the direction of the beam axis of the pre-pulse laser beam P is shorter than the length in the direction perpendicular to the beam axis of the pre-pulse laser beam P. The torus-shaped diffused target of such dimensions may be irradiated with the main pulse laser beam M in the same direction as the pre-pulse laser beam P. Accordingly, the diffused target may be irradiated with the main pulse laser beam M more uniformly, and thus the main pulse laser beam M may be absorbed efficiently by the diffused target. In turn, the conversion efficiency (CE) in the LPP type EUV light generation system may be improved.

In order to generate a torus-shaped diffused target, the pre-pulse laser beam P may not need to have a top-hat beam intensity distribution. In that case, the beam-shaping optical system 31 shown in FIG. 17 may be omitted. However, the beam-shaping optical system 31 may be provided in order to reduce the variation in the position of the diffused target resulting from the variation in the position of the droplet DL.

It is speculated that when the torus-shaped diffused target is irradiated with the main pulse laser beam M having a top-hat beam intensity distribution, plasma is emitted cylindrically from the torus-shaped diffused target. Then, the plasma diffused toward the inner portion of the cylinder may be trapped therein. This may generate high-temperature, high-density plasma, and improve the CE. Here, the term "torus-shape" means an annular shape, but the diffused target need not be perfectly annular in shape, and may be substantially annular in shape. The torus-shaped diffused target comprises particles of the target material which is diffused by the pre-pulse laser beam P. The particles aggregate to have the torus shape.

When the variation in the position of the torus-shaped diffused target is ΔX, a diameter Dtop of a region where the beam intensity distribution of the main pulse laser beam M has substantial uniformity may be in the following relationship with an outer diameter Dout of the torus-shaped diffused target.

$$Dtop \geq Dout + 2\Delta X$$

That is, the diameter Dtop of the aforementioned region may be equal to or larger than the sum of the outer diameter Dout of the torus-shaped diffused target and double the variation ΔX (2ΔX) in the position of the torus-shaped diffused target. With this configuration, the entire torus-shaped diffused target may be irradiated with the main pulse laser beam M at substantially uniform beam intensity. Accordingly, a larger portion of the diffused target may be turned into plasma. As a result, debris of the target material may be reduced.

10. Fifth Embodiment

Figure 19:
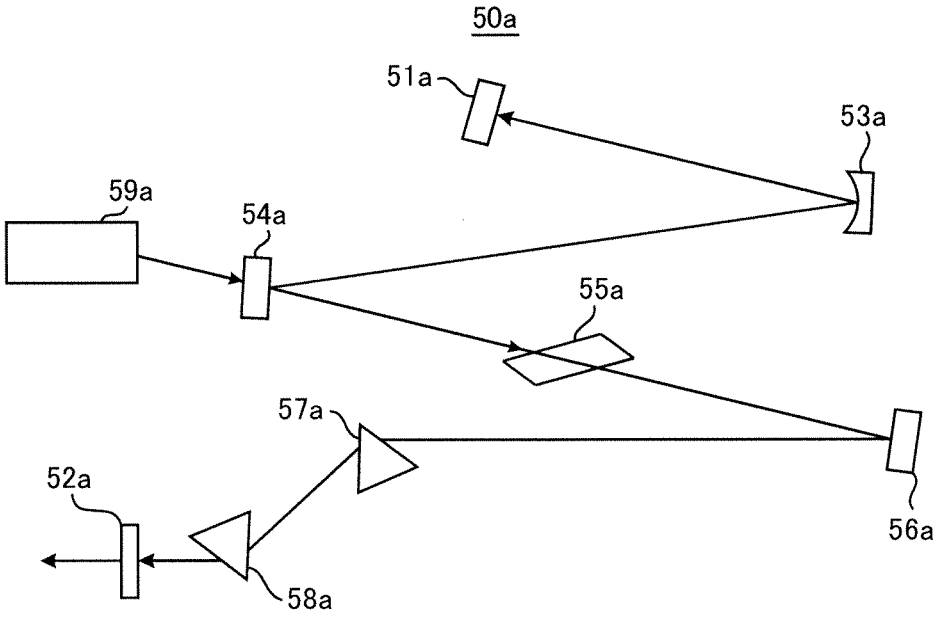
FIG. 19 schematically illustrates an exemplary configuration of a Ti:sapphire laser configured to output a pre-pulse laser beam in an EUV light generation system according to a fifth embodiment.

FIG. 19 schematically illustrates an exemplary configuration of a Ti:sapphire laser configured to output the pre-pulse laser beam P in an EUV light generation system according to a fourth embodiment. A Ti:sapphire laser 50*a* of the fifth embodiment may be provided outside the chamber 1 as a pre-pulse laser apparatus.

The Ti:sapphire laser 50*a* may include a laser resonator formed by a semiconductor saturable absorber mirror 51*a* and an output coupler 52*a*. A concave mirror 53*a*, a first pumping mirror 54*a*, a Ti:sapphire crystal 55*a*, a second pumping mirror 56*a*, and two prisms 57*a* and 58*a* are provided in this order from the side of the semiconductor saturable absorber mirror 51*a* in the optical path in the laser resonator. Further, the Ti:sapphire laser 50*a* may include a pumping source 59*a* for introducing a pumping beam into the laser resonator.

The first pumping mirror 54*a* may be configured to transmit the pumping beam from the outside of the laser resonator with high transmittance and reflect the laser beam inside the laser resonator with high reflectance. The Ti:sapphire crystal 55*a* may serve as a laser medium that undergoes stimulated emission with the pumping beam. The two prisms 57*a* and 58*a* may selectively transmit a laser beam at a wavelength. The output coupler 52*a* may transmit a part of the laser beam amplified in the laser resonator and output the amplified laser beam from the laser resonator, and reflect the remaining part of the laser beam back into the laser resonator. The semiconductor saturable absorber mirror 51*a* may have a reflective layer and a saturable absorber layer laminated thereon. A part of an incident laser beam of low beam intensity may be absorbed by the saturable absorber layer, and another part of the incident laser beam of high beam intensity may be transmitted through the saturable absorber layer and reflected by the reflective layer. With this, the pulse duration of the incident laser beam may be shortened.

A semiconductor pumped Nd:$YVO_4$ laser may be used as the pumping source 59*a*. The second harmonic wave from the pumping source 59*a* may be introduced into the laser resonator through the first pumping mirror 54*a*. The position of the semiconductor saturable absorber mirror 51*a* may be adjusted so as to adjust the resonator length for given longitudinal modes. This adjustment may lead to mode-locking of the Ti:sapphire laser 50*a*, and a picosecond pulse laser beam may be outputted through the output coupler 52*a*. Here, when the pulse energy is small, the pulse laser beam may be amplified by a regenerative amplifier.

According to the fifth embodiment, the picosecond pulse laser beam may be outputted, and the droplet DL may be irradiated with the pre-pulse laser beam P having such a pulse duration. Accordingly, the droplet DL can be diffused with relatively small pulse energy.

11. Sixth Embodiment

Figure 20:
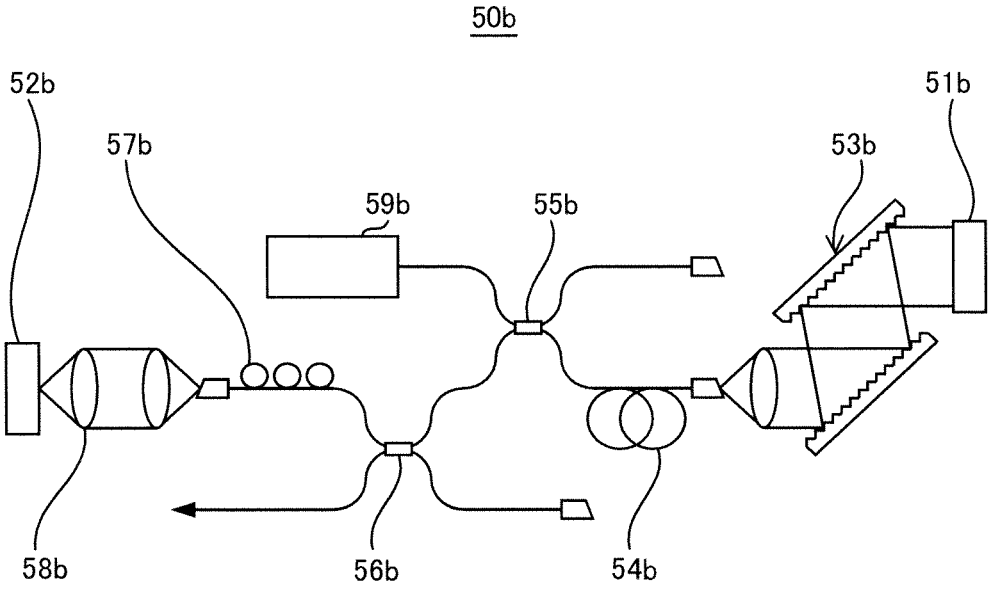
FIG. 20 schematically illustrates an exemplary configuration of a fiber laser configured to output a pre-pulse laser beam in an EUV light generation system according to a sixth embodiment.

FIG. 20 schematically illustrates an exemplary configuration of a fiber laser configured to output the pre-pulse laser beam P in an EUV light generation system according to a sixth embodiment. A fiber laser 50*b* of the sixth embodiment may be provided outside the chamber 1 as a pre-pulse laser apparatus.

The fiber laser 50*b* may include a laser resonator formed by a high-reflection mirror 51*b* and a semiconductor saturable absorber mirror 52*b*. A grating pair 53*b*, a first polarization maintenance fiber 54*b*, a multiplexer 55*b*, a separation element 56*b*, a second polarization maintenance fiber 57*b*, and a focusing optical system 58*b* may be provided in this order from the side of the high-reflection mirror 51*b* in the beam path in the laser resonator. Further, the fiber laser 50*b* may include a pumping source 59*b* for introducing a pumping beam into the laser resonator.

The multiplexer 55*b* may be configured to introduce the pumping beam from the pumping source 59*b* to the first polarization maintenance fiber 54*b* and may transmit a laser beam traveling back and forth between the first polarization maintenance fiber 54*b* and the second polarization maintenance fiber 57*b*. The first polarization maintenance fiber 54*b* may be doped with ytterbium (Yb), and may undergo stimulated emission with the pumping beam. The grating pair 53*b* may selectively reflect a laser beam at a wavelength. The semiconductor saturable absorber mirror 52*b* may be similar in configuration and function to the semiconductor saturable absorber mirror 51*b* in the fifth embodiment. The separation element 56*b* may separate a part of the laser beam amplified in the laser resonator and output the separated laser beam from the laser resonator and return the remaining part of the laser beam back into the laser resonator. This configuration may lead to mode-locking of the fiber laser 50*b*. When the pumping beam from the pumping source 59*b* is introduced into the multiplexer 55*b* through an optical fiber, and a picosecond pulse laser beam may be outputted through the separation element 56*b*.

According to the sixth embodiment, in addition to the effects obtained in the fifth embodiment, the direction of the pre-pulse laser beam P may easily be adjusted since the pre-pulse laser beam P is guided through an optical fiber.

The shorter the wavelength of a laser beam, the higher the absorptivity of the laser beam by tin. Accordingly, when the priority is placed on the absorptivity of the laser beam by tin, a laser beam at a shorter wavelength may be advantageous. For example, compared to the fundamental harmonic wave outputted from an Nd:YAG laser apparatus at a wavelength of 1064 nm, the absorptivity may increase with the second harmonic wave (a wavelength of 532 nm), further with the third harmonic wave (a wavelength of 355 nm), and even further with the fourth harmonic wave (a wavelength of 266 nm).

Here, an example where a picosecond pulse laser beam is used is shown. However, similar effects can be obtained even with a femtosecond pulse laser beam. Further, a droplet can be diffused even with a nanosecond pulse laser beam. For example, a fiber laser with such specifications as a pulse duration of approximately 15 ns, a repetition rate of 100 kHz, pulse energy of 1.5 mJ, a wavelength of 1.03 μm, and the $M^2$ value of below 1.5 may be used as a pre-pulse laser apparatus.

12. Irradiation Conditions of Pre-pulse Laser Beam

FIG. 21 is a table showing examples of irradiation conditions of the pre-pulse laser beam P in this disclosure. When the irradiation pulse energy is E (J), the pulse duration is Tp (s), and the diameter of a region where the beam intensity distribution has substantial uniformity is Dt (m), the beam intensity W ($W/m^2$) of the pre-pulse laser beam P may be expressed in the following expression.

$$W=E/(Tp(Dt/2)^2\pi)$$

FIG. 21 shows four examples (case 1 through case 4) of the irradiation conditions of the pre-pulse laser beam P. In each of the cases 1 through 4, the diameter of a molten tin droplet is 10 μm, and the diameter Dt of a region where the beam intensity distribution has substantial uniformity is 30 μm.

In the case 1, in order to generate a desired diffused target by diffusing such a droplet, the irradiation pulse energy E is set to 0.3 mJ, and the pulse duration Tp is set to 20 ns. In this case, the beam intensity W of $2.12\times10^9$ $W/cm^2$ may be obtained. With such a pre-pulse laser beam P, a diffused target as shown in FIG. 2B may be generated.

In the case 2, the irradiation pulse energy E is set to 0.3 mJ, and the pulse duration Tp is set to 10 ns. In this case, the beam intensity W of $4.24\times10^9$ $W/cm^2$ may be obtained. With such a pre-pulse laser beam P, a diffused target as shown in FIG. 2B may be generated.

In the case 3, the irradiation pulse energy E is set to 0.3 mJ, and the pulse duration Tp is set to 0.1 ns. In this case, the beam intensity W of $4.24\times10^{11}$ $W/cm^2$ may be obtained. A diffused target generated with such a pre-pulse laser beam P will be discussed later.

In the case 4, the irradiation pulse energy E is set to 0.5 mJ, and the pulse duration Tp is set to 0.05 ns. In this case, the beam intensity W of $1.41\times10^{12}$ $W/cm^2$ may be obtained. A diffused target generated with such a pre-pulse laser beam P will be discussed later. In this way, the high beam intensity W may be obtained when a picosecond pulse laser beam is used as the pre-pulse laser beam P.

In the cases shown in FIG. 21, the droplet having a diameter of 10 μm is used. This disclosure, however, is not limited thereto. For example, when the variation ΔX in the position of the droplet DL having a diameter of 16 μm is 7 μm, the diameter Dt of a region where the beam intensity distribution has substantial uniformity may be set to 30 μm.

13. Seventh Embodiment

Figure 22:
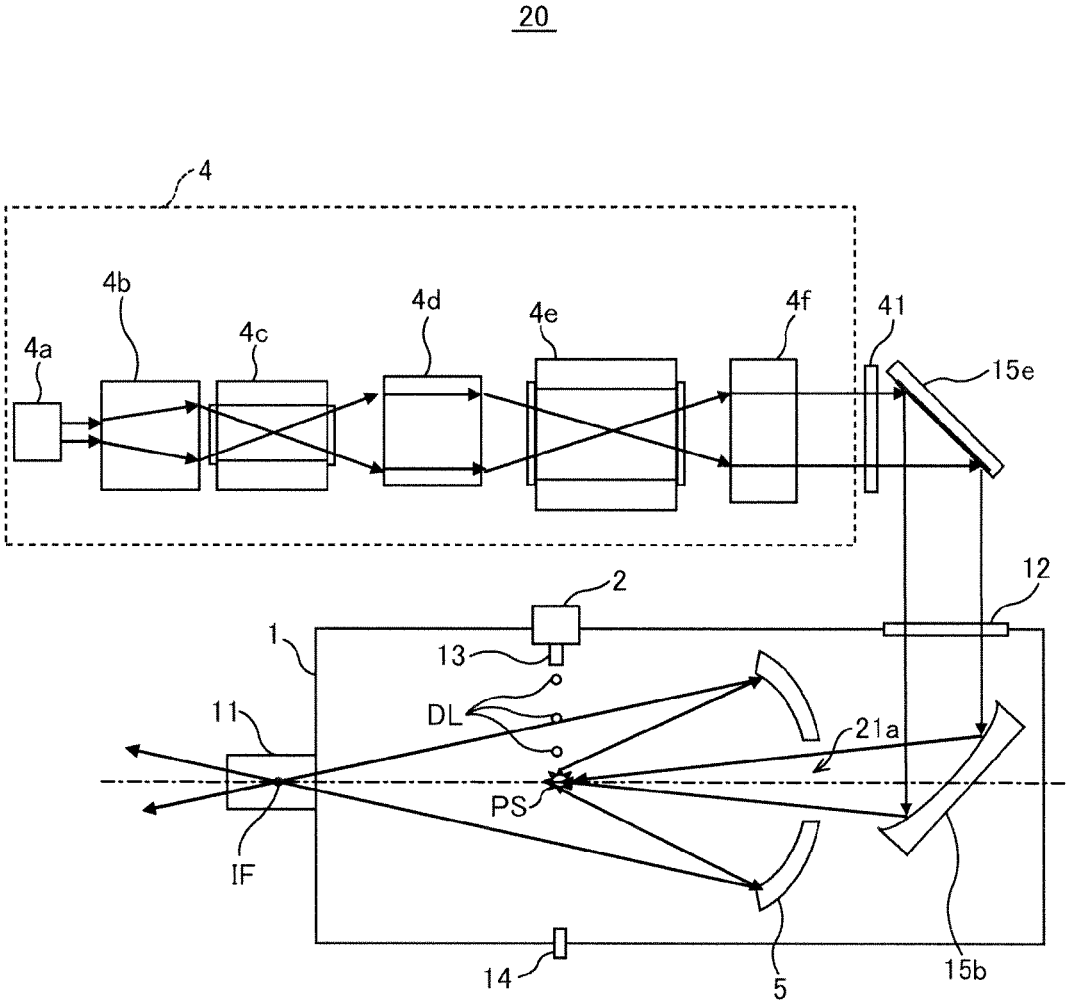
FIG. 22 schematically illustrates an exemplary configuration of an EUV light generation system according to a seventh embodiment.

FIG. 22 schematically illustrates an exemplary configuration of an EUV light generation system according to a seventh embodiment. The EUV light generation system according to the seventh embodiment may differ from the EUV light generation system according to the fourth embodiment described with reference to FIG. 17 in that the pre-pulse laser apparatus 3 (see FIG. 17) is not provided. In the EUV light generation system of the seventh embodiment, the droplet DL may be turned into plasma with only the main pulse laser beam M.

In the seventh embodiment, the beam-shaping optical system 41 may adjust the beam intensity distribution of the main pulse laser beam M so as to include a region where the beam intensity distribution along a cross-section has substantial uniformity. With this configuration, even when the position of the droplet DL varies within the aforementioned region when the droplet DL is irradiated with the main pulse laser beam M, the variation in the irradiation beam intensity of the main pulse laser beam M on the droplet DL may be kept small. As a result, the stability in the generated plasma density may be improved, and the energy of the generated EUV light may be stabilized.

14. Eighth Embodiment

Figure 23:
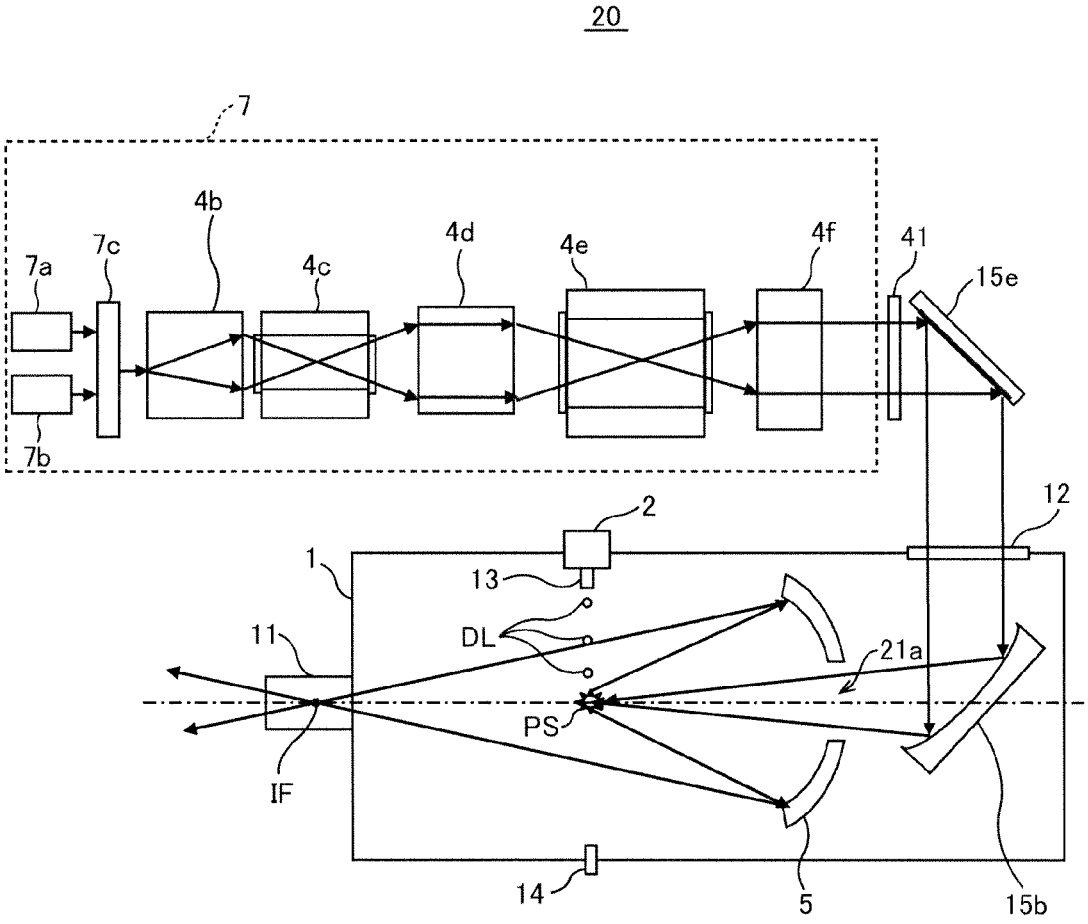
FIG. 23 schematically illustrates an exemplary configuration of an EUV light generation system according to an eighth embodiment.

FIG. 23 schematically illustrates an exemplary configuration of an EUV light generation system according to an eighth embodiment. The EUV light generation system according to the eighth embodiment may include a laser apparatus 7 configured to output both the pre-pulse laser beam P and the main pulse laser beam M.

The laser apparatus 7 may include a first master oscillator 7*a*, a second master oscillator 7*b*, a beam path adjusting unit 7*c*, the preamplifier 4*c*, the main amplifier 4*e*, and the relay optical systems 4*b*, 4*d*, and 4*f*. The first master oscillator 7*a* may be configured to generate a seed beam of the pre-pulse laser beam P. The second master oscillator 7*b* may be configured to generate a seed beam of the main pulse laser beam M. The seed beams generated by the first and second master oscillators 7*a* and 7*b*, respectively, may be in the same bandwidth. The beam path adjusting unit 7*c* may adjust the beam paths of the seed beams to overlap spatially with each other and output the seed beams to the relay optical system 4*b*.

Each of the pre-pulse laser beam P and the main pulse laser beam M outputted from the laser apparatus 7 may have the beam intensity distribution thereof adjusted by the beam-shaping optical system 41 so as to include a region where the beam intensity distribution has substantial uniformity. When the wavelengths of the pre-pulse laser beam P and the main pulse laser beam M are contained within the same bandwidth, the beam intensity distribution of both laser beams may be adjusted by a signal beam-shaping optical system 41.

15. Ninth Embodiment

15.1 Configuration

Figure 24:
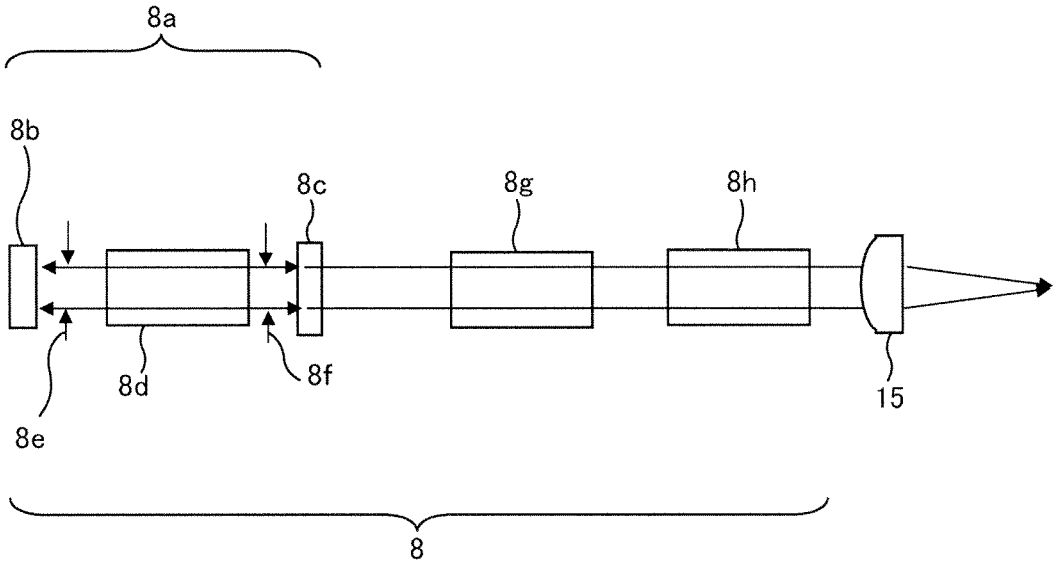
FIG. 24 schematically illustrates an exemplary configuration of a laser apparatus used in an EUV light generation system according to a ninth embodiment.

FIG. 24 schematically illustrates an exemplary configuration of a laser apparatus used in an EUV light generation system according to a ninth embodiment. A laser apparatus 8 of the ninth embodiment may be provided outside the chamber 1 as a pre-pulse laser apparatus.

The laser apparatus 8 may include a master oscillator 8*a*, a preamplifier 8*g*, and a main amplifier 8*h*. The preamplifier 8*g* and the main amplifier 8*h* may be provided in the beam path of a laser beam from the master oscillator 8*a*.

The master oscillator 8*a* may include a stable resonator formed by a high-reflection mirror 8*b* and a partial reflection mirror 8*c*, and a laser medium 8*d*. The laser medium 8*d* may be provided between the high-reflection mirror 8*b* and the partial reflection mirror 8*c*. The laser medium 8*d* may be an Nd:YAG crystal, a Yb:YAG crystal, or the like. The crystal may be columnar or planar.

Each of the high-reflection mirror 8*b* and the partial reflection mirror 8*c* may be a flat mirror or a curved mirror. Aperture plates 8*e* and 8*f* each having an aperture formed therein may be provided in the beam path in the stable resonator.

Each of the preamplifier 8*g* and the main amplifier 8*h* may include a laser medium. This laser medium may be an Nd:YAG crystal, a Yb:YAG crystal, or the like. The crystal may be columnar or planar.

15.2 Operation

When the laser medium 8*d* in the master oscillator 8*a* is excited by a pumping beam from a pumping source (not shown), the stable resonator formed by the high-reflection mirror 8*b* and a partial reflection mirror 8*c* may oscillate in a multi-traverse mode. The cross-sectional shape of the multi-traverse mode laser beam may be modified in accordance with the shape of the apertures formed in the respective aperture plates 8*e* and 8*f* provided in the stable resonator. With this configuration, a laser beam having a cross-sectional shape in accordance with the shape of the apertures and a top-hat beam intensity distribution at a spot may be outputted from the master oscillator 8*a*. The laser beam from the master oscillator 8*a* may be amplified by the preamplifier 8*g* and the main amplifier 8*h*, and the amplified laser beam may be focused by the focusing optical system 15 on the droplet DL. With this configuration, a laser beam having a top-hat beam intensity distribution may be generated without using a beam-shaping optical system.

When the apertures formed in the respective aperture plates 8*e* and 8*f* are rectangular, the cross-sectional shape of the laser beam having a top-hat beam intensity distribution may become rectangular. When the apertures formed in the respective aperture plates 8*e* and 8*f* are circular, the cross-sectional shape of the laser beam having a top-hat beam intensity distribution may become circular. When the direction into which the position of the droplet DL varies fluctuates, the cross-sectional shape of the laser beam having a top-hat beam intensity distribution may be made rectangular by using the aperture plates 8*e* and 8*f* having rectangular apertures formed therein. In this way, the cross-sectional shape of the laser beam having a top-hat beam intensity distribution at a spot may be adjusted by selecting or adjusting the shape of the apertures. Further, without being limited to the use of the aperture plate, the cross-sectional shape of the laser beam may be controlled by the cross-sectional shape of the laser medium 8*d*.

16. Control of Fluence

Figure 25:
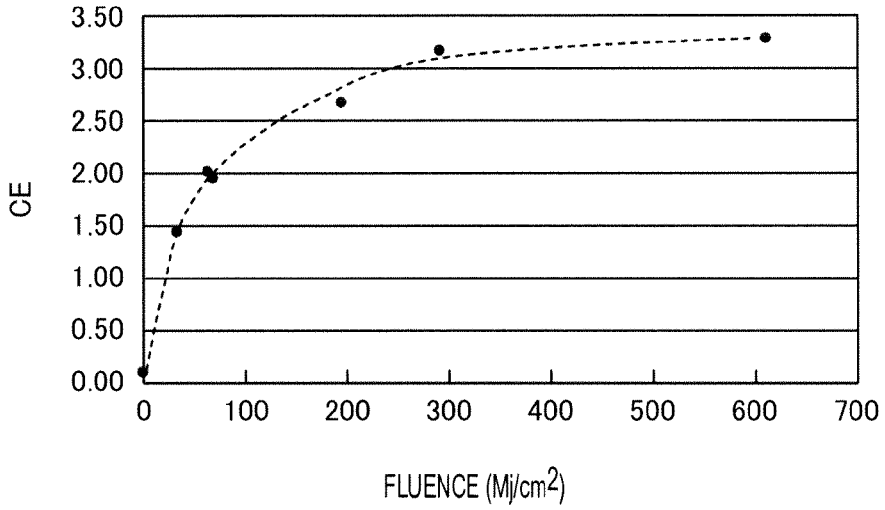
FIG. 25 is a graph on which the obtained conversion efficiency (CE) for the corresponding fluence of a pre-pulse laser beam is plotted.

FIG. 25 is a graph on which the obtained conversion efficiency (CE) for the corresponding fluence of the pre-pulse laser beam is plotted. The fluence may be defined as energy per unit area in a cross-section of a laser beam at its focus.

The measuring conditions are as follows. A molten tin droplet of 20 μm in diameter is used as a target material. A laser beam with a pulse duration of 5 ns to 15 ns outputted from a YAG laser apparatus is used as a pre-pulse laser beam P. A laser beam with a pulse duration of 20 ns outputted from a $CO_2$ laser apparatus is used as a main pulse laser beam M. The beam intensity of the main pulse laser beam is $6.0\times10^9$ W/cm$^2$, and the delay time for the irradiation with the main pulse laser beam is 1.5 μs from the irradiation with the pre-pulse laser beam P.

The horizontal axis of the graph shown in FIG. 25 shows a value obtained by converting the irradiation conditions of the pre-pulse laser beam (pulse duration, energy, and spot size) into a fluence. The vertical axis shows the CE obtained in the case where each of the diffused targets generated in accordance with the respective irradiation conditions of the pre-pulse laser beam P is irradiated with the main pulse laser beam M of substantially the same condition.

The measurement results shown in FIG. 25 reveal that increasing the fluence of the pre-pulse laser beam P may improve the CE (approximately 3%). That is, at least in a range where the pulse duration of the pre-pulse laser beam P is 5 ns to 15 ns, there is a correlation between the fluence and the CE.

Accordingly, in the above-described embodiments, the fluence, instead of the beam intensity, of the pre-pulse laser beam P may be controlled. The measurement results shown in FIG. 25 reveal that the fluence of the pre-pulse laser beam P may be in the range of 10 mJ/cm$^2$ to 600 mJ/cm$^2$. In other embodiments, the range may be 30 mJ/cm$^2$ to 400 mJ/cm$^2$. In yet other embodiments, the range may be 150 mJ/cm$^2$ to 300 mJ/cm$^2$.

17. Control of Delay Time

Figure 26:
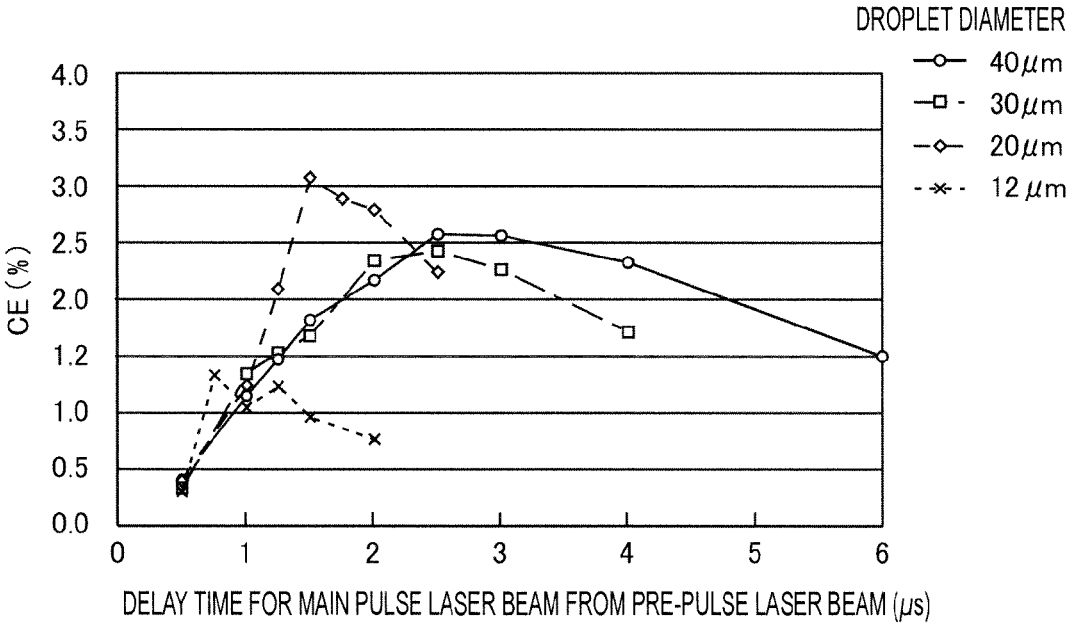
FIG. 26 is a graph on which the obtained CE for the corresponding delay time since a droplet is irradiated with a pre-pulse laser beam until a diffused target is irradiated by a main pulse laser beam for differing diameters of the droplet.

FIG. 26 is a graph on which the obtained CE for the corresponding delay time since a droplet is irradiated with a pre-pulse laser beam until a diffused target is irradiated by a main pulse laser beam is plotted for differing diameters of the droplet.

The measuring conditions are as follows. Molten tin droplets of 12 μm, 20 μm, 30 μm, and 40 μm in diameter are used as the target material. A laser beam with a pulse duration of 5 ns outputted from a YAG laser apparatus is used as a pre-pulse laser beam P. The fluence of the pre-pulse laser beam P is 490 $mJ/cm^2$. A laser beam with a pulse duration of 20 ns outputted from a $CO_2$ laser apparatus is used as a main pulse laser beam M. The beam intensity of the main pulse laser beam M is $6.0\times10^9$ $W/cm^2$.

The measurement results shown in FIG. 26 reveal that the delay time for the irradiation with the main pulse laser beam M may be in a range of 0.5 μs to 2.5 μs from the irradiation with the pre-pulse laser beam P. More specifically, the optimum range of the delay time for the irradiation with the main pulse laser beam M to obtain a high CE may differ depending on the diameters of the droplets.

When the diameter of the droplet is 12 μm, the delay time for the irradiation with the main pulse laser beam M may be in a range of 0.5 μs to 2 μs from the irradiation with the pre-pulse laser beam P. In other embodiments, the range may be 0.6 μs to 1.5 μs. In yet other embodiments, the range may be 0.7 μs to 1 μs.

When the diameter of the droplet is 20 μm, the delay time for the irradiation with the main pulse laser beam M may be in a range of 0.5 μs to 2.5 μs from the irradiation with the pre-pulse laser beam P. In other embodiments, the range may be 1 μs to 2 μs. In yet other embodiments, the range may be 1.3 μs to 1.7 μs.

When the diameter of the droplet is 30 μm, the delay time for the irradiation with the main pulse laser beam M may be in a range of 0.5 μs to 4 μs from the irradiation with the pre-pulse laser beam P. In other embodiments, the range may be 1.5 μs to 3.5 μs. In yet other embodiments, the range may be 2 μs to 3 μs.

When the diameter of the droplet is 40 μm, the delay time for the irradiation with the main pulse laser beam M may be in a range of 0.5 μs to 6 μs from the irradiation with the pre-pulse laser beam P. In other embodiments, the range may be 1.5 μs to 5 μs. In yet other embodiments, the range may be 2 μs to 4 μs.

18. Tenth Embodiment

18.1 Configuration

Figure 27:
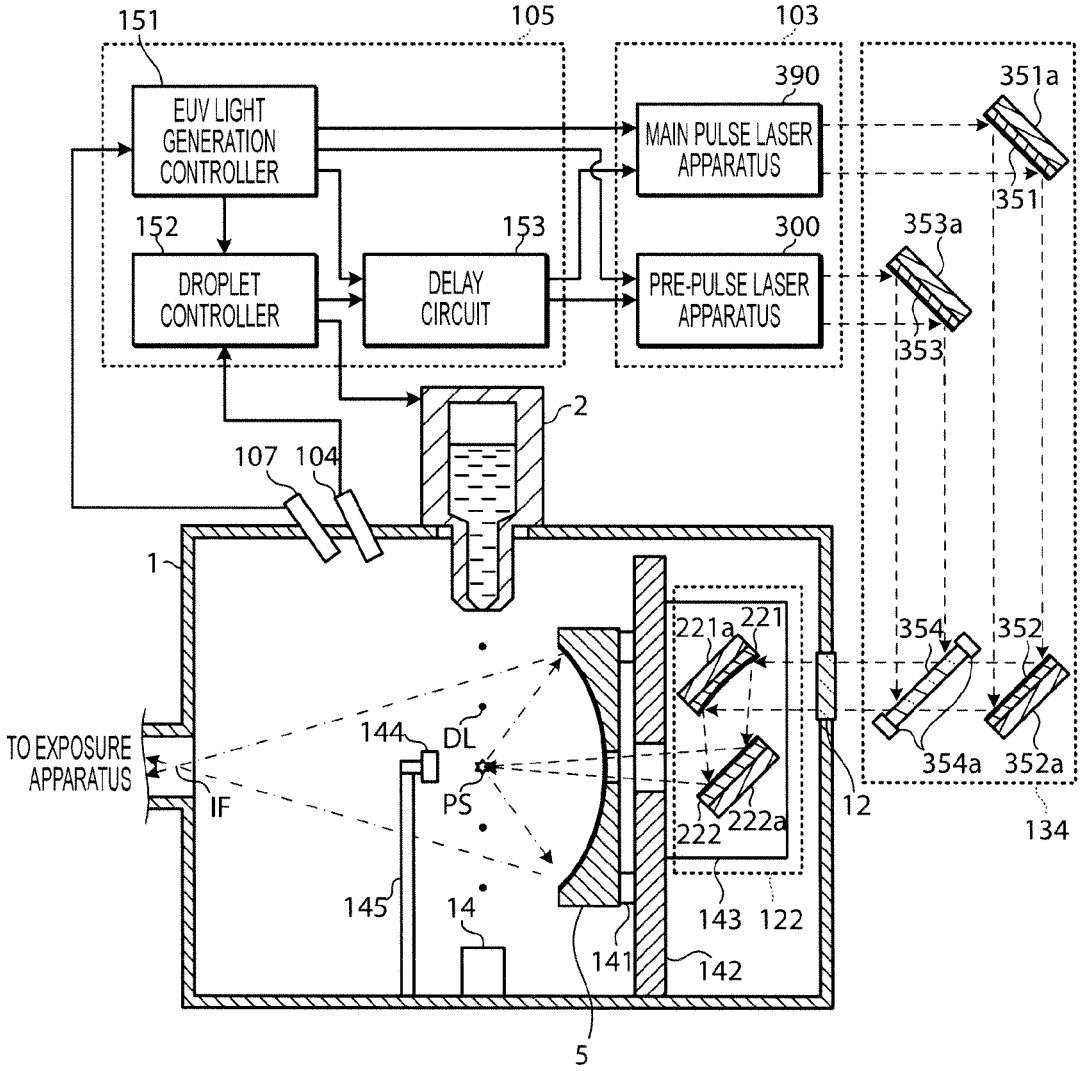
FIG. 27 is a partial sectional view schematically illustrating an exemplary configuration of an EUV light generation system according to a tenth embodiment.

FIG. 27 is a partial sectional view schematically illustrating an exemplary configuration of an EUV light generation system according to a tenth embodiment of this disclosure. As shown in FIG. 27, a laser beam focusing optical system 122, an EUV collector mirror 5, a target collector 14, an EUV collector mirror mount 141, plates 142 and 143, a beam dump 144, a beam dump support member 145 may be provided inside the chamber 1.

The plate 142 may be attached to the chamber 1, and the plate 143 may be attached to the plate 142. The EUV collector mirror 5 may be attached to the plate 142 through the EUV collector mirror mount 141.

The laser beam focusing optical system 122 may include an off-axis paraboloidal mirror 221, a flat mirror 222, and holders 221*a* and 222*a* for the respective mirrors 221 and 222. The off-axis paraboloidal mirror 221 and the flat mirror 222 may be positioned on the plate 143 through the respective mirror holders 221*a* and 222*a* such that a pulse laser beam reflected by these mirrors 221 and 222 is focused in the plasma generation region PS.

The beam dump 144 may be fixed in the chamber 1 through the beam dump support member 145 to be positioned on an extension of a beam path of a pulse laser beam. The target collector 14 may be provided on an extension of a trajectory of a droplet DL.

A target sensor 104, an EUV light sensor 107, a window 12, and a target supply unit 2 may be provided in the chamber 1. A laser apparatus 103, a laser beam travel direction control unit 134, and an EUV light control device 105 may be provided outside the chamber 1.

The target sensor 104 may include an imaging function and may detect at least one of the presence, the trajectory, the position, and the speed of a droplet DL. The EUV light sensor 107 may be configured to detect EUV light generated in the plasma generation region PS to detect an intensity of the EUV light, and output a detection signal to an EUV light generation controller 151. The target supply unit 2 may be configured to continuously output droplets at a predetermined interval, or configured to output a droplet on-demand at a timing in accordance with a trigger signal received from a droplet controller 152. The laser beam travel direction control unit 134 may include high-reflection mirrors 351, 352, and 353, a dichroic mirror 354, and holders 351*a*, 352*a*, 353*a*, and 354*a* for the respective mirrors 351, 352, 353, and 354.

The EUV light control device 105 may include the EUV light generation controller 151, the droplet controller 152, and a delay circuit 153. The EUV light generation controller 151 may be configured to output control signals respectively to the droplet controller 152, the delay circuit 153, and the laser apparatus 103.

The laser apparatus 103 may include a pre-pulse laser apparatus 300 configured to output a pre-pulse laser beam P and a main pulse laser apparatus 390 configured to output a main pulse laser beam M. The aforementioned dichroic mirror 354 may include a coating configured to reflect the pre-pulse laser beam P with high reflectance and transmit the main pulse laser beam M with high transmittance, and may serve as a beam combiner.

18.2 Operation

The droplet controller 152 may output a target supply start signal to the target supply unit 2 to cause the target supply unit 2 to start supplying the droplets DL toward the plasma generation region PS inside the chamber 1.

Upon receiving the target supply start signal from the droplet controller 152, the target supply unit 2 may start outputting the droplets DL toward the plasma generation region PS. The droplet controller 152 may receive a target detection signal from the target sensor 104 and output that detection signal to the delay circuit 153. The target sensor 104 may be configured to detect a timing at which a droplet DL passes through a predetermined position prior to reaching the plasma generation region PS. For example, the target sensor 104 may include a laser device (not shown) and an optical sensor. The laser device included in the target sensor 104 may be positioned such that a continuous wave (CW) laser beam from the laser device travels through the aforementioned predetermined position. The optical sensor included in the target sensor 104 may be positioned to detect a ray reflected by the droplet DL when the droplet DL passes through the aforementioned predetermined position. When the droplet DL passes through the aforementioned predetermined position, the optical sensor may detect the ray reflected by the droplet DL and output a target detection signal.

The delay circuit 153 may output a first timing signal to the pre-pulse laser apparatus 300 so that the droplet DL is irradiated with the pre-pulse laser beam P at a timing at which the droplet DL reaches the plasma generation region PS. The first timing signal may be a signal in which a first delay time is given to a target detection signal. The delay circuit 153 may output a second timing signal to the main pulse laser apparatus 390 such that a diffused target is irradiated with the main pulse laser beam M at a timing at which a droplet irradiated with the pre-pulse laser beam P is diffused to a predetermined size to form the diffused target. Here, a time from the first timing signal to the second timing signal may be a second delay time.

The pre-pulse laser apparatus 300 may be configured to output the pre-pulse laser beam P in accordance with the first timing signal from the delay circuit 153. The main pulse laser apparatus 390 may be configured to output the main pulse laser beam M in accordance with the second timing signal from the delay circuit 153.

The pre-pulse laser beam P from the pre-pulse laser apparatus 300 may be reflected by the high-reflection mirror 353 and the dichroic mirror 354, and enter the laser beam focusing optical system 122 through the window 12. The main pulse laser beam M from the main pulse laser apparatus 390 may be reflected by the high-reflection mirrors 351 and 352, transmitted through the dichroic mirror 354, and enter the laser beam focusing optical system 122 through the window 12.

Each of the pre-pulse laser beam P and the main pulse laser beam M that have entered the laser beam focusing optical system 122 may be reflected sequentially by the off-axis paraboloidal mirror 221 and the flat mirror 222, and guided to the plasma generation region PS. The pre-pulse laser beam P may strike the droplet DL, which may be diffused to form a diffused target. This diffused target may then be irradiated with the main pulse laser beam M to thereby be turned into plasma.

18.3 Parameters of Pre-pulse Laser Beam

18.3.1 Relationship between Pulse Duration and CE

Figure 28:
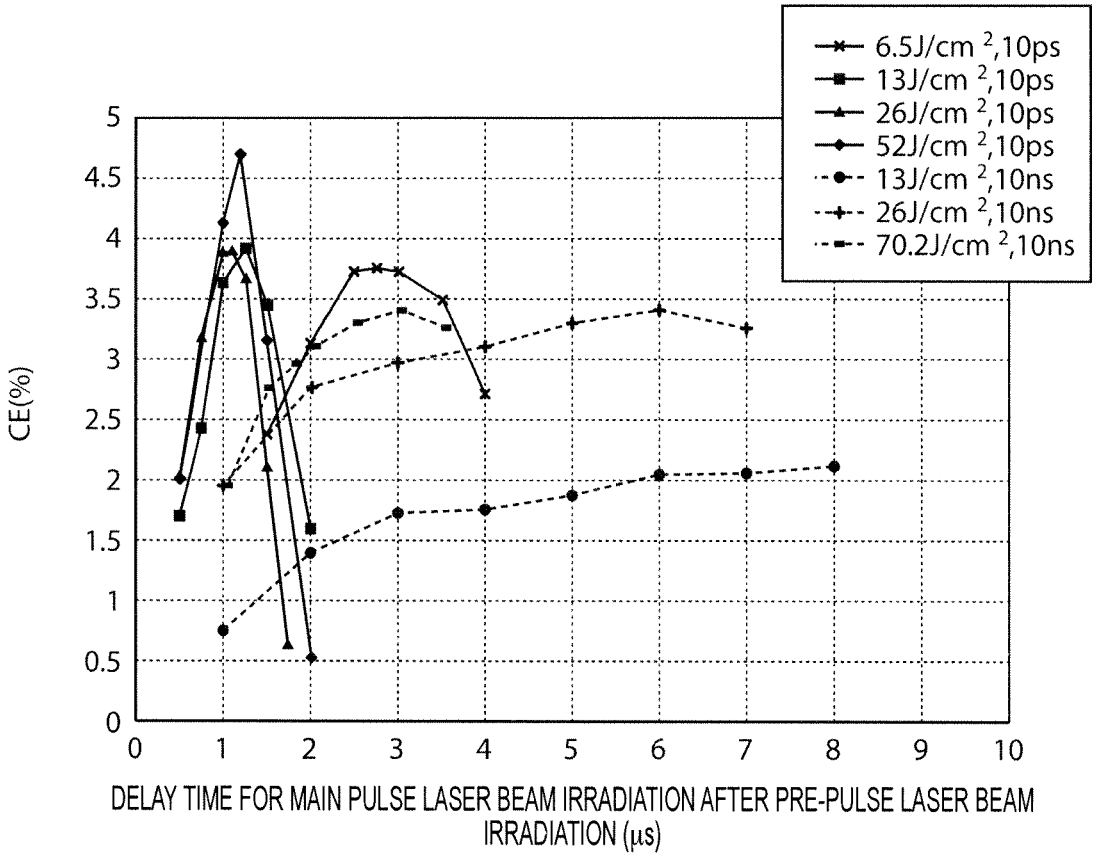
FIG. 28 is a graph showing an example of a relationship between an irradiation condition of a pre-pulse laser beam and a CE in an EUV light generation system.

FIG. 28 is a graph showing an example of a relationship between an irradiation condition of a pre-pulse laser beam and a conversion efficiency (CE) in an EUV light generation system. In FIG. 28, a delay time (a third delay time) (μs) for the main pulse laser beam M from the pre-pulse laser beam P is plotted along the horizontal axis, and a conversion efficiency (%) from an energy of the main pulse laser beam M into an energy of the EUV light is plotted along the vertical axis. The third delay time may be a time from the irradiation of a droplet DL with a pre-pulse laser beam P to the irradiation of a diffused target with a main pulse laser beam M.

In the graph shown in FIG. 28, seven combination patterns of a pulse duration (the full width at half maximum) and a fluence (energy density) of a pre-pulse laser beam P were set, and a measurement was carried out on each combination pattern. Obtained results are shown in a line graph. Here, a fluence may be a value in which an energy of a pulse laser beam is divided by an area of a portion having a beam intensity equal to or higher than $1/e^2$ at the spot.

Details on the measuring conditions are as follows. Tin (Sn) was used as the target material, and tin was molten to produce a droplet having a diameter of 21 μm.

As for the pre-pulse laser apparatus 300, an Nd:YAG laser apparatus was used to generate a pre-pulse laser beam P having a pulse duration of 10 ns and a pulse energy of 0.5 mJ to 2.7 mJ. The wavelength of this pre-pulse laser beam P was 1.06 μm. When a pre-pulse laser beam P having a pulse duration of 10 ps was to be generated, a mode-locked laser device including an $Nd:YVO_4$ crystal was used as a master oscillator, and a regenerative amplifier including an Nd:YAG crystal was used. The wavelength of this pre-pulse laser beam P was 1.06 μm, and the pulse energy thereof was 0.25 mJ to 2 mJ. The spot size of each of the pre-pulse laser beams P was 70 μm.

A $CO_2$ laser apparatus was used as the main pulse laser apparatus to generate a main pulse laser beam M. The wavelength of the main pulse laser beam M was 10.6 μm, and the pulse energy thereof was 135 mJ to 170 mJ. The pulse duration of the main pulse laser beam M was 15 ns, and the spot size thereof was 300 μm.

The results are as follows. As shown in FIG. 28, when the pulse duration of the pre-pulse laser beam P was 10 ns, a CE never reached 3.5% at the maximum. Further, the CE in this case reached the maximum in each combination pattern when the third delay time is equal to or greater than 3 μs.

On the other hand, as for a CE when the pulse duration of the pre-pulse laser beam P was 10 ps, the maximum value in each combination pattern exceeded 3.5%. These maximum values were obtained when the third delay time was smaller than 3 μs. In particular, the CE of 4.7% was achieved when the pulse duration of the pre-pulse laser beam P was 10 ps, the fluence was 52 J/cm$^2$, and the third delay time was 1.2 μs.

The above-described results reveal that a higher CE may be achieved when the pulse duration of the pre-pulse laser beam P is in the picosecond range (e.g., 10 ps) compared to the case where the pulse duration thereof is in the nanosecond range (e.g., 10 ns). Further, an optimal third delay time for obtaining the highest CE was smaller when the pulse duration of the pre-pulse laser beam P was in the picosecond range compared to the case where the pulse duration thereof was in the nanosecond range. Accordingly, the EUV light may be generated at a higher repetition rate when the pulse duration of the pre-pulse laser beam P is in the picosecond range compared to the case where the pulse duration thereof is in the nanosecond range.

Further, based on the results shown in FIG. 28, when the pulse duration of the pre-pulse laser beam P is in the picosecond range and the fluence is 13 J/cm$^2$ to 52 J/cm$^2$, the third delay time may be set in a range between 0.5 μs and 1.8 μs inclusive. In other embodiments, the third delay time may be in a range between 0.7 μs and 1.6 μs inclusive, and in yet other embodiments, the range may be between 1.0 μs and 1.4 μs inclusive.

Figure 29A:
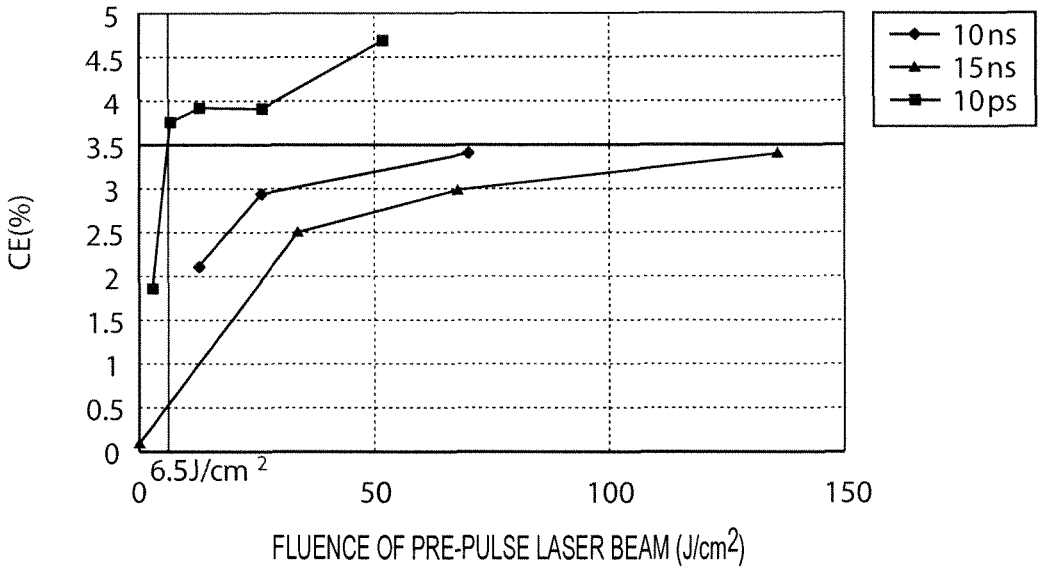
FIG. 29A is a graph showing an example of a relationship between a fluence of a pre-pulse laser beam and a CE in an EUV light generation system.

18.3.2 Relationship Between Pulse Duration and Fluence, and Relationship Between Pulse Duration and Beam Intensity FIG. 29A is a graph showing an example of a relationship between a fluence of a pre-pulse laser beam and a CE in an EUV light generation system. In FIG. 29A, a fluence (J/cm$^2$) of a pre-pulse laser beam P is plotted along the horizontal axis, and a CE (%) is plotted along the vertical axis. In each of the cases where a pulse duration of the pre-pulse laser beam P was set to 10 ps, 10 ns, and 15 ns, a CE was measured for various third delay times, and the CE at the optimal third delay time was plotted. Here, the results shown in FIG. 28 were used to fill a part of the data where the pulse duration was 10 ps or 10 ns. Further, in order to generate a pre-pulse laser beam P having a pulse duration of 15 ns, a pre-pulse laser apparatus configured similarly to the one used to generate a pre-pulse laser beam P having a pulse duration of 10 ns was used.

In all of the cases where the pulse duration of the pre-pulse laser beam P was 10 ps, 10 ns, and 15 ns, the CE increased with the increase in the fluence of the pre-pulse laser beam P, and the CE saturated when the fluence exceeded a predetermined value. Further, the higher CE was obtained when the pulse duration was 10 ps, compared to the case where the pulse duration was 10 ns or 15 ns, and the fluence required to obtain that CE was smaller when the pulse duration was 10 ps. When the pulse duration was 10 ps, if the fluence was increased from 2.6 J/cm$^2$ to 6.5 J/cm$^2$, the CE improved greatly, and if the fluence exceeded 6.5 J/cm$^2$, the rate of increase in the CE with respect to the increase in the fluence was small.

Figure 29B:
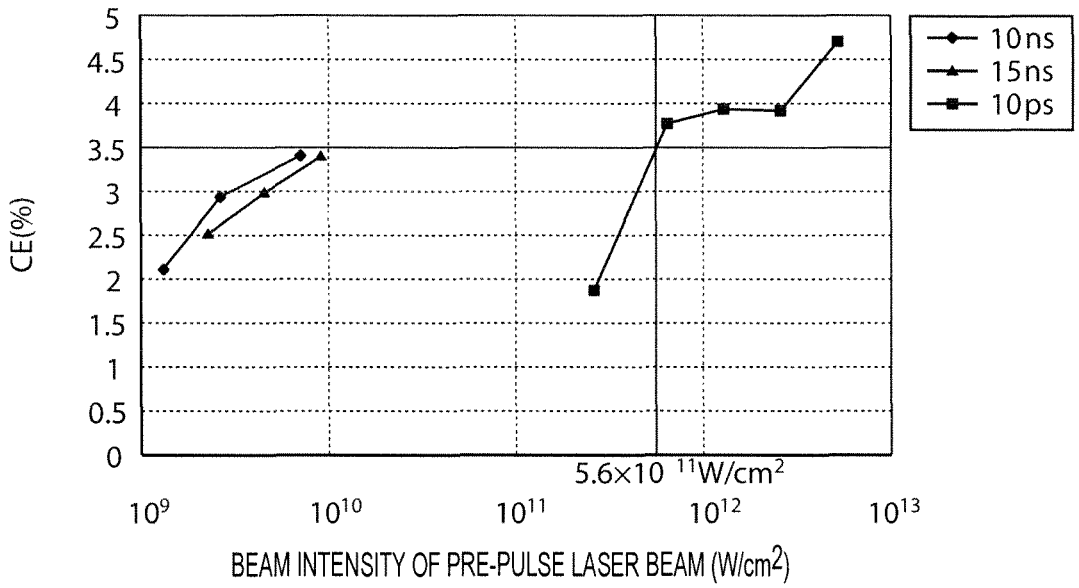
FIG. 29B is a graph showing an example of a relationship between a beam intensity of a pre-pulse laser beam and a CE in an EUV light generation system.

FIG. 29B is a graph showing an example of a relationship between a beam intensity of a pre-pulse laser beam and a CE in an EUV light generation system. In FIG. 29B, the beam intensity (W/cm$^2$) of the pre-pulse laser beam P is plotted along the horizontal axis, and the CE (%) is plotted along the vertical axis. The beam intensity was calculated from the results shown in FIG. 29A. Here, the beam intensity is a value in which the fluence of the pre-pulse laser beam P is divided by the pulse duration (the full width at half maximum).

In all of the cases where the pulse duration of the pre-pulse laser beam P was 10 ps, 10 ns, and 15 ns, the CE increased with the increase in the beam intensity of the pre-pulse laser beam P. Further, a higher CE was obtained when the pulse duration was 10 ps, compared to the case where the pulse duration was 10 ns or 15 ns. When the pulse duration was 10 ps, the CE greatly improved if the beam intensity was increased from $2.6\times10^{11}$ W/cm$^2$ to $5.6\times10^{11}$ W/cm$^2$, and an even higher CE was obtained when the beam intensity exceeded $5.6\times10^{11}$ W/cm$^2$.

As described above, when a droplet is irradiated with a pre-pulse laser beam P having a pulse duration in the picosecond range to form a diffused target and the diffused target is irradiated with a main pulse laser beam M, a higher CE may be obtained.

18.3.3 Relationship Between Pulse Duration and State of Diffused Target

Figure 30A:
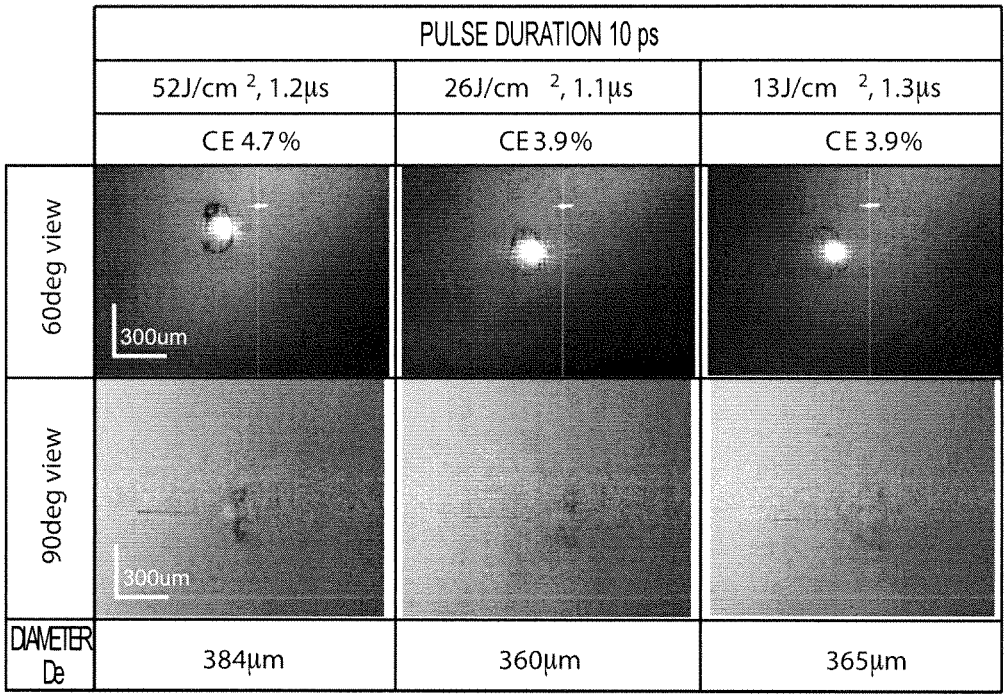
FIG. 30A shows photographs of a diffused target generated when a droplet is irradiated with a pre-pulse laser beam in an EUV light generation system.
Figure 30B:
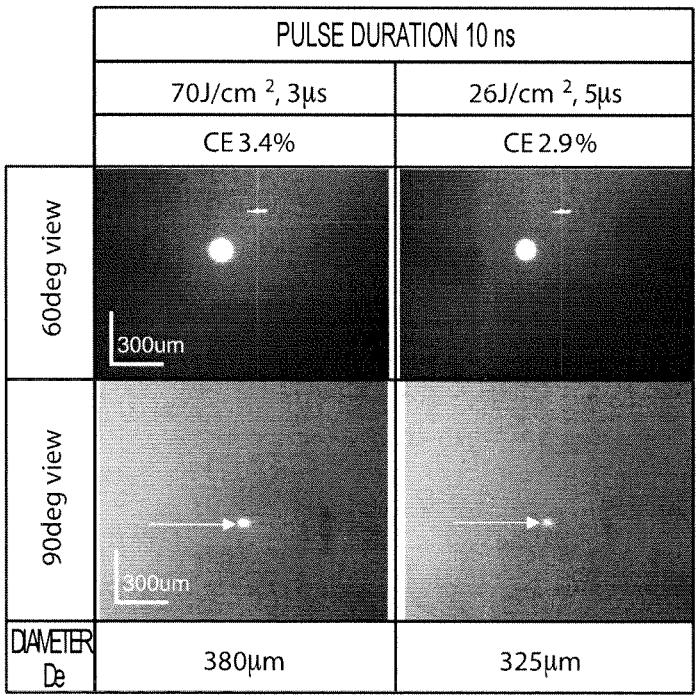
FIG. 30B shows photographs of a diffused target generated when a droplet is irradiated with a pre-pulse laser beam in an EUV light generation system.

FIGS. 30A and 30B show photographs of a diffused target generated when a droplet is irradiated with a pre-pulse laser beam in an EUV light generation system. Each of the photographs shown in FIG. 30A was captured with the optimal third delay time in cases where the pulse duration of the pre-pulse laser beam P was set to 10 ps with three differing fluences. That is, as in the description given with reference to FIG. 28, FIG. 30A shows a diffused target at the third delay times of 1.2 μs (fluence of 52 J/cm$^2$), 1.1 μs (fluence of 26 J/cm$^2$), and 1.3 μs (fluence of 13 J/cm$^2$). Each of the photographs shown in FIG. 30B was captured with the optimal third delay time in cases where the pulse duration of the pre-pulse laser beam P was set to 10 ns with two differing fluences. That is, FIG. 30B shows a diffused target at the third delay times of 3 μs (fluence of 70 J/cm$^2$) and 5 μs (fluence of 26 J/cm$^2$). In both FIGS. 30A and 30B, the diffused target was captured at an angle of 60 degrees and 90 degrees with respect to the beam path of the pre-pulse laser beam P. The arrangement of the capturing equipment will be described later.

A diameter De of the diffused target was 360 μm to 384 μm when the pulse duration of the pre-pulse laser beam P was 10 ps, and the diameter De was 325 μm to 380 μm when the pulse duration of the pre-pulse laser beam P was 10 ns. That is, the diameter De of the diffused target was somewhat larger than 300 μm, which was the spot size of the main pulse laser beam M. However, the spot size of the main pulse laser beam M here is shown as a 1/e$^2$ width (a width of a portion having a beam intensity equal to or higher than 1/e$^2$ of the peak intensity). Thus, even when the diameter De of the diffused target is 400 μm, the diffused target may be irradiated with the main pulse laser beam M sufficiently.

Further, the diameter De of the diffused target reached 300 μm in a shorter period of time when the pulse duration of the pre-pulse laser beam P was 10 ps, compared to the case where the pulse duration was 10 ns. That is, the diffusion speed of the diffused target was found to be faster when the pulse duration was 10 ps, compared to the case where the pulse duration was 10 ns.

Figure 31:
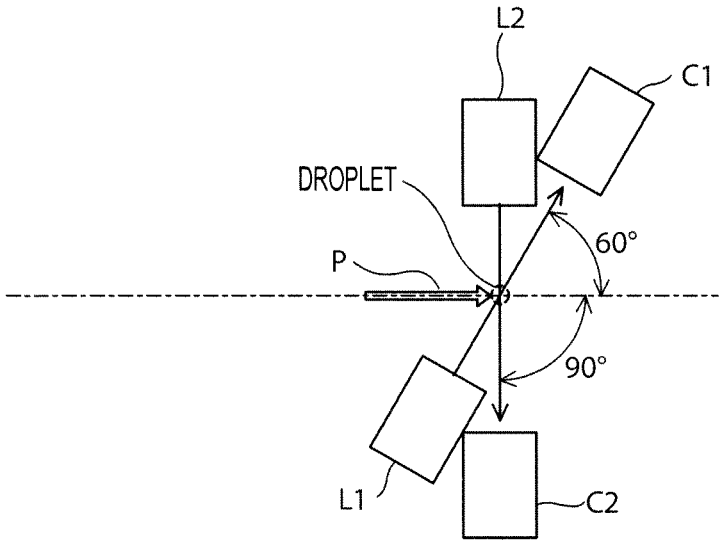
FIG. 31 schematically illustrates an arrangement of equipment used to capture the photographs shown in FIGS. 30A and 30B.

FIG. 31 schematically illustrates an arrangement of equipment used to capture the photographs shown in FIGS. 30A and 30B. As shown in FIG. 31, cameras C1 and C2 are respectively arranged at 60 degrees and 90 degrees to the beam path of the pre-pulse laser beam P, and flash lamps L1 and L2 are respectively arranged to oppose the cameras C1 and C2 with a point where a droplet is irradiated located therebetween.

Figure 32A:
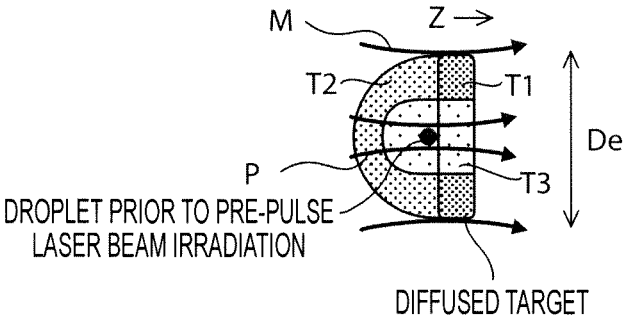
FIG. 32A is a sectional view schematically illustrating the diffused target shown in FIG. 30A.
Figure 32B:
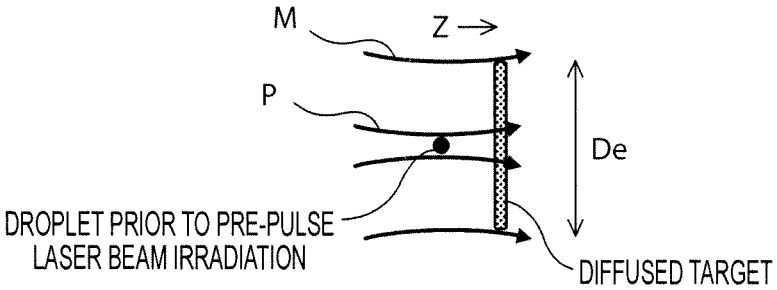
FIG. 32B is a sectional view schematically illustrating the diffused target shown in FIG. 30B.

FIGS. 32A and 32B are sectional views schematically illustrating the diffused targets shown respectively in FIGS. 30A and 30B. As shown in FIGS. 30A and 32A, when the pulse duration of the pre-pulse laser beam P was 10 ps, the droplet diffused annularly in the direction in which the pre-pulse laser beam P travels, and diffused in a dome shape in the opposite direction. More specifically, the diffused target included a first portion T1 where the target material diffused in an annular shape, a second portion T2 which is adjacent to the first portion T1 and in which the target material diffused in a dome shape, and a third portion T3 surrounded by the first portion T1 and the second portion T2. The density of the target material was higher in the first portion T1 than in the second portion T2, and the density of the target material was higher in the second portion T2 than in the third portion T3.

On the other hand, as shown in FIGS. 30B and 32B, when the pulse duration of the pre-pulse laser beam P was 10 ns, the droplet diffused in a disc shape or in an annular shape. In this case, the droplet diffused toward the direction in which the pre-pulse laser beam P travels.

When the pulse duration of the pre-pulse laser beam P is in the nanosecond range, laser ablation from the droplet may occur over a time period in the nanosecond range. During that time period, heat may be conducted into the droplet, a part of the droplet may be vaporized, or the droplet may move due to the reaction of the laser ablation. On the other hand, when the pulse duration of the pre-pulse laser beam P is in the picosecond range, the droplet may be broken up instantaneously before the heat is conducted into the droplet. Such a difference in the diffusion process of the droplet may be a cause for the higher CE with a pre-pulse laser beam P having a small fluence when the pulse duration thereof is in the picosecond range, compared to the case where the pulse duration thereof is in the nanosecond range (see FIG. 29A).

Further, the particle size of the fine particles of the target material included in the diffused target was smaller when the pulse duration of the pre-pulse laser beam P was in the picosecond range, compared to the case where the pulse duration was in the nanosecond range. Accordingly, the diffused target may be turned into plasma more efficiently when the diffused target is irradiated with the main pulse laser beam M in a case where the pulse duration of the pre-pulse laser beam P is in the picosecond range. This may be a cause for the higher CE when the pulse duration is in the picosecond range, compared to the case where the pulse duration is in the nanosecond range.

18.3.4 Generation Process of Diffused Target

Figure 33A:
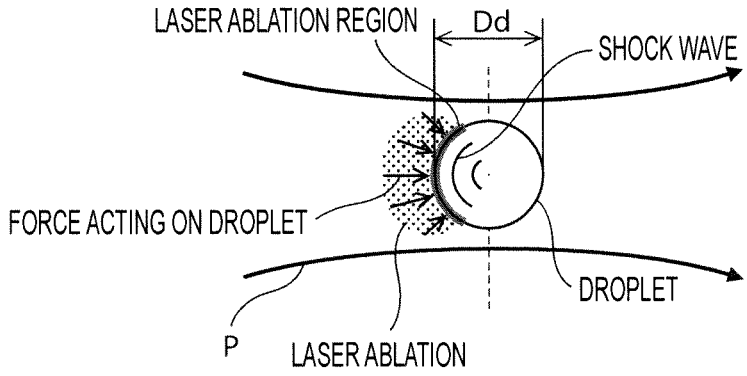
FIG. 33A is a sectional view schematically illustrating a process through which a diffused target is generated when a droplet is irradiated with a pre-pulse laser beam having a pulse duration in the picosecond range.
Figure 33B:
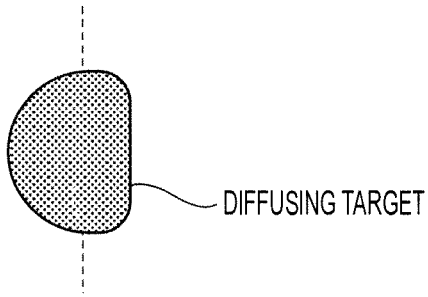
FIG. 33B is another sectional view schematically illustrating the process through which the diffused target is generated when a droplet is irradiated with a pre-pulse laser beam having a pulse duration in the picosecond range.
Figure 33C:
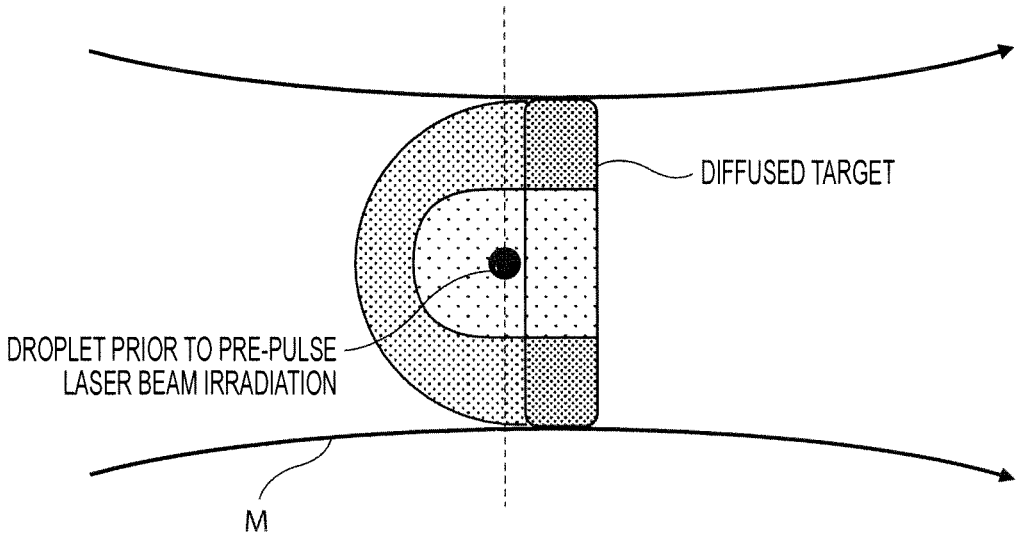
FIG. 33C is yet another sectional view schematically illustrating the process through which the diffused target is generated when a droplet is irradiated with a pre-pulse laser beam having a pulse duration in the picosecond range.

FIGS. 33A through 33C are sectional views schematically illustrating a process through which a diffused target is generated when a droplet is irradiated with a pre-pulse laser beam having a pulse duration in the picosecond range. FIG. 33A shows a presumed state of the target material after a time in the picosecond range has passed since the droplet starts to be irradiated with the pre-pulse laser beam P having a pulse duration in the picosecond range. FIG. 33B shows a presumed state of the target material after a time in the nanosecond range has passed since the droplet starts to be irradiated with the pre-pulse laser beam P having a pulse duration in the picosecond range. FIG. 33C shows a state of a diffused target after approximately 1 μs has passed since the droplet starts to be irradiated with the pre-pulse laser beam P having a pulse duration in the picosecond range (see FIG. 32A).

As shown in FIG. 33A, when the droplet is irradiated with the pre-pulse laser beam P, a part of the energy of the pre-pulse laser beam P may be absorbed into the droplet. As a result, laser ablation, a jet of ions or atoms of the target material, may occur substantially normal to the surface of the droplet irradiated with the pre-pulse laser beam P toward the outside of the droplet. Then, the reaction of the laser ablation may act normal onto the surface of the droplet irradiated with the pre-pulse laser beam P.

This pre-pulse laser beam P may have a fluence equal to or higher than 6.5 J/cm$^2$, and the irradiation may be completed within the picosecond range. Thus, the energy of the pre-pulse laser beam P which the droplet receives per unit time may be relatively large (see FIG. 29B). Accordingly, a large amount of laser ablation may occur in a short period of time. Thus, the reaction of the laser ablation may be large, and a shock wave may occur into the droplet.

The shock wave may travel substantially normal to the surface of the droplet irradiated with the pre-pulse laser beam P, and thus the shock wave may converge at substantially the center of the droplet. The curvature of the wavefront of the shock wave may be substantially the same as that of the surface of the droplet. As the shock wave converges, the energy may be concentrated, and when the concentrated energy exceeds a predetermined level, the droplet may begin to break up.

It is speculated that the break-up of the droplet starts from a substantially semi-spherical wavefront of the shock wave whose energy has exceeded the aforementioned predetermined level as the shock wave converges. This may be a reason why the droplet has diffused in a dome shape in a direction opposite to the direction in which the pre-pulse laser beam P has struck the droplet.

When the shock wave converges at the center of the droplet (see FIG. 29A), the energy may be at highest concentration, and the remaining part of the droplet may be broken up at once. This may be a reason why the droplet has diffused in an annular shape in the direction in which the pre-pulse laser beam P has struck the droplet, as shown in FIG. 33C.

Although it is speculated that a large amount of laser ablation occurs in the state shown in FIG. 33A, the time in which the laser ablation occurs is short, and the time it takes for the shock wave to reach the center of the droplet may also be short. Then, as shown in FIG. 33B, it is speculated that the droplet has already started to break up after a time in the nanosecond range has elapsed. This may be a reason why the centroid of the diffused target does not differ much from the position of the center of the droplet prior to being irradiated with the pre-pulse laser beam P.

Figure 34A:
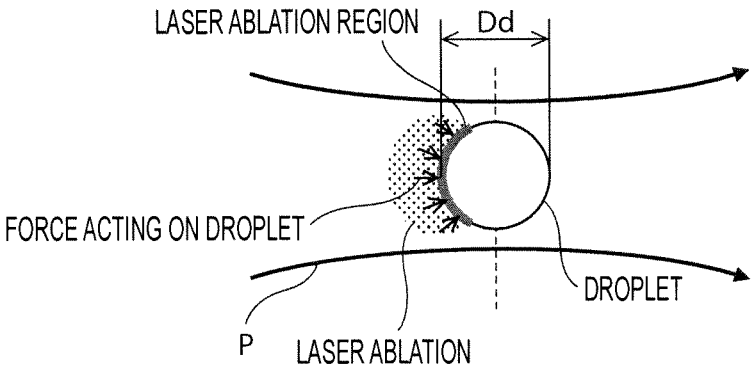
FIG. 34A is a sectional view schematically illustrating a process through which a diffused target is generated when a droplet is irradiated with a pre-pulse laser beam having a pulse duration in the nanosecond range.
Figure 34B:
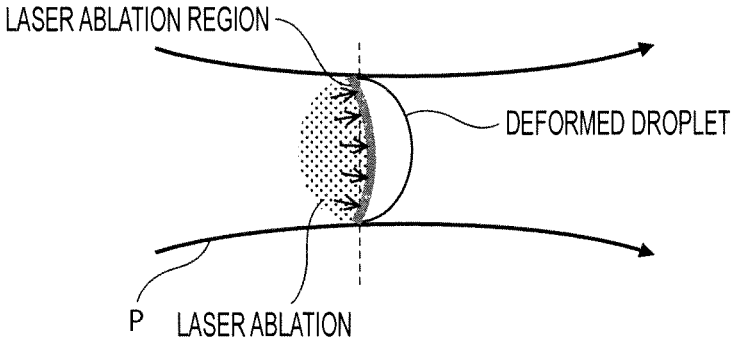
FIG. 34B is another sectional view schematically illustrating the process through which the diffused target is generated when a droplet is irradiated with a pre-pulse laser beam having a pulse duration in the nanosecond range.
Figure 34C:
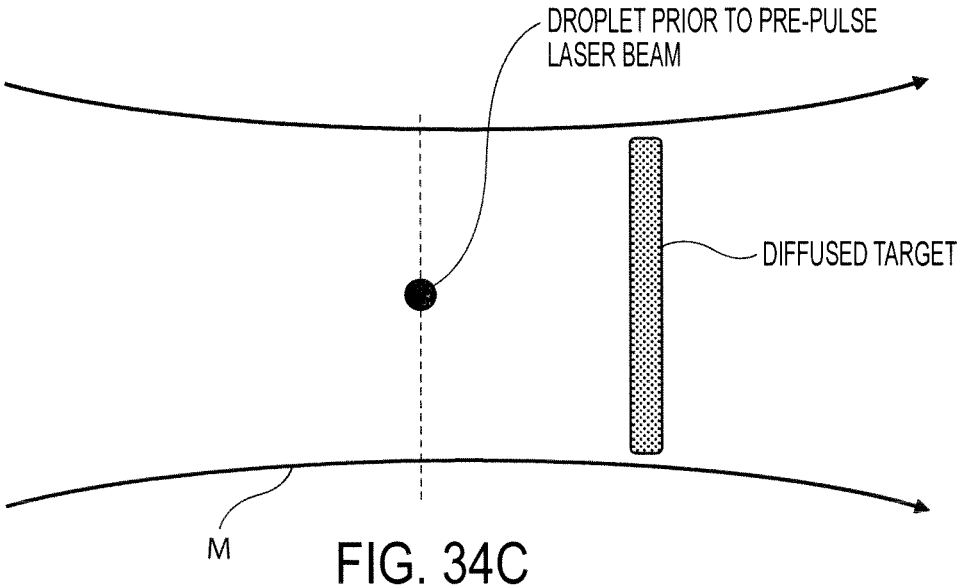
FIG. 34C is yet another sectional view schematically illustrating the process through which the diffused target is generated when a droplet is irradiated with a pre-pulse laser beam having a pulse duration in the nanosecond range.

FIGS. 34A through 34C are sectional views schematically illustrating a process through which a diffused target is generated when a droplet is irradiated with a pre-pulse laser beam having a pulse duration in the nanosecond range. FIG. 34A shows a presumed state of the target material after a time in the picosecond range has passed since the droplet starts to be irradiated with the pre-pulse laser beam P having a pulse duration in the nanosecond range. FIG. 34B shows a presumed state of the target material after a time in the nanosecond range has passed since the droplet starts to be irradiated with the pre-pulse laser beam P having a pulse duration in the nanosecond range. FIG. 34C shows a state of a diffused target after a few μs has passed since the droplet starts to be irradiated with the pre-pulse laser beam P having a pulse duration in the nanosecond range (see FIG. 32B).

As shown in FIG. 34A, when the droplet is irradiated with the pre-pulse laser beam P, a part of the energy of the pre-pulse laser beam P may be absorbed into the droplet. As a result, laser ablation may occur substantially normal to the surface of the droplet irradiated with the pre-pulse laser beam P. Then, the reaction of the laser ablation may act substantially normal onto the surface of the droplet irradiated with the pre-pulse laser beam P.

This pre-pulse laser beam P has a pulse duration in the nanosecond range. This pre-pulse laser beam P may have a fluence similar to that of the above-described pre-pulse laser beam P having a pulse duration in the picosecond range. However, since the droplet is irradiated with the pre-pulse laser beam P having a pulse duration in the nanosecond range over a time period in the nanosecond range, the energy of the pre-pulse laser beam P which the droplet receives per unit time is smaller (see FIG. 29B).

A sonic speed V through liquid tin forming the droplet is approximately 2500 m/s. When the diameter Dd of the droplet is 21 μm, a time Ts in which the sonic wave travels from the surface of the droplet irradiated with the pre-pulse laser beam P to the center of the droplet may be calculated as follows.

$$\begin{aligned} Ts &= (Dd/2)/V \\ &= (21\times10^{-6}/2)/2500 \\ &= 4.2\ \text{ns} \end{aligned}$$

In the above-described measurement (see FIGS. 28 through 31), the fluence of the pre-pulse laser beam P is not set to be high enough to vaporize the entire droplet as ions or atoms by the laser ablation. Accordingly, when the droplet is irradiated with the pre-pulse laser beam P having a pulse duration of 10 ns, the thickness of the droplet in the direction in which the pre-pulse laser beam P travels may not be reduced more than 21 μm within 10 ns. That is, the speed at which the thickness of the droplet decreases by being pressurized by the reaction of the laser ablation may not exceed the sonic speed in liquid tin. Accordingly, the shock wave may not likely to occur inside the droplet.

The droplet irradiated with such a pre-pulse laser beam P having a pulse duration in the nanosecond range may deform into a flat or substantially disc shape due to the reaction of the laser ablation acting on the droplet over a time period in the nanosecond range, as shown in FIG. 34B. Then, when the force causing the droplet to deform due to the reaction of the laser ablation overcomes the surface tension, the droplet may break up. This may be a reason why the droplet has diffused in a disc shape or in an annular shape as shown in FIG. 34C.

Further, as stated above, the reaction of the laser ablation may act on the droplet for a time period in the nanosecond range in the above-described case. Thus, this droplet may be accelerated by the reaction of the laser ablation for an approximately 1000 times longer period of time than in a case where the droplet is irradiated with the pre-pulse laser beam P having a pulse duration in the picosecond range. This may be a reason why the centroid of the diffused target is shifted from the center of the droplet in the direction in which the pre-pulse laser beam P travels, as shown in FIG. 34C.

18.3.5 Range of Pulse Duration

As stated above, when the droplet is irradiated with the pre-pulse laser beam P having a pulse duration in the picosecond range, a shock wave may occur inside the droplet and the droplet may break up from the vicinity of the center thereof. On the other hand, when the droplet is irradiated with the pre-pulse laser beam P having a pulse duration in the nanosecond range, a shock wave may not occur and the droplet may break up from the surface thereof.

Based on the above, the conditions for causing a shock wave to occur by the pre-pulse laser beam and breaking up the droplet may be as follows. Here, the diameter Dd of the droplet may be 10 μm to 40 μm.

When the diameter Dd of the droplet is 40 μm, a time Ts required for the sonic wave to reach the center of the droplet from the surface thereof is calculated as follows.

$$\begin{aligned} Ts &= (Dd/2)/V \\ &= (40\times10^{-6}/2)/2500 \\ &= 8\ \text{ns} \end{aligned}$$

A pulse duration Tp of the pre-pulse laser beam P may be sufficiently shorter than the time Ts required for the sonic wave to reach the center of the droplet from the surface thereof. Irradiating the droplet with the pre-pulse laser beam P having a certain level of fluence within such a short period of time may cause a shock wave to occur, and the droplet may break up into fine particles.

A coefficient K will now be defined. The coefficient K may be set to determine a pulse duration Tp which is sufficiently smaller than the time Ts required for the sonic wave to reach the center of the droplet from the surface thereof. As in Expression (1) below, a value smaller than a product of the time Ts and the coefficient K may be the pulse duration Tp of the pre-pulse laser beam P.

$$Tp<K\cdot Ts \tag{1}$$

The coefficient K may, for example, be set as $K<1/8$. In other embodiments, the coefficient K may be set as $K\leq1/16$. In yet other embodiments, the coefficient K may be set as $K\leq1/160$.

When the diameter Dd of the droplet is 40 μm, a value for the pulse duration Tp of the pre-pulse laser beam P may be induced from Expression (1) above as follows.

When $K<1/8$, $Tp<1$ ns

In other embodiments, when $K\leq1/16$, $Tp\leq500$ ps

In yet other embodiments, when $K<1/160$, $Tp\leq50$ ps 18.3.6 Range of Fluence

Referring back to FIG. 29A, when a fluence of the pre-pulse laser beam P having a pulse duration in the picosecond range is set to be equal to or higher than 6.5 J/cm$^2$, the CE of 3.5% or higher is obtained when the diffused target is irradiated with the main pulse laser beam M in the optimal third delay time. When the fluence is set to be equal to or higher than 30 J/cm$^2$, the CE of 4% or higher is obtained. Further, when the fluence is set to be equal to or higher than 45 J/cm$^2$, the CE of 4.5% or higher is obtained. Accordingly, the fluence of the pre-pulse laser beam P having the pulse duration in the picosecond range may be set to be equal to or higher than 6.5 J/cm$^2$. In other embodiments, the fluence may be set to 30 J/cm$^2$, and in yet other embodiments, the fluence may be set to 45 J/cm$^2$.

An energy Ed absorbed by the droplet when the droplet is irradiated with the pre-pulse laser beam P having a pulse duration in the picosecond range may be approximated from the following expression.

$$Ed\approx F\cdot A\cdot n\cdot(Dd/2)^2$$

Here, F is the fluence of the pre-pulse laser beam P, and A is an absorptance of the pre-pulse laser beam P by the droplet. When the target material is liquid tin, and the wavelength of the pre-pulse laser beam P is 1.06 μm, A is approximately 16%. Dd is the diameter of the droplet.

Mass m of the droplet may be obtained from the following expression.

$$m=\rho\cdot(4\pi/3)\cdot(Dd/2)^3$$

Here, ρ is the density of the droplet. When the target material is liquid tin, ρ is approximately 6.94 g/cm$^3$.

Then, an energy Edp of the pre-pulse laser beam P absorbed by the droplet per unit mass may be obtained from Expression (2) below.

$$\begin{aligned} Edp &= Ed/m \\ &\approx (3/2)\cdot F\cdot A/(\rho\cdot Dd) \end{aligned} \tag{2}$$

Accordingly, when the target material is liquid tin and the CE of 3.5% is obtained (i.e., the fluence F of the pre-pulse laser beam P is 6.5 J/cm$^2$), the energy Edp absorbed by the droplet per unit mass may be obtained from Expression (2) above as follows.

$$Edp\approx(3/2)\times6.5\times0.16/(6.94\times21\times10^{-4})\approx107\ J/g$$

When the CE of 4% is obtained (i.e., the fluence F of the pre-pulse laser beam P is 30 J/cm$^2$), the energy Edp absorbed by the droplet per unit mass may be obtained as follows.

$$Edp\approx(3/2)\times30\times0.16/(6.94\times21\times10^{-4})\approx494\ J/g$$

When the CE of 4.5% is obtained (i.e., the fluence F of the pre-pulse laser beam P is 45 J/cm$^2$), the energy Edp absorbed by the droplet per unit mass may be obtained as follows.

$$Edp\approx(3/2)\times45\times0.16/(6.94\times21\times10^{-4})\approx741\ J/g$$

Further, from Expression (2), the relationship between the fluence F of the pre-pulse laser beam P and the energy Edp absorbed by the droplet per unit mass may be expressed as follows.

$$F \approx (2/3)Edp \cdot \rho Dd/A$$

Accordingly, the fluence F of the pre-pulse laser beam P to obtain the CE of 3.5% using a given target material may be obtained using the aforementioned Edp as follows.

$$F \approx (2/3)107 \cdot \rho \cdot Dd/A \approx 71.3(\rho \cdot Dd/A)$$

The fluence F of the pre-pulse laser beam P to obtain the CE of 4% using a given target material may be obtained as follows.

$$F \approx (2/3)494 \cdot \rho \cdot Dd/A \approx 329(\rho \cdot Dd/A)$$

The fluence F of the pre-pulse laser beam P to obtain the CE of 4.5% using a given target material may be obtained as follows.

$$F \approx (2/3)741 \cdot \rho \cdot Dd/A \approx 494(\rho \cdot Dd/A)$$

Accordingly, the value of the fluence F of the pre-pulse laser beam P may be equal to or greater than the values obtained as above. Further, the value of the fluence F of the pre-pulse laser beam P may be equal to or smaller than the value of the fluence of the main pulse laser beam M. The fluence of the main pulse laser beam M may, for example, be 150 J/cm$^2$ to 300 J/cm$^2$.

18.4 Pre-Pulse Laser Apparatus

18.4.1 General Configuration

A mode-locked laser device may be used to generate a pre-pulse laser beam P having a short pulse duration. The mode-locked laser device may oscillate at a plurality of longitudinal modes with fixed phases among one another. When the plurality of longitudinal modes interferes with one another, a pulse of a laser beam having a short pulse duration may be outputted. However, a timing at which a given pulse of the pulse laser beam is outputted from the mode-locked laser device may depend on a timing at which a preceding pulse is outputted and a repetition rate in accordance with a resonator length of the mode-locked laser device. Accordingly, it may not be easy to control the mode-locked laser device such that each pulse is outputted at a desired timing. Thus, in order to control the timing at which a droplet supplied into the chamber 1 is irradiated with a given pulse of a pre-pulse laser beam P, a pre-pulse laser apparatus may be configured as follows.

Figure 35:
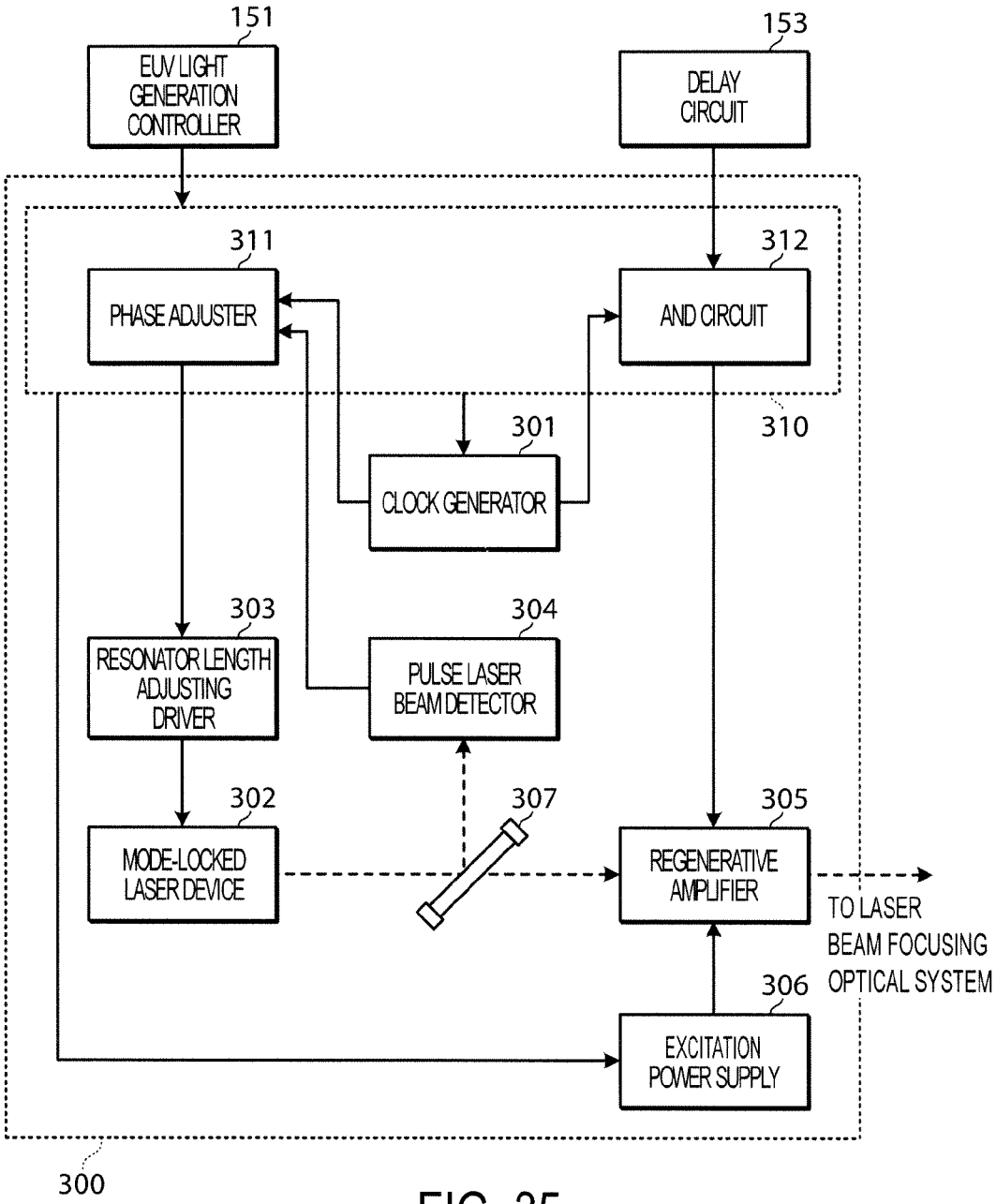
FIG. 35 schematically illustrates an exemplary configuration of a pre-pulse laser apparatus shown in FIG. 27.

FIG. 35 schematically illustrates an exemplary configuration of a pre-pulse laser apparatus shown in FIG. 27. The pre-pulse laser apparatus 300 may include a clock generator 301, a mode-locked laser device 302, a resonator length adjusting driver 303, a pulse laser beam detector 304, a regenerative amplifier 305, an excitation power supply 306, and a controller 310.

The clock generator 301 may, for example, output a clock signal at a repetition rate of 100 MHz. The mode-locked laser device 302 may output a pulse laser beam at a repetition rate of approximately 100 MHz, for example. The mode-locked laser device 302 may include a resonator, which will be described later, and the resonator length thereof may be adjusted through the resonator length adjusting driver 303.

A beam splitter 307 may be provided in a beam path of the pulse laser beam from the mode-locked laser device 302. The pulse laser beam may be split by the beam splitter 307, and the pulse laser beam detector 304 may be provided in a beam path of a part of the pulse laser beam split by the beam splitter 307. The pulse laser beam detector 304 may be configured to detect the pulse laser beam and output a detection signal.

The regenerative amplifier 305 may be provided in a beam path of the other part of the pulse laser beam split by the beam splitter 307. The details of the regenerative amplifier 305 will be given later.

The controller 310 may include a phase adjuster 311 and an AND circuit 312. The phase adjuster 311 may carry out a feedback-control on the resonator length adjusting driver 303 based on the clock signal from the clock generator 301 and the detection signal from the pulse laser beam detector 304.

Further, the controller 310 may control the regenerative amplifier 305 based on the clock signal from the clock generator 301 and the aforementioned first timing signal from the delay circuit 153 described with reference to FIG. 27. More specifically, the AND circuit 312 may be configured to generate an AND signal of the clock signal and the first timing signal, and control a Pockels cell inside the regenerative amplifier 305 through the AND signal of the clock signal.

18.4.2 Mode-Locked Laser Device

Figure 36:
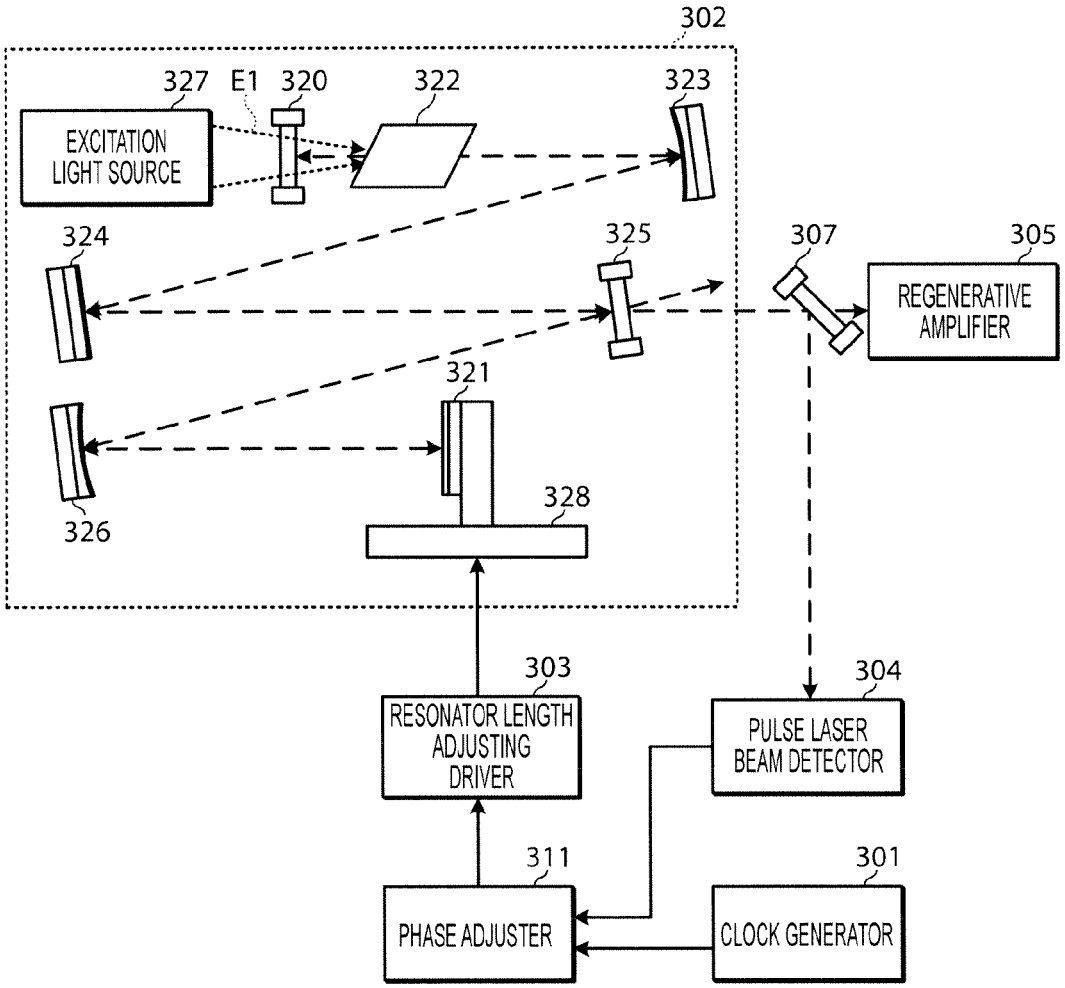
FIG. 36 schematically illustrates an exemplary configuration of a mode-locked laser device shown in FIG. 35.

FIG. 36 schematically illustrates an exemplary configuration of a mode-locked laser device shown in FIG. 35. The mode-locked laser device 302 may include a resonator formed by a flat mirror 320 and a saturable absorber mirror 321, and a laser crystal 322, a concave mirror 323, a flat mirror 324, an output coupler mirror 325, and a concave mirror 326 are provided in this order from the side of the flat mirror 320 in a beam path in the resonator. The beam path in the resonator may be substantially parallel to the paper plane. The mode-locked laser device 302 may further include an excitation light source 327 configured to introduce excitation light E1 to the laser crystal 322 from the outside of the resonator. The excitation light source 327 may include a laser diode to generate the excitation light E1.

The flat mirror 320 may be configured to transmit the excitation light E1 from the excitation light source 327 with high transmittance and reflect light from the laser crystal 322 with high reflectance. The laser crystal 322 may be a laser medium that undergoes stimulated emission with the excitation light E1. The laser crystal 322 may, for example, be a neodymium-doped yttrium orthovanadate (Nd:$YVO_4$) crystal. Light emitted from the laser crystal 322 may include a plurality of longitudinal modes. The laser crystal 322 may be arranged so that a laser beam is incident on the laser crystal 322 at a Brewster's angle.

The concave mirror 323, the flat mirror 324, and the concave mirror 326 may reflect the light emitted from the laser crystal 322 with high reflectance. The output coupler mirror 325 may be configured to transmit a part of the laser beam amplified in the laser crystal 322 to the outside of the resonator and reflect the remaining part of the laser beam back into the resonator to be further amplified in the laser crystal 322. First and second laser beams that travel in different directions may be outputted through the output coupler mirror 325 to the outside of the resonator. The first laser beam is a part of the laser beam reflected by the flat mirror 324 and transmitted through the output coupler mirror 325, and the second laser beam is a part of the laser beam reflected by the concave mirror 326 and transmitted through the output coupler mirror 325. The aforementioned beam splitter 307 may be provided in a beam path of the first laser beam, and a beam dump (not shown) may be provided in a beam path of the second laser beam.

The saturable absorber mirror 321 may be formed such that a reflective layer is laminated on a mirror substrate and a saturable absorber layer is laminated on the reflective layer. In the saturable absorber mirror 321, the saturable absorber layer may absorb an incident ray while the intensity thereof is equal to or lower than a predetermined threshold value. When the intensity of the incident ray exceeds the predetermined threshold value, the saturable absorber layer may transmit the incident ray and the reflective layer may reflect the incident ray. With this configuration, only high-intensity pulses of the laser beam may be reflected by the saturable absorber mirror 321. The high-intensity pulses may be generated when the plurality of longitudinal modes is in phase with one another.

In this way, the mode-locked pulses of the laser beam may travel back and forth in the resonator and be amplified. The amplified pulses may be outputted through the output coupler mirror 325 as a pulse laser beam. The repetition rate of this pulse laser beam may correspond to an inverse of a time it takes for a pulse to make a round trip in the resonator. For example, when the resonator length L is 1.5 m, the speed of light in vacuum c is $3\times10^8$ m/s, a refractive index in the beam path, which is obtained by dividing the speed of light in vacuum by the speed of light in a material in the beam path, is 1, a repetition rate f may be 100 MHz as obtained from the following expression.

$$\begin{aligned} f &= c/(2L) \\ &= (3\times10^8)/(2\times1.5) \\ &= 100\ \text{MHz} \end{aligned}$$

Since the laser crystal 322 is arranged at a Brewster's angle to the laser beam, the pulse laser beam outputted from the mode-locked laser beam 302 may be a linearly polarized laser beam whose polarization direction is parallel to the paper plane.

The saturable absorber mirror 321 may be held by a mirror holder, and this mirror holder may be movable by a linear stage 328 in the direction in which the laser beam is incident on the saturable absorber mirror 321. The linear stage 328 may be driven through the aforementioned resonator length adjusting driver 303. As the saturable absorber mirror 321 is moved in the direction in which the laser beam is incident on the saturable absorber mirror 321, the resonator length may be adjusted to adjust the repetition rate of the pulse laser beam.

As mentioned above, the phase adjuster 311 may be configured to control the resonator length adjusting driver 303 based on the clock signal from the clock generator 301 and the detection signal from the pulse laser beam detector 304. More specifically, the phase adjuster 311 may detect a phase difference between the clock signal and the detection signal, and control the resonator length adjusting driver 303 so that the clock signal and the detection signal are in synchronization with a certain phase difference, a fourth delay time. The fourth delay time will be described later with reference to FIGS. 39A and 39B.

18.4.3 Regenerative Amplifier

Figure 37:
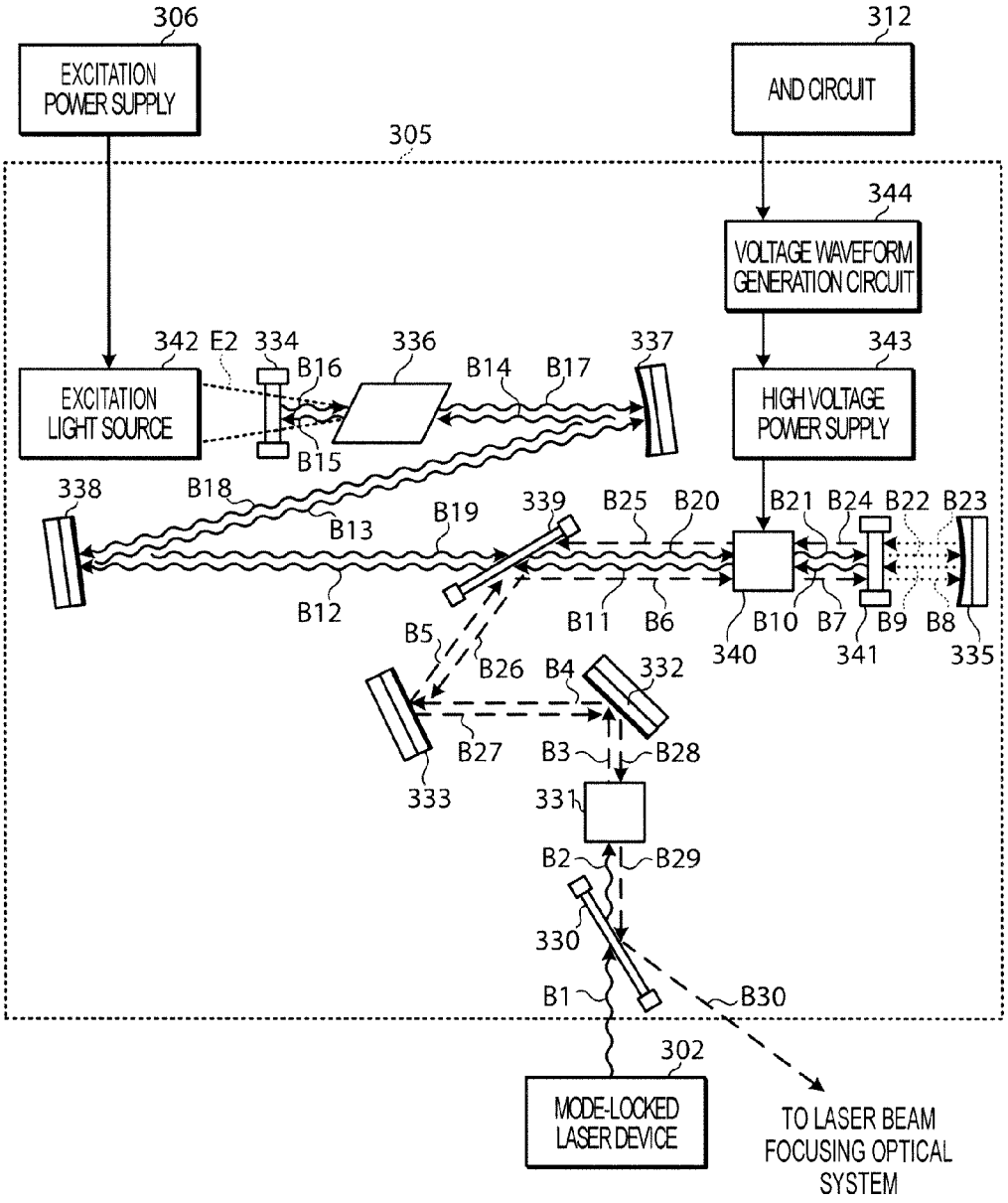
FIG. 37 schematically illustrates an exemplary configuration of a regenerative amplifier shown in FIG. 35.

FIG. 37 schematically illustrates an exemplary configuration of the regenerative amplifier shown in FIG. 35. The regenerative amplifier 305 may include a resonator formed by a flat mirror 334 and a concave mirror 335, and a laser crystal 336, a concave mirror 337, a flat mirror 338, a polarization beam splitter 339, a Pockels cell 340, and a quarter-wave plate 341 may be provided in this order from the side of the flat mirror 334 in a beam path in the resonator. The resonator length of the resonator in the regenerative amplifier 305 may be shorter than that of the resonator in the mode-locked laser device 302. Further, the regenerative amplifier 305 may include an excitation light source 342 configured to introduce excitation light E2 to the laser crystal 336 from the outside of the resonator. An electric power may be supplied to the excitation light source 342 from the excitation power supply 306. The excitation light source 342 may include a laser diode to generate the excitation light E2. Further, the regenerative amplifier 305 may include a polarization beam splitter 330, a Faraday optical isolator 331, and flat mirrors 332 and 333. The Faraday optical isolator 331 may include a Faraday rotator (not shown) and a quarter-wave plate (not shown).

The flat mirror 334 may be configured to transmit the excitation light E2 from the excitation light source 342 with high transmittance and reflect light emitted from the laser crystal 336 with high reflectance. The laser crystal 336 may be a laser medium excited by the excitation light E2, and may, for example, be a neodymium-doped yttrium aluminum garnet (Nd:YAG) crystal. Further, the laser crystal 336 may be arranged so that a laser beam is incident on the laser crystal 336 at a Brewster's angle. When a seed beam outputted from the mode-locked laser device 302 is incident on the laser crystal 336 excited by the excitation light E2, the seed beam may be amplified through stimulated emission.

18.4.3.1 When Voltage is not Applied to Pockels Cell

The beam splitter 330 may be provided in a beam path of a pulse laser beam B1 from the mode-locked laser device 302. The polarization beam splitter 330 may, for example, be arranged such that light receiving surfaces thereof are perpendicular to the paper plane. The polarization beam splitter 330 may be configured to transmit a polarization component parallel to the paper plane with high transmittance and reflect the other polarization component perpendicular to the paper plane with high reflectance.

The Faraday optical isolator 331 may be provided in a beam path of a pulse laser beam B2 transmitted through the polarization beam splitter 330. The Faraday optical isolator 331 may shift a phase difference between the two polarization components of the incident pulse laser beam B2 by 180 degrees and output as a pulse laser beam B3. That is, the Faraday optical isolator 331 may rotate the polarization direction of the incident linearly polarized laser beam B2 by 90 degrees. Further, the Faraday optical isolator 331 may transmit a pulse laser beam B28, which will be described later, toward the polarization beam splitter 330 without rotating the polarization direction thereof.

The flat mirror 322 may be provided in a beam path of the pulse laser beam B3 transmitted through the Faraday optical isolator 331. The flat mirror 332 may reflect the pulse laser beam B3 with high reflectance. The flat mirror 333 may reflect a pulse laser beam B4 reflected by the flat mirror 332 with high reflectance.

The polarization beam splitter 339 in the resonator may be provided in a beam path of a pulse laser beam B5 reflected by the flat mirror 333. The polarization beam splitter 339 may be provided such that the light receiving surfaces thereof are perpendicular to the paper plane, and the pulse laser beam B5 may be incident on a first surface of the polarization beam splitter 339. The polarization beam splitter 339 may reflect the linearly polarized pulse laser beam B5 polarized in a direction perpendicular to the paper plane with high reflectance to thereby guide into the resonator as a pulse laser beam B6.

A voltage may be applied to the Pockels cell 340 by a high-voltage power supply 343. However, when the voltage is not applied to the Pockels cell 340, the Pockels cell 340 may transmit the entering pulse laser beam B6 without shifting the phase difference between the two polarization components thereof.

The quarter-wave plate 341 may shift a phase difference between the two polarization components of a pulse laser beam B7 by 90 degrees. The concave mirror 335 may reflect a pulse laser beam B8 from the quarter-wave plate 341 with high reflectance. A pulse laser beam B9 reflected by the concave mirror 335 may be transmitted through the quarter-wave plate 341, and the phase difference between the two polarization components thereof may be shifted by 90 degrees. In this way, the pulse laser beam B9 may be transformed into a linearly polarized pulse laser beam B10 polarized in a direction parallel to the paper plane.

As stated above, when the voltage is not applied to the Pockels cell 340, the Pockels cell 340 may transmit the incident pulse laser beam without shifting the phase difference between the two polarization components. Accordingly, a pulse laser beam B11 transmitted through the Pockels cell 340 may be incident on the first surface of the polarization beam splitter 339 as a linearly polarized pulse laser beam polarized in a direction parallel to the paper plane and be transmitted through the polarization beam splitter 339 with high transmittance.

The flat mirror 338 may reflect a pulse laser beam B12 from the polarization beam splitter 339 with high reflectance. The concave mirror 337 may reflect a pulse laser beam B13 from the flat mirror 338 with high reflectance. A pulse laser beam B14 from the concave mirror 337 may then be incident on the laser crystal 336, and be amplified in the laser crystal 336.

The flat mirror 334 may reflect a pulse laser beam B15 from the laser crystal 336 with high reflectance back to the laser crystal 336 as a pulse laser beam B16. A pulse laser beam B17 amplified by the laser crystal 336 may be reflected by the concave mirror 337 as a pulse laser beam B18. The pulse laser beam B18 may then be reflected the flat mirror 338, and, as a pulse laser beam B19, transmitted through the polarization beam splitter 339. A pulse laser beam B20 from the beam splitter 339 may enter the Pockels cell 340, and be incident on the quarter-wave plate 341 as a pulse laser beam B21. The pulse laser beam B21 may be transmitted through the quarter-wave plate 341, and, as a pulse laser beam B22, reflected by the concave mirror 335. A pulse laser beam B23 may then be transmitted again through the quarter-wave plate 341, to thereby be converted into a linearly polarized pulse laser beam B24 polarized in a direction perpendicular to the paper plane. The pulse laser beam B24 may be transmitted through the Pockels cell 340, reflected, as a pulse laser beam B25, by the polarization beam splitter 339, and outputted as a pulse laser beam B26 to the outside of the resonator.

The pulse laser beam B26 may be reflected by the high-reflection mirror 333, and, as a pulse laser beam B27, reflected by the high-reflection mirror 332. Then, a pulse laser beam 28 from the high-reflection mirror 332 may enter the Faraday optical isolator 331. As stated above, the Faraday optical isolator 331 may transmit the linearly polarized pulse laser beam B28 as a linearly polarized pulse laser beam B29 without rotating the polarization direction thereof. The polarization beam splitter 330 may reflect the linearly polarized pulse laser beam B29 polarized in a direction perpendicular to the paper plane with high reflectance.

A pulse laser beam B30 reflected by the polarization beam splitter 330 may be guided to the plasma generation region PS through the laser beam focusing optical system 122 (see FIG. 27). Here, even when a droplet is irradiated with the pulse laser beam B30 outputted after making only one round trip in the resonator in the regenerative amplifier 305, the droplet may not be diffused. This pulse laser beam B30 may not have a beam intensity sufficient to turn the droplet into plasma.

18.4.3.2 When Voltage is Applied to Pockels Cell

The high-voltage power supply 343 may apply a voltage to Pockels cell 340 at a given timing prior to the pulse laser beam B20 entering the Pockels cell 340. When the voltage is applied to the Pockels cell 340, the Pockels cell 340 may shift the phase difference between the two polarization components of the entering pulse laser beam by 90 degrees.

Figure 38:
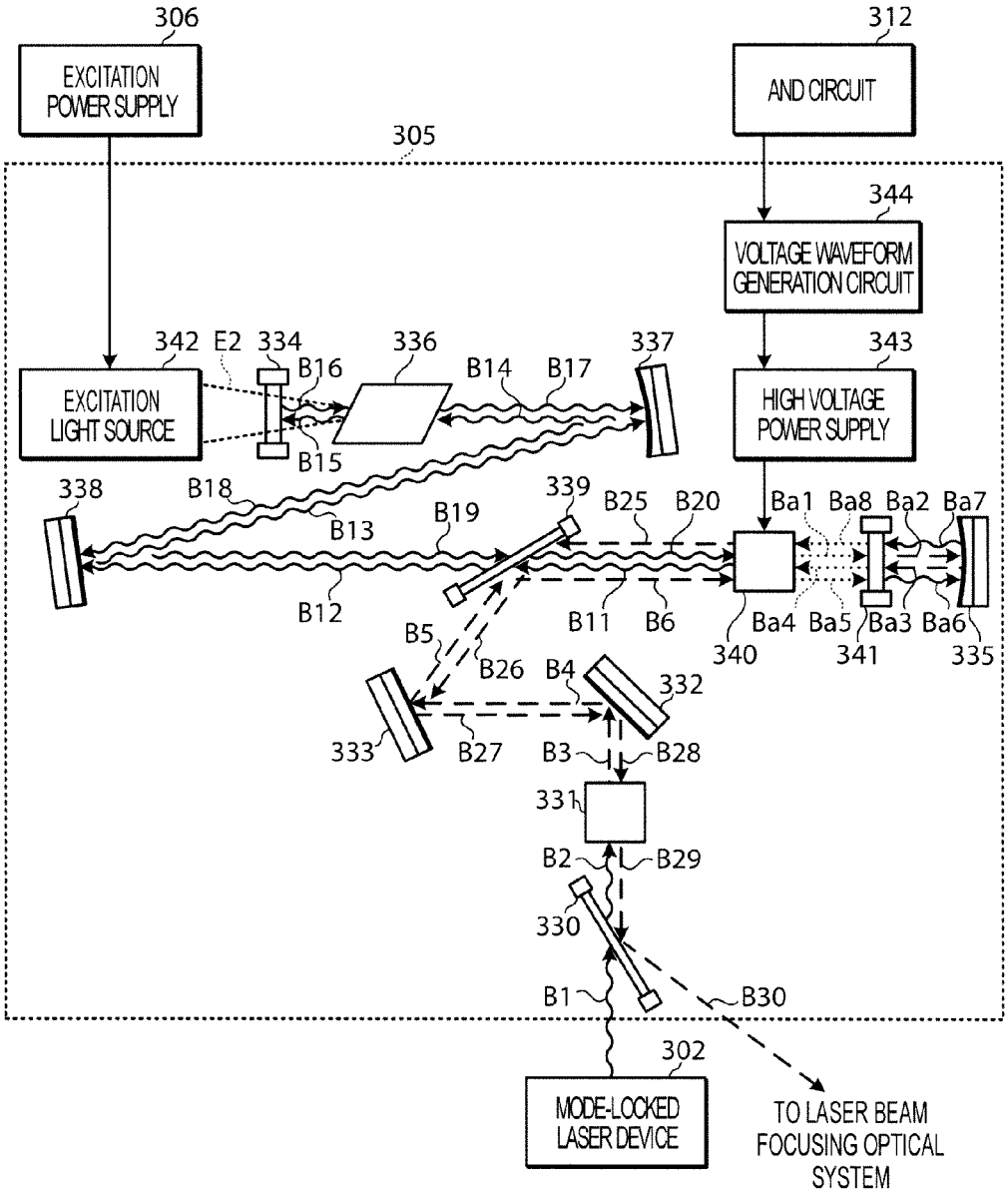
FIG. 38 schematically illustrates a beam path in the regenerative amplifier shown in FIG. 37, when a voltage is applied to a Pockels cell.

FIG. 38 schematically illustrates a beam path in the regenerative amplifier shown in FIG. 37 when a voltage is applied to the Pockels cell. Here, the pulse laser beam B20 may be transmitted through the Pockels cell 340 twice and the quarter-wave plate 341 twice, as indicated by pulse laser beams Ba1, Ba2, Ba3, and Ba4, and return as the pulse laser beam B11. The pulse laser beam B11 that has been transmitted through the quarter-wave plate 341 twice and transmitted through the Pockels cell 340 twice to which the voltage is applied may have its polarization direction oriented toward the same direction as that of the pulse laser beam B20. Accordingly, the pulse laser beam B11 may be transmitted through the polarization beam splitter 339 and be amplified by the laser crystal 336. While the voltage is applied to the Pockels cell 340, this amplification operation may be repeated.

After the amplification operation is repeated, the high-voltage power supply 343 may set the voltage applied to the Pockels cell 340 to OFF at a given timing prior to the pulse laser beam B20 entering the Pockels cell 340. As stated above, when the voltage is not applied to the Pockels cell 340 from the high-voltage power supply 343, the Pockels cell 340 may not shift the phase difference between the two polarization components of the entering pulse laser beam. Accordingly, the pulse laser beam B20 entering the Pockels cell 340 when the voltage is not applied thereto may have its polarization direction rotated only by 90 degrees as it is transmitted through the quarter-wave plate 341 twice (see the pulse laser beams B21, B22, B23, and B24 shown in FIG. 37). Thus, the pulse laser beam after the amplification operation is repeated may be incident on the first surface of the polarization beam splitter 339 as the linearly polarized pulse laser beam B25 polarized in a direction perpendicular to the paper plane and be outputted to the outside of the resonator.

While the voltage is applied to the Pockels cell 340 and the amplification operation is repeated (see FIG. 38), the pulse laser beam B1 newly outputted from the mode-locked laser device 302 may enter the Pockels cell 340 as the linearly polarized pulse laser beam B6 polarized in a direction perpendicular to the paper plane. While the voltage is applied to the Pockels cell 340, the pulse laser beam B6 may be transmitted through the quarter-wave plate 341 twice and the Pockels cell 340 twice (see pulse laser beams Ba5, Ba6, Ba7, and Ba8) and return as the pulse laser beam B25. Here, the pulse laser beam B25 may have its polarization direction oriented to the same direction as that of the pulse laser beam B6. Accordingly, the pulse laser beam B25 may be reflected by the first surface of the polarization beam splitter 339, and as a pulse laser beam B26, outputted to the outside of the resonator without being amplified even once.

A timing at which the high-voltage power supply 343 sets the voltage applied to the Pockels cell 340 to ON/OFF may be determined by the AND signal of the clock signal and the first timing signal described above. The AND signal may be supplied to the voltage waveform generation circuit 344 in the regenerative amplifier 305 from the AND circuit 312. The voltage waveform generation circuit 344 may generate a voltage waveform with the AND signal as a trigger, and supply this voltage waveform to the high-voltage power supply 343. The high-voltage power supply 343 may generate a pulse voltage in accordance with the voltage waveform and apply this pulse voltage to the Pockels cell 340. The first timing signal, the AND signal, and the voltage waveform by the voltage waveform generation circuit 344 will be described later with reference to FIGS. 39C through 39E.

18.4.4 Timing Control

Figure 39A:
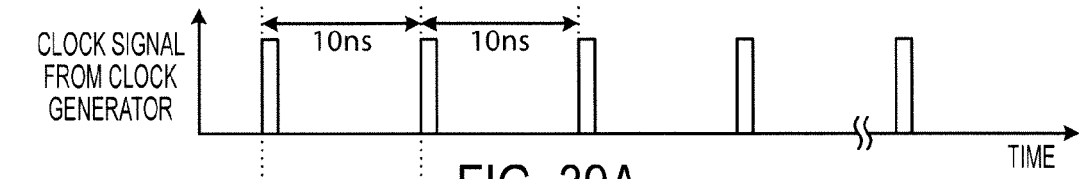
FIG. 39A is a timing chart of a clock signal in the pre-pulse laser apparatus shown in FIG. 35.

FIGS. 39A through 39E show timing charts of various signals in the pre-pulse laser apparatus shown in FIG. 35. FIG. 39A is a timing chart of the clock signal outputted from the clock generator. The clock generator 301 may, for example, be configured to output the clock signal at a repetition rate of 100 MHz. In this case, the interval of the pulses may be 10 ns.

Figure 39B:
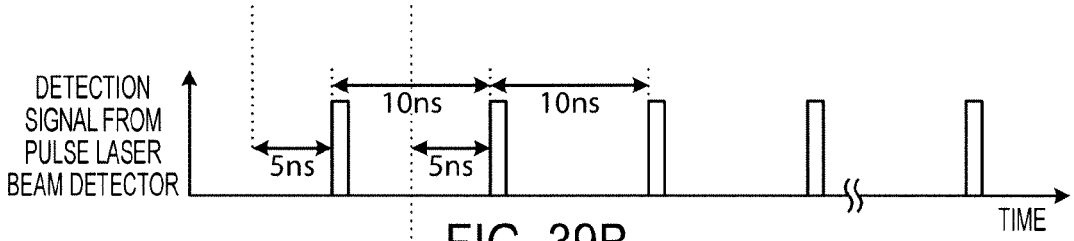
FIG. 39B is a timing chart of a detection signal in the pre-pulse laser apparatus shown in FIG. 35.

FIG. 39B is a timing chart of a detection signal outputted from the pulse laser beam detector. A repetition rate of the detection signal may depend on the repetition rate of the pulse laser beam outputted from the mode-locked laser device 302. The repetition rate of the pulse laser beam from the mode-locked laser device 302 may be adjusted by adjusting the resonator length of the mode-locked laser device 302. In this example, the repetition rate of the pulse laser beam may be approximately 100 MHz. By fine-tuning the repetition rate of the pulse laser beam, the phase difference from the clock signal shown in FIG. 39A may be adjusted. Thus, a feedback-control may be carried out on the mode-locked laser device 302 so that the detection signal of the pulse laser beam is in synchronization with the clock signal shown in FIG. 39A with the fourth delay time of, for example, 5 ns.

Figure 39C:
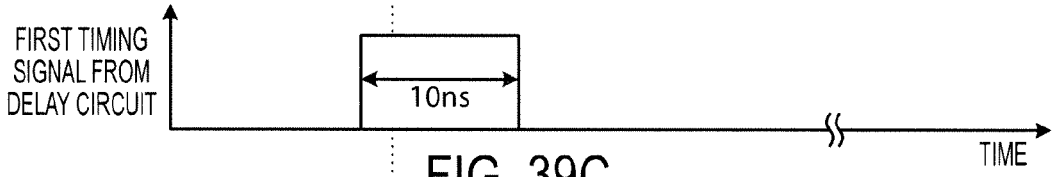
FIG. 39C is a timing chart of a first timing signal in the pre-pulse laser apparatus shown in FIG. 35.

FIG. 39C is a timing chart of the first timing signal outputted from the delay circuit. As stated above, the first timing signal from the delay circuit 153 may be a signal in which the first delay time is given to the target detection signal by the target sensor 104. A repetition rate of the first timing signal may depend on the repetition rate of the droplets outputted from the target supply unit 2. The droplets may, for example, be outputted from the target supply unit 2 at a repetition rate of approximately 100 kHz. The pulse duration of the first timing signal may be 10 ns.

Figure 39D:
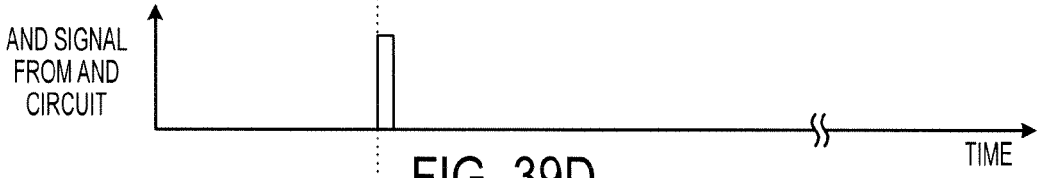
FIG. 39D is a timing chart of an AND signal in the pre-pulse laser apparatus shown in FIG. 35.

FIG. 39D is a timing chart of the AND signal outputted from the AND circuit. The AND signal from the AND circuit 312 may be a signal of a logical product of the clock signal and the first timing signal. When the pulse duration of the first timing signal is substantially the same as the interval of the clock signal, such as 10 ns, a single pulse of the AND signal may be generated for a single pulse of the first timing signal. The AND signal may be generated to be substantially in synchronization with a part of multiple pulses of the clock signal.

Figure 39E:
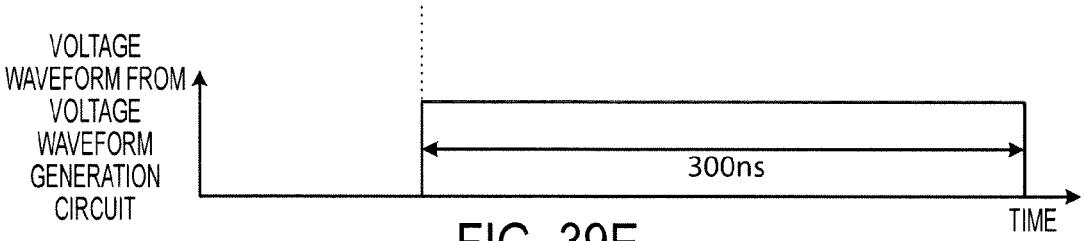
FIG. 39E is a timing chart of a voltage waveform in the pre-pulse laser apparatus shown in FIG. 35.

FIG. 39E is a timing chart of the voltage waveform outputted from the voltage waveform generation circuit. The voltage waveform from the voltage waveform generation circuit 344 may be generated at substantially the same time as the AND signal from the AND circuit 312. The voltage waveform may, for example, have a pulse duration of 300 ns. For example, when the resonator length of the regenerative amplifier 305 is 1 m, the pulse laser beam makes 50 round trips in the resonator in 300 ns at the speed of light of $3\times10^8$ m/s. By setting a pulse duration of the voltage waveform, the number of round trips the pulse laser beam makes in the resonator in the regenerative amplifier 305 may be set.

With the above timing control, the clock signal and the pulse laser beam from the mode-locked laser device 302 may be in synchronization with each other with the fourth delay time, and the AND signal may be in synchronization with a part of the pulses of the clock signal. Thus, while the pulse laser beam travels in a specific section of the resonator in the regenerative amplifier 305, the voltage applied to the Pockels cell 340 from the high-voltage power supply 343 may be set to ON/OFF. Accordingly, only a desired pulse in the pulse laser beam from the mode-locked laser device 302 may be amplified to a desired beam intensity, and outputted to strike a droplet.

Further, with the above-described timing control, the timing of a pulse from the regenerative amplifier 305 may be controlled with a resolving power in accordance with the interval of the pulses from the mode-locked laser device 302. For example, a droplet outputted from the target supply unit 2 and traveling inside the chamber 1 at a speed of 30 m/s to 60 m/s may move 0.3 μm to 0.6 μm in 10 ns, which is the interval of the pulses from the mode-locked laser device 302. When the diameter of the droplet is 20 μm, the resolving power of 10 ns is sufficient to irradiate the droplet with the pulse laser beam.

18.4.5 Examples of Laser Medium

In the above-described example, an Nd:$YVO_4$ crystal is used as the laser crystal 322 in the mode-locked laser device 302, and an Nd:YAG crystal is used as the laser crystal 336 in the regenerative amplifier 305. However, this disclosure is not limited to these crystals.

As one example, an Nd:YAG crystal may be used as a laser crystal in each of the mode-locked laser device 302 and the regenerative amplifier 305.

As another example, a Titanium-doped Sapphire (Ti:Sapphire) crystal may be used as a laser crystal in each of the mode-locked laser device 302 and the regenerative amplifier 305.

As yet another example, a ruby crystal may be used as a laser crystal in each of the mode-locked laser device 302 and the regenerative amplifier 305.

As yet another example, a dye cell may be used as a laser medium in each of the mode-locked laser device 302 and the regenerative amplifier 305.

As still another example, a triply ionized neodymium-doped glass ($Nd^{3+}$:glass) may be used as a laser medium in each of the mode-locked laser device 302 and the regenerative amplifier 305.

18.5 Main Pulse Laser Apparatus

Figure 40:
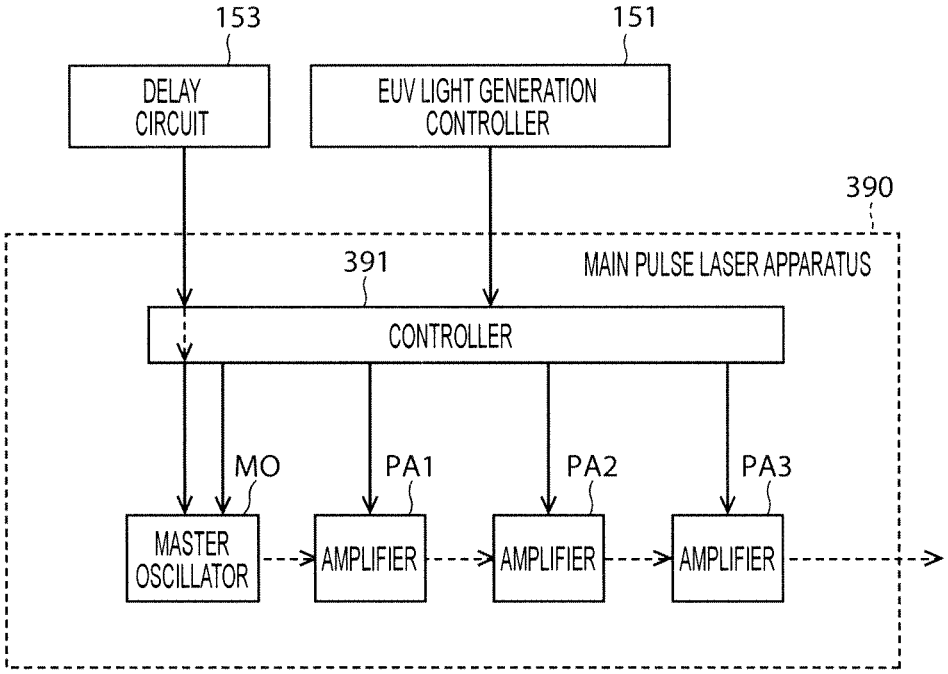
FIG. 40 schematically illustrates an exemplary configuration of a main pulse laser apparatus shown in FIG. 27.

FIG. 40 schematically illustrates an exemplary configuration of a main pulse laser apparatus shown in FIG. 27. The main pulse laser apparatus 390 may include a master oscillator MO, amplifiers PA1, PA2, and PA3, and a controller 391.

The master oscillator MO may be a $CO_2$ laser apparatus in which a $CO_2$ gas is used as a laser medium, or may be a quantum cascade laser apparatus configured to oscillate in a bandwidth of the $CO_2$ laser apparatus. The amplifiers PA1, PA2, and PA3 may be provided in series in a beam path of a pulse laser beam outputted from the master oscillator MO. Each of the amplifiers PA1, PA2, and PA3 may include a laser chamber (not shown) filled with a $CO_2$ gas serving as a laser medium, a pair of electrodes (not shown) provided inside the laser chamber, and a power supply (not shown) configured to apply a voltage between the pair of electrodes.

The controller 391 may be configured to control the master oscillator MO and the amplifiers PA1, PA2, and PA3 based on a control signal from the EUV light generation controller 151. The controller 391 may output the aforementioned second timing signal from the delay circuit 153 to the master oscillator MO. The master oscillator MO may output each pulse of the pulse laser beam in accordance with the second timing signal serving as triggers. The pulse laser beam may be amplified in the amplifiers PA1, PA2, and PA3. Thus, the main pulse laser apparatus 390 may output the main pulse laser beam M in synchronization with the second timing signal from the delay circuit 153.

19. Eleventh Embodiment

Figure 41:
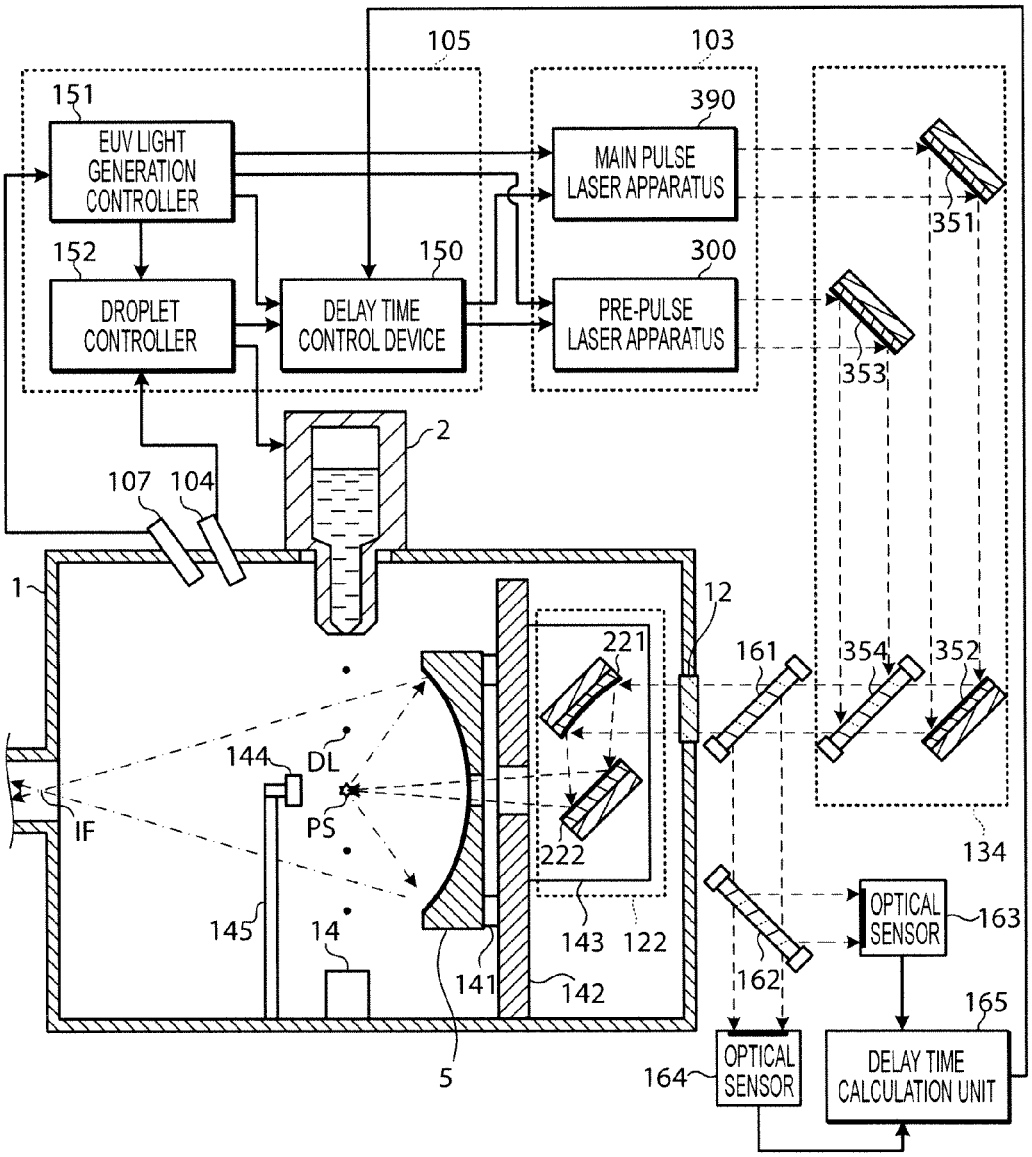
FIG. 41 is a partial sectional view schematically illustrating an exemplary configuration of an EUV light generation system according to an eleventh embodiment.

FIG. 41 is a partial sectional view schematically illustrating an exemplary configuration of an EUV light generation system according to an eleventh embodiment of this disclosure. The EUV light generation system according to the eleventh embodiment may include beam splitters 161 and 162, optical sensors 163 and 164, a delay time calculation unit 165, and a delay time control device 150. Other points may be similar to those of the tenth embodiment.

The beam splitter 161 may be provided in a beam path of the pre-pulse laser beam P and the main pulse laser beam M between the dichroic mirror 354 and the laser beam focusing optical system 122. The beam splitter 161 may be coated with a film configured to transmit the pre-pulse laser beam P and the main pulse laser beam M with high transmittance and reflect a part of the pre-pulse laser beam P and the main pulse laser beam M.

The beam splitter 162 may be provided in a beam path of the pre-pulse laser beam P and the main pulse laser beam M reflected by the beam splitter 161. The beam splitter 162 may be coated with a film configured to reflect the pre-pulse laser beam P with high reflectance and transmit the main pulse laser beam M with high transmittance.

The optical sensor 163 may be provided in a beam path of the pre-pulse laser beam P reflected by the beam splitter 162. The optical sensor 164 may be provided in a beam path of the main pulse laser beam M transmitted through the beam splitter 162. The optical sensors 163 and 164 may be provided such that the respective optical lengths from the beam splitter 162 are equal to each other. The optical sensor 163 may detect the pre-pulse laser beam P and output a detection signal. The optical sensor 163 may include a fast-response photodiode configured to detect the pre-pulse laser beam P at a wavelength of 1.06 μm. The optical sensor 164 may detect the main pulse laser beam M and output a detection signal. The optical sensor 164 may include a fast-response thermoelectric element configured to detect the main pulse laser beam M at a wavelength of 10.6 μm.

The delay time calculation unit 165 may be connected to the optical sensors 163 and 164 through respective signal lines. The delay time calculation unit 165 may receive detection signals from the respective optical sensors 163 and 164, and calculate a delay time δT from the detection of the pre-pulse laser beam P to the detection of the main pulse laser beam M based on the received detection signals. Here, the calculated delay time δT may be equivalent to the aforementioned third delay time, and thus this delay time δT will serve as the third delay time hereinafter. The delay time calculation unit 165 may output the calculated third delay time δT to the delay time control device 150.

Figure 42:
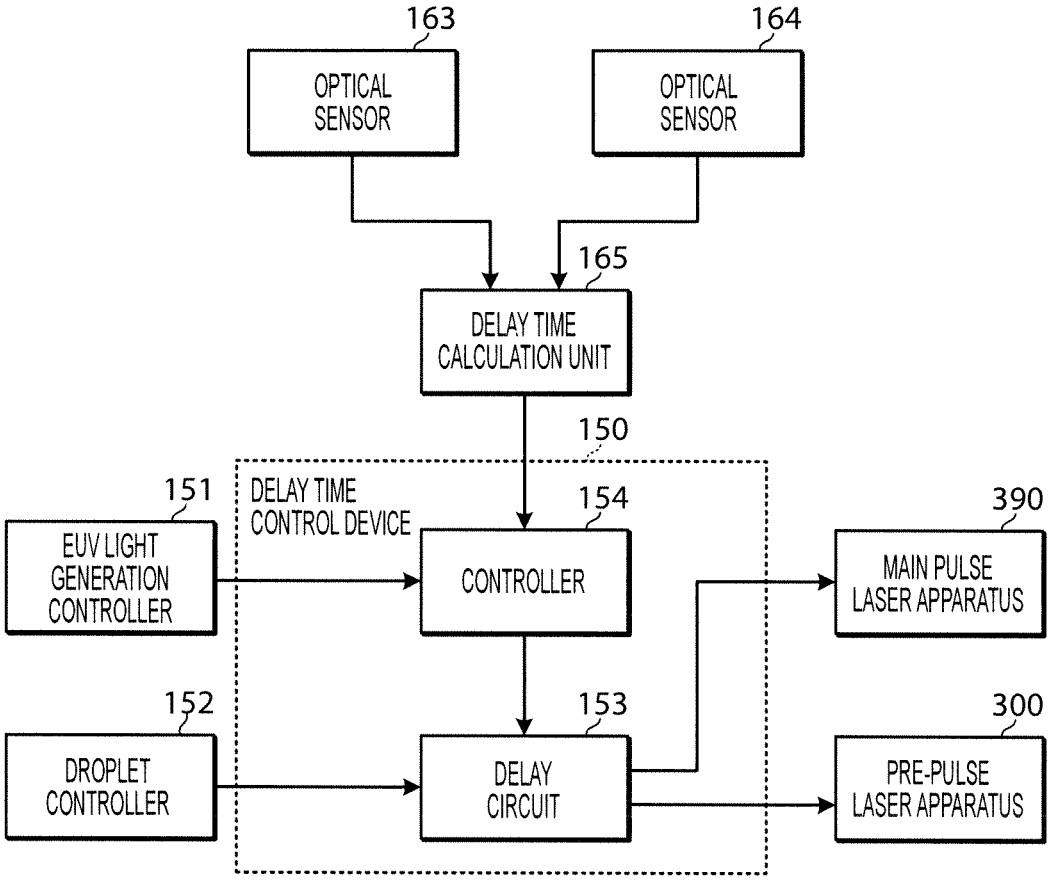
FIG. 42 schematically illustrates an exemplary configuration of a delay time control device shown in FIG. 41.

FIG. 42 schematically illustrates an exemplary configuration of a delay time control device shown in FIG. 41. The delay time control device 150 may include the delay circuit 153 and a controller 154. The delay circuit 153 may output to the pre-pulse laser apparatus 300 the first timing signal in which the first delay time is given to the target detection signal outputted from the droplet controller 152. Further, the delay circuit 153 may output to the main pulse laser apparatus 390 the second timing signal having the second delay time δTo from the first timing signal. The second delay time δTo may vary.

The controller 154 may receive a target value δTt of the third delay time from the EUV light generation controller 151. Further, the controller 154 may receive the calculated third delay time δT from the delay time calculation unit 165. The controller 154 may be configured to control the delay circuit 153 to modify the second delay time δTo based on a difference between the third delay time δT and the target value δTt.

Figure 43:
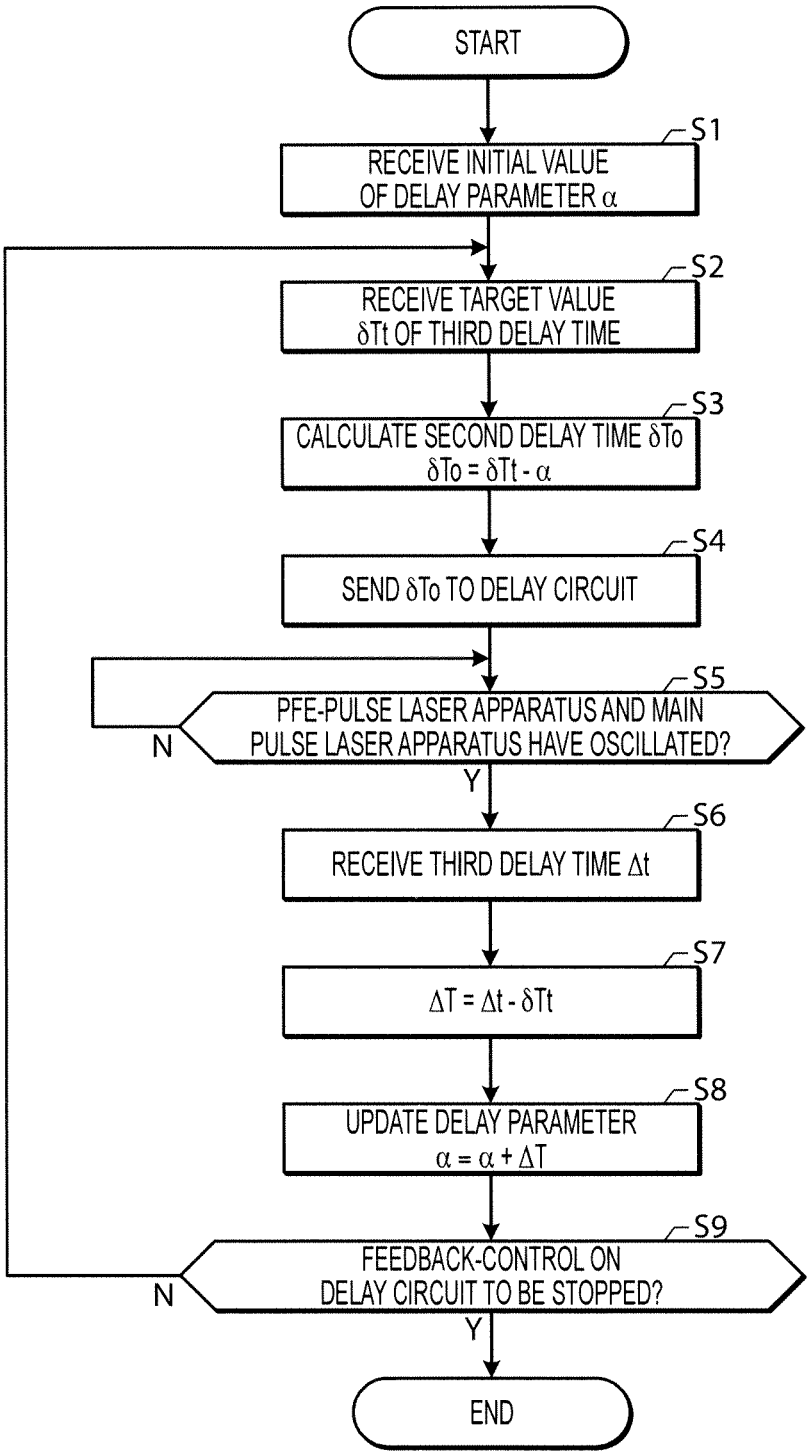
FIG. 43 is a flowchart showing an exemplary operation of a controller shown in FIG. 42.

FIG. 43 is a flowchart showing an exemplary operation of the controller shown in FIG. 42. The controller 154 may carry out a feedback-control on the delay circuit 153 based on the difference between the third delay time δT and the target value δTt.

The controller 154 may first receive an initial value of a delay parameter α from the EUV light generation controller 151 (Step S1). The initial value of the delay parameter α may be calculated from the following expression.

$$\alpha=(Lm-Lp)/c$$

Here, Lm may be a beam path length of the main pulse laser beam M from the master oscillator MO (see FIG. 40) of the main pulse laser apparatus 390 to the plasma generation region PS, Lp may be a beam path length of the pre-pulse laser beam P from the regenerative amplifier 305 (see FIG. 35) of the pre-pulse laser apparatus 300 to the plasma generation region PS, and c may be the speed of light ($3\times10^8$ m/s).

The main pulse laser apparatus 390 may include a larger number of amplifiers than the pre-pulse laser apparatus 300 in order to output the main pulse laser beam M having a higher beam intensity than the pre-pulse laser beam P. Accordingly, the beam path length Lm of the main pulse laser beam M may be longer than the beam path length Lp of the pre-pulse laser beam P, and thus the delay parameter α may be greater than 0.

Then, the controller 154 may receive a target value δTt of the third delay time from the EUV light generation controller 151 (Step S2). The controller 154 may then calculate the second delay time δTo by subtracting the delay parameter α from the target value δTt (Step S3). Subsequently, the controller 154 may send the calculated second delay time δTo to the delay circuit 153 (Step S4).

Thereafter, the controller 154 may determine whether or not the pre-pulse laser apparatus 300 and the main pulse laser apparatus 390 have oscillated (Step S5). When either of these laser apparatuses has not oscillated (Step S5; NO(N)), the controller 154 may stand by until these laser apparatuses oscillate. When both laser apparatuses have oscillated (Step S5; YES (Y)), the processing may proceed to Step S6.

Then, the controller 154 may receive the calculated third delay time δT from the delay time calculation unit 165 (Step S6). The controller 154 may then calculate a difference ΔT between the third delay time δT and the target value δTt through the following expression (Step S7).

$$\Delta T=\delta T-\delta Tt$$

Subsequently, the controller 154 may update the delay parameter α by adding the difference ΔT between the third delay time δT and the target value δTt to the delay parameter α (Step S8). That is, when the third delay time δT is greater than the target value δTt (ΔT>0), the delay parameter α may be increased by ΔT so that the second delay time ΔTo becomes smaller.

Thereafter, the controller 154 may determine whether or not the feedback-control on the delay circuit 153 is to be stopped (Step S9). For example, when the output of the pulse laser beam is to be stopped based on a control signal from the EUV light generation controller 151, the feedback-control on the delay circuit 153 may be stopped. Alternatively, when the output energy of the EUV light reaches or exceeds a predetermined value as a result of repeating Steps S2 through S8 multiple times, the feedback-control on the delay circuit 153 may be stopped and the second delay time δTo may be fixed to generate the EUV light. When the feedback-control on the delay circuit 153 is not to be stopped (Step S9; NO), the processing may return to Step S2, and the controller 154 may receive the target value δTt of the third delay time and carry out the feedback-control on the delay circuit 153. When the feedback-control on the delay circuit 153 is to be stopped (Step S9; YES), the processing in this example may be terminated.

As described above, by carrying out the feedback-control on the delay circuit 153 based on the calculated third delay time δT, the third delay time δT may be stabilized with high precision. As a result, the diffused target may be irradiated with the main pulse laser beam M at an optimal third delay time, and a CE may be improved. Further, even in a case where the third delay time δT varies for some reason although the second delay time δTo is fixed, the feedback-control may allow the third delay time δT to be stabilized.

In the eleventh embodiment, the feedback-control may be carried out on the delay circuit based on the calculated third delay time. However, this disclosure is not limited thereto, and the third delay time may not be calculated. For example, the second delay time δTo may be calculated from the initial value of the aforementioned delay parameter α and the aforementioned target value δTt, and the delay circuit 153 may be controlled based on this second delay time δTo.

The above-described embodiments and the modifications thereof are merely examples for implementing this disclosure, and this disclosure is not limited thereto. Making various modifications according to the specifications or the like is within the scope of this disclosure, and other various embodiments are possible within the scope of this disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A system for generating extreme ultraviolet light by irradiating a target with a pre-pulse laser beam and a main laser beam to turn the target into plasma, the system comprising:

a chamber;

a target supply configured to supply the target to a region inside the chamber;

a first laser apparatus configured to output the pre-pulse laser beam having a pulse duration of smaller than 1 ns, the pre-pulse laser beam having a fluence equal to or lower than a fluence of the main pulse laser beam, the fluence of the pre-pulse laser beam being equal to or higher than 6.5 J/cm$^2$ and equal to or lower than 52 J/cm$^2$, where the target is to be irradiated with the pre-pulse laser beam;

a second laser apparatus configured to output the main pulse laser beam, where the target irradiated with the pre-pulse laser beam is to be further irradiated with the main pulse laser beam; and an intensity distribution control optical system for controlling intensity distribution of the pre-pulse laser beam so that the pre-pulse laser beam has a uniform intensity distribution region in a first cross-section where the target is irradiated with the pre-pulse laser beam, the first cross-section being perpendicular to a first traveling path of the pre-pulse laser beam, wherein:

the first laser apparatus is configured to output the pre-pulse laser beam so as to make the target be diffused in a dome shape, the uniform intensity distribution region of the first cross-section of the pre-pulse laser beam has an area larger than an area of a maximum cross section of the target, the maximum cross section of the target being perpendicular to the first traveling path, and the main pulse laser beam does not have a uniform intensity distribution region in a second cross-section where the target is irradiated with the main pulse laser beam, the second cross-section being perpendicular to a second traveling path of the main pulse laser beam.

2. The system according to claim 1, wherein the second cross-section of the main pulse laser beam has a diameter larger than the target diffused in a dome shape.

3. The system according to claim 2, wherein the target diffused in a dome shape has a first portion where the target material is diffused in an annular shape and a second portion which is adjacent to the first portion and in which the target material is diffused in a dome shape, and a density of the target material is higher in the first portion than in the second portion.

4. The system according to claim 3, wherein the second portion of the target is diffused in the dome shape opposite to a direction in which the pre-pulse laser beam travels.

5. The system according to claim 4, wherein the first portion of the target is diffused in the annular shape to a direction in which the pre-pulse laser beam travels.

6. The system according to claim 5, wherein the target diffused in a dome shape further has a third portion surrounded by the first portion, and a density of the target material is higher in the first portion than in the third portion.

7. The system according to claim 6, wherein the third portion is also surrounded by the second portion, and a density of the target material is higher in the second portion than in the third portion.

8. The system according to claim 7, wherein the first laser apparatus is configured to output the pre-pulse laser beam having a pulse duration of smaller than 500 ps.

9. The system according to claim 8, wherein the first laser apparatus is configured to output the pre-pulse laser beam having a pulse duration of smaller than 50 ps.

10. The system according to claim 9, wherein the first laser apparatus is configured to output the pre-pulse laser beam having a fluence equal to or higher than 30 $J/cm^2$.

11. The system according to claim 10, wherein the first laser apparatus is configured to output the pre-pulse laser beam having a fluence equal to or higher than 45 $J/cm^2$.

12. The system according to claim 11, wherein a delay time for the irradiation with the main pulse laser beam is no less than 0.5 μs and no more than 1.8 μs from the irradiation with the pre-pulse laser beam.

13. The system according to claim 12, wherein a delay time for the irradiation with the main pulse laser beam is no less than 0.7 μs and no more than 1.6 μs from the irradiation with the pre-pulse laser beam.

14. The system according to claim 13, wherein a delay time for the irradiation with the main pulse laser beam is no less than 1.0 μs and no more than 1.4 μs from the irradiation with the pre-pulse laser beam.

15. The system according to claim 14, wherein the first laser apparatus includes an oscillator and an amplifier, the amplifier including a solid laser medium.

16. The system according to claim 15, wherein the amplifier includes at least one of a titanium-doped sapphire crystal, an ytterbium-doped optical fiber, a neodymium-doped yttrium aluminum garnet crystal, a ruby crystal, a dye cell and a triply ionized neodymium-doped glass.

17. The system according to claim 16, wherein the oscillator ncludes a mode-locked laser.

18. The system according to claim 1, wherein a delay time for the irradiation with the main pulse laser beam is no less than 0.5 μs and no more than 1.8 μs from the irradiation with the pre-pulse laser beam.

19. The system according to claim 1, wherein a delay time for the irradiation with the main pulse laser beam is no less than 0.7 μs and no more than 1.6 μs from the irradiation with the pre-pulse laser beam.

20. The system according to claim 1, wherein a delay time for the irradiation with the main pulse laser beam is no less than 1.0 μs and no more than 1.4 μs from the irradiation with the pre-pulse laser beam.

* * * * *

UNITED STATES PATENT AND TRADEMARK OFFICE

CERTIFICATE OF CORRECTION

PATENT NO. : 9,072,153 B2
APPLICATION NO. : 13/572248
DATED : June 30, 2015
INVENTOR(S) : Osamu Wakabayashi et al.

It is certified that error appears in the above-identified patent and that said Letters Patent is hereby corrected as shown below:

On the Title page, Item (63), Related U.S. Application Data should read:

--Continuation-in-part of Application No. 13/523,446, filed on June 14, 2012, which is a Continuation-in-part of PCT/JP2011/056820, filed March 22, 2011.--

Signed and Sealed this
Twenty-second Day of March, 2016

Michelle K. Lee

Michelle K. Lee
*Director of the United States Patent and Trademark Office*